US010414571B2

(12) United States Patent
Wallace

(10) Patent No.: US 10,414,571 B2
(45) **Date of Patent: *Sep. 17, 2019**

(54) LIQUID SEQUESTERING CONTAINER, OPTIONALLY WITH PEELABLY DETACHABLE LAYERS

(71) Applicant: Converter Manufacturing, LLC, Orwigsburg, PA (US)

(72) Inventor: Millard F. Wallace, Orwigsburg, PA (US)

(73) Assignee: Converter Manufacturing, LLC, Orwigsburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/053,108

(22) Filed: Feb. 25, 2016

(65) Prior Publication Data

US 2016/0176611 A1 Jun. 23, 2016

Related U.S. Application Data

(62) Division of application No. 13/415,781, filed on Mar. 8, 2012, now Pat. No. 9,302,842.

(Continued)

(51) Int. Cl.
*B65D 81/26* (2006.01)
*B65D 51/28* (2006.01)

(Continued)

(52) U.S. Cl.
CPC ..... *B65D 81/264* (2013.01); *B65D 51/28* (2013.01); *B65D 77/30* (2013.01); *B65D 81/262* (2013.01);

(Continued)

(58) Field of Classification Search
CPC .... B65D 81/264; B65D 81/262; B65D 51/28; B65D 77/30; B65D 1/22; B65D 1/26;

(Continued)

(56) References Cited

U.S. PATENT DOCUMENTS 5,496,575 A * 3/1996 Newarski ..... B65D 81/3205 206/222
6,223,894 B1 * 5/2001 Lemaire ..... B65D 81/264 206/204

(Continued)

*Primary Examiner* — J. Gregory Pickett
*Assistant Examiner* — Elizabeth Volz
(74) *Attorney, Agent, or Firm* — Preti Flaherty Beliveau & Pachios LLP; Gary D. Colby

(57) ABSTRACT

The disclosure relates to containers and other shaped articles (e.g., trays and dishes) for containing articles such as food products (e.g., cuts of meat and poultry or liquid-sensitive electronic parts) in shaped articles such as. In one aspect, the container has a reservoir portion into which liquid can be sequestered. In another aspect, the container includes a thermoformable substrate, a liner, and a lidding material, the lidding and the liner defining a compartment for containing articles. The compartment can be detached from the substrate by detaching the liner from the substrate without necessarily rupturing the compartment. A substantial portion of the containers described herein can be recycled by separating the liner and/or lidding from the substrate. The disclosure also relates to methods of making thermoformed articles having multiple layers that does not rely on use of a coextruded or other composite thermoplastic-containing substrate.

20 Claims, 13 Drawing Sheets
(8 of 13 Drawing Sheet(s) Filed in Color)

Related U.S. Application Data

(60) Provisional application No. 61/552,687, filed on Oct. 28, 2011, provisional application No. 61/552,663, filed on Oct. 28, 2011, provisional application No. 61/494,170, filed on Jun. 7, 2011, provisional application No. 61/487,677, filed on May 18, 2011, provisional application No. 61/450,565, filed on Mar. 8, 2011.

(51) Int. Cl.

| | |
|---|---|
| ***B65D 77/30*** | (2006.01) |
| *B65D 1/26* | (2006.01) |
| *B65D 25/14* | (2006.01) |
| *B65D 1/22* | (2006.01) |
| *B65D 25/04* | (2006.01) |

(52) U.S. Cl.

CPC ..... *B65D 1/22* (2013.01); *B65D 1/26* (2013.01); *B65D 25/04* (2013.01); *B65D 25/14* (2013.01); *B65D 2577/205* (2013.01); *B65D 2577/2075* (2013.01)

(58) Field of Classification Search

CPC .. B65D 25/04; B65D 25/14; B65D 2577/205; B65D 2577/2075

USPC ..... 220/501, 571; 206/204, 557

See application file for complete search history.

(56) References Cited

U.S. PATENT DOCUMENTS

| | | | | |
|---|---|---|---|---|
| 7,921,992 | B2 | 4/2011 | LaRue et al. | |
| 9,302,842 | B2 * | 4/2016 | Wallace | B65D 81/262 |
| 2007/0056863 | A1 * | 3/2007 | Chou | B65D 81/262 206/204 |
| 2008/0031553 | A1 * | 2/2008 | Tokita | B65D 33/2508 383/113 |
| 2012/0052165 | A1 * | 3/2012 | Becraft | A23B 4/16 426/129 |

* cited by examiner

LIQUID SEQUESTERING CONTAINER, OPTIONALLY WITH PEELABLY DETACHABLE LAYERS

CROSS-REFERENCES TO RELATED APPLICATIONS

This application is a divisional of U.S. non-provisional application Ser. No. 13/415,781 (allowed), which was filed on 8 Mar. 2012 and which is entitled to priority pursuant to 35 § 119(e) to U.S. provisional patent application 61/450,565, which was filed on 8 Mar. 2011; to U.S. provisional patent application 61/487,677, which was filed on 18 May 2011; to U.S. provisional patent application 61/494,170, which was filed on 7 Jun. 2011; to U.S. provisional patent application 61/552,663, which was filed on 28 Oct. 2011; and to provisional patent application 61/552,687, which was filed on 28 Oct. 2011.

BACKGROUND OF THE DISCLOSURE

Field of the Disclosure

This disclosure relates generally to thermoformable polymeric materials and articles formed from such materials. In one aspect, the present disclosure relates generally to a tray for supporting items, including liquid-exuding items such as cuts of meat or poultry. The tray can be adapted to receive lidstock in one or more locations and can have peelable layers, such as at a food-contacting surface thereof. The tray can include or have attached thereto a liquid-sequestering compartment that can be peeled from the tray. In another aspect, the disclosure relates to methods of making laminated plastic articles such as trays of this type.

Packaging Materials, Including Food Packages

Packaging materials are widely used to contain materials for shipping and sale. Particularly when wet items are to be contained and when items which can be damaged by external liquids are to be contained, packaging materials that are relatively impervious to liquids are employed. Because such materials tend to prevent fluid flow across the packaging, they can have the effect of trapping liquid within the packaging, as well as excluding external liquid from contacting the packaged contents.

For example, trays, cartons, and other containers are commonly used to contain and display food items at the point of sale. In such containers, liquid that runs off from or is exuded from items on the container can form a pool or puddle within the container, and it can be undesirable for such a pool or puddle to be visible to one handling the container (e.g., a customer considering whether to purchase the container and its contents). By way of example, cuts of meat and poultry are commonly sold at retail outlets (e.g., in supermarkets or at butcher shops) in packaging containers in which the cut is supported by a plastic or foam tray and wrapped with a polymeric sheet, at least a portion of which includes a clear window through which the cut may be viewed by potential purchasers. By way of further example, prepared solid or semi-solid foods are sometimes packaged in containers having a clear portion through which the food can be viewed.

In either of these situations, the presence of liquid that is visible (either when the package is at rest or upon handling by a potential purchaser) can be considered unsightly and detract from the desirability of the item, as perceived by the potential purchaser. Liquid in a food container can also harbor microorganisms, support their growth, and facilitate their transfer among items within the container, leading to spoilage of food items, appearance of spoilage, or both. Furthermore, transfer of free liquid from one component of a packaged food item to another (e.g., liquid exuded from a cooked meat item and absorbed by a pasta component packaged in the same container) can degrade the desirability or other properties of the food components. In each of these situations, it is desirable that liquid within the container be sequestered.

Known food containers often have compartments (e.g., channels or voids) or absorbent materials (e.g., paper or silica-based absorbents) therein for sequestering undesirable fluid.

Sequestration of fluid within or outside of packages is also desirable in non-food applications. By way of example, many electronic and textile articles can be damaged by contact with liquid during shipping and storage. It is desirable to avoid contact of such items with moisture. Water-tight packaging of items can prevent moistening of these items, but variations in atmospheric conditions among packaging, shipping, and storage locations can cause formation of liquid within even water-tight packages, as can breach of the packaging materials and subsequent contact with liquid. It is desirable to include a simple mechanism by which liquid which may form within or be introduced into such containers can be sequestered, thereby avoiding damage to liquid-sensitive contents.

Sequestration of undesirable liquids within containers has been effected by others by configuring containers such that they include a portion into which liquid may drain under the influence of gravity. An example of such a container is a meat tray having a roughly planar region for supporting a cut of meat and a trough surrounding the planar region into which meat exudate (often termed "purge" by workers in this field) or other fluids can flow under the influence of gravity. A drawback of such containers is that when a potential purchaser handles the container, liquid within the trough can flow under gravity to other portions of the container, potentially spilling or becoming visible in a clear portion of a flexible polymeric wrapper that encompasses the container. Gravity-dependent packaging can also be of little assistance for separating liquids from items capable of absorbing it.

Liquid sequestration within containers has also been effected by others by including within a container a material (e.g., silica gel, porous paper, and liquid-absorbing fibrous or amorphous polymer materials) that absorbs intra-container liquid. Such absorbent materials can reduce spilling and intra-container flow of purge and other liquids. However, whether imbued with liquid or not, absorbent materials can adversely affect disposal of the packaging once it is no longer needed. By way of example, absorbent materials (especially those having fluid retained therein) can adversely affect the recyclability of the packaging or the willingness of a refuse source to accept the used packaging. In the context of food packaging, the absorbent materials can also be unsightly upon unpackaging and can harbor pathogens in close contact with food items. Even containers that do not include a fluid-absorbing material are often considered unsanitary, by consumers, by potential recycling facilities, or by both.

Disposal of used food containers accounts for a tremendous amount of solid waste and burned rubbish. In recent decades, significant effort has been expended to reduce the quantity of such waste and to increase the amounts of such waste that are usable and used in recycled products. Food trays in particular have proven to be recalcitrant to waste-reduction efforts.

Food trays and other food packages need to have sufficient size, bulk, and rigidity to contain and support food products throughout the handling involved in food harvesting, preparation, shipping, and selling processes. Such containers need also comply with sanitary and regulatory needs to prevent food contamination and spoilage. They also need to contain and display contained foodstuffs in a manner consistent with ordinary retail marketing. Furthermore, in order to avoid being considered non-recyclable refuse by end users and recyclers, such containers need also be readily separable from visible and perceived contamination by food residue.

A need exists for containers which are capable of containing food in a safe, practical, and marketable condition and which are nonetheless substantially recyclable. Such containers are disclosed herein, as are methods of making and using them.

A need also exists for containers which have the capacity to sequester fluid present within the container and which have favorable disposability characteristics even upon sequestration of fluid. Such containers are disclosed herein, as are methods of making and using them.

Food Packaging Films

Use of homopolymer films and laminated polymer films to coat food-contacting surfaces is well known in the fields of food preparation, packaging, and storage. Such films are in wide use and many such films are approved by relevant regulatory agencies, such as the Food and Drug Administration in the U.S., for food- and food-preparation-related uses.

One common use of polymer films in the food industry is for packaging of food items in sealed containers. It is recognized in this field that various polymer films exhibit different properties, particularly as they relate to permeability of polymer films to water and gases. In food packaging applications, polymer films having high resistance to permeation by water and oxygen are frequently used in order to prevent drying and oxidation of foods during storage, shipping, and display. In some instances, packaging that exhibits different permeability properties at different times is considered desirable. By way of example, packaging used in sale of cuts of meat often is highly impermeable to water and oxygen when it is initially packed. However, because meats develop an unattractive purplish color when stored anoxically, it can be desirable to expose the meat to oxygen prior to offering it for sale. Many in this field have developed meat storage packages (e.g., U.S. Pat. No. 4,886,690) which make use of peelable laminated films, with the laminated film substantially preventing oxygen permeation and the peeled, delaminated film permitting oxygen permeation to restore the packaged meat to a desirable red appearance prior to sale.

Other known food packaging films make use of laminated plastic sheets to form containers, with the layers of the sheets being selected for their favorable properties, such as water- or gas-permeability resistance, rigidity, tear or puncture strength, sealability, and the like. However, the need to seal seams in such sheets (e.g., using heat or adhesives) and the incompatibility of many polymer films can limit the use of desirable polymer films in such containers. Furthermore, when laminated or homogenous polymeric films are used as lidstock to seal an opening or concavity in another container component (e.g., clear, label-bearing films sealed about the perimeter of a concavity in a tray containing ground beef), existing methods of cutting and trimming the lidstock often leave ragged or wrinkled film edges that detract from the appearance of the package.

In many countries, including the U.S., government regulations specify criteria for materials which may and may not contact foodstuffs sold to the public. The regulations can limit, for example, adhesives used for food packaging and ingredients of such adhesives. Such limitations can complicate the process of selecting materials for a desired food package, since the materials must be both compatible with one another and in conformity with applicable regulations.

A need exists for food packaging films that can be used, alone, or together with food containers to appropriately package food while reducing non-recyclable packaging products and avoiding contact between packaged food and adhesives used to bind together parts of the packaging.

BRIEF SUMMARY OF THE DISCLOSURE

In one aspect, the disclosure relates to a shaped article designed for sequestering liquid between layers from which the article is formed by way of perforations through at least one of the layers. The article can include multiple layers, but includes at least two, which are herein designated the substrate layer and a liner layer. Among the advantages of the articles disclosed herein is that liquid sequestered between the layers can be retained therein despite handling and manipulation of a package containing the article. Another advantage is that the layers of the articles can be made separable, facilitating release of liquid sequestered therebetween and potentially enhancing the suitability of each layer for recycling, either together or separately. Other features and advantages are disclosed herein or evident from the subject matter that is disclosed herein.

In another aspect, the disclosure relates to improved methods for making shaped articles such as trays, bowls, cartons, and other packaging materials. Others have previously made such articles by thermoforming a laminated plastic sheet that is created by co-extrusion of multiple polymers. In the methods described herein, two or more homopolymer sheets can be brought together and laminated upon or shortly before thermoforming one or more of the sheets into the shaped article. Such processes can be performed economically, since they do not require preparation, shipping, and storage of application-specific thermoforming substrates. Furthermore, such processes facilitate switchover between thermoforming of articles having one laminated plastic structure and thermoforming of (the same or different) articles having a second (different) laminated plastic structure. These processes can be used to make the liquid-sequestering containers described herein, as well as articles that do not exhibit the ability to sequester liquids.

This disclosure also relates to a container for sequestering contents, the container having a compartment formed from a pliable material that is separably adhered to another, generally more rigid, substrate material. The pliable material is preferably in the form of a sheet that coats a face of the substrate, and is preferably peelably adhered thereto. When a lidding material is maintained in contact with the pliable material such that the pliable and lidding materials fully enclose a compartment, the contents of the compartment can be separated from the substrate without contact occurring between the contents and the substrate. The pliable material can also be used in the absence of a lidding material as a peelable coating for a tray or other container.

This disclosure further relates to a container for liquid in which the liquid is retained in a compartment or pocket that can be separated from another portion of the container while maintaining segregation of the liquid and that other portion. The compartment or pocket can also be opened or breached to release the liquid.

In an important embodiment, the disclosure relates to a liquid container that includes a relatively rigid substrate (e.g., a tray, or bowl) and a pair of flexible sheets. One of the sheets is a liner sheet that is separably attached to the substrate. The other sheet is a lidding sheet that forms a seal with the liner sheet, the seal, the liner sheet, and the lidding sheet defining a closed compartment from which liquid within the compartment cannot flow without breaching at least one of the seal, the liner sheet, and the lidding sheet. In one form, the seal is substantially more tenacious than the attachment between the liner sheet and the substrate, so that the liquid-containing compartment can be readily detached from the substrate without breaching the compartment. In another form, the seal is substantially less tenacious than the attachment between the liner sheet and the substrate, so that the liquid-containing compartment can be readily breached and substantially drained prior to separating the liner sheet from the substrate. Of course, the compartment can contain dry (e.g., powdery) contents and the structures described herein can be used to inhibit contact between such dry contents and the substrate.

In another important embodiment, the disclosure relates to a container that includes at least three sheets and a lidding sheet. In this embodiment, at least two pliable liner sheets are adhered to a substantially rigid substrate sheet. At least the liner sheet adjacent the substrate sheet is peelable therefrom. At least two of the liner sheets define a space (a "reservoir") between their adjacent faces. The reservoir communicates through a perforation with the space on the opposite face of the liner sheet that bears the perforation, such that liquid present at that face can enter the reservoir and be sequestered there (e.g., by gravity settling, capillary action, absorption by an absorbent material present in the reservoir, or some combination of these). Preferably, the liner sheet adjacent the substrate does not bear a perforation that communicates with the reservoir, so that liquid at the liner-bearing face of the container is capable of migrating or flowing into the reservoir, but is not capable of migrating thence to contact the substrate through the liner sheet adjacent the substrate, and the liner sheets (including any liquid present in the reservoir or on the liner-bearing face of the container) can be peeled from the substrate without transferring any of the liquid to the substrate. The lidding sheet can enrobe the container, be sealed to and around the perimeter of one or more of the liner sheets, or some combination of these, to form a compartment for containing liquid, a food item, an article that can be damaged by liquid, or the like.

Such an embodiment can be particularly useful for recycling of substrate materials (e.g., shaped PET food containers) in applications in which fluid contamination of the substrate renders the substrate unsuitable for recycling. By way of example, many municipal recycling streams exclude food containers contaminated with food waste; significant portions of such containers can be recycled if—as described herein—they have a peelable layer (optionally including a fluid reservoir) by means of which the food waste can be removed from the substrate.

In another important embodiment described in this disclosure, at least one liner sheet (whether or not perforated) has a quenched face that wets against the polymeric face to which it is applied. In such embodiments, liners having a quenched face can be applied to a substrate sheet and will adhere to the sheet without the need for an interposed adhesive or application of any substantial amount heat. For instance, such liner sheets can be laminated against a substrate sheet by passing the two sheets (stacked such that the quenched face of the liner is opposed against a face of the substrate sheet) through a cold nip roller to form a laminated stack in which the liner is peelably adhered to the substrate. The stack can thereafter be thermoformed (assuming one or both of the liner and substrate is formed from a thermoformable material), trimmed from the larger stack sheet, and used as food container. Following such use, the liner can be peeled from the substrate, and one or both of the liner and the substrate can be recycled.

In another embodiment, the materials described herein are formed into a sealed food container having a tray-shaped substrate to which a liner is peelably adhered at the food-bearing surface. The container is sealed with a lidstock that extends across the food-bearing surface and is relatively securely attached to the liner.

BRIEF SUMMARY OF THE SEVERAL VIEWS OF THE DRAWINGS

The patent or application file contains at least one drawing executed in color. Copies of this patent or patent application publication with color drawing(s) will be provided by the Office upon request and payment of the necessary fee.

FIG. 10 consists of FIGS. 10A and 10B.

FIG. 11 consists of FIGS. 11A and 11B.

DETAILED DESCRIPTION

Figure 1:
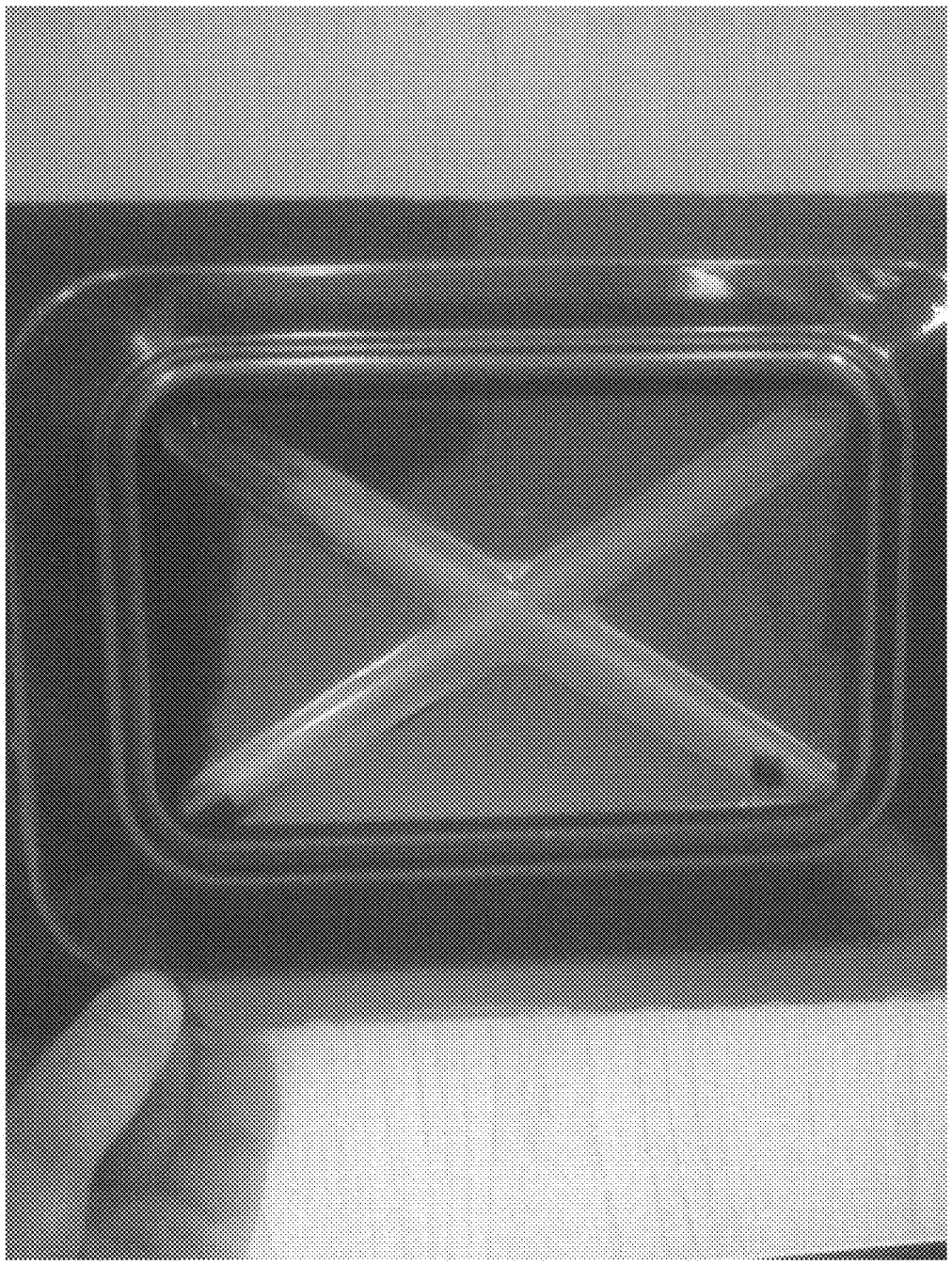
FIG. 1 is an image of a tray described in greater detail herein, the tray having a perforation (generally square shape at the lower right) through the liner sheet thereof, but not through the underlying substrate sheet, in a reservoir portion of the tray.

This disclosure relates to containers which include at least one thermoformable component and which are made by layering at least one polymeric sheet against a surface of a substrate. The sheet bounds a reservoir or compartment within which liquid or another material can be sequestered from the outside of the reservoir or compartment. The reservoir or compartment can be bounded by the substrate, such that a material within the compartment or reservoir contacts the substrate, or it can be bounded by a second (optionally perforated) sheet such that material within the compartment is contained between the first and second sheets. The sheets can be peelably adhered or adhesed to the surface of the substrate, to one another, or to both, such that the container can be partially or wholly disassembled. In an important embodiment, sheets which bound the reservoir or compartment can be separated from the substrate without breaching the reservoir or compartment.

It will be apparent to a skilled artisan that the materials described in this disclosure can be assembled in many different configurations to yield containers and other objects having various specific functionalities. For ease of discussion, aspects of several related technologies are separately described in the ensuing sections of this disclosure. Despite the separate discussions, two or more of the technologies can be incorporated into a single container or other object.

"Layered reservoir" containers described herein are, generally speaking, containers which include a reservoir defined, at least in part, by a plastic sheet layered against a substrate or against another plastic sheet. A perforation extending through the sheet (or through the substrate) permits passage of fluid between the interior and the exterior of the reservoir. The sheet can, optionally, be peelable from the substrate or other sheet, such that the reservoir can be opened, for example to discard or access fluid situated therein.

"Layered compartment" containers described herein are, generally speaking, containers which have a plastic liner sheet on a surface of a substrate. Attached to the liner sheet is a lidding sheet, the liner and lidding sheets being attached to one another about an internal compartment defined by the liner and lidding sheets and the attachment between them. The compartment can be completely enclosed by the sheets and their attachment, and the sheets can be peelable from one another (or, if preferred, fused with one another). The liner sheet can furthermore be peelable from the substrate, such as in an embodiment in which the liner and substrate can be peeled apart much more easily than the liner and lidding can be peeled from one another or in an embodiment in which the liner and lidding are more easily peeled than the liner and substrate.

Layered Reservoir Containers

This disclosure pertains to multi-layer shaped articles that are capable of sequestering liquid between their layers. Such articles have a variety of uses, such as being useful as liquid-sequestering trays in retail packages for containing cuts of meat, produce items, poultry parts, whole fish, and other items which have a tendency to exude liquid over time. The articles can also be used as packaging materials for sequestering liquid away from items that can be damaged by contact with the liquids. In another aspect, the disclosure pertains to methods of making multi-layer shaped articles without regard to whether the articles are capable of sequestering liquid between their layers.

The articles include at least two layers, herein termed a substrate sheet or layer and a liner sheet or layer. In one embodiment, the substrate layer provides the structure giving the article the predominant amount of its structural strength, its shape, or both of these. The liner layer can provide little or substantially no structural strength and can contribute little or nothing to the shape of the article. Alternatively, the liner layer can significantly contribute to the structural strength, the shape, or both, of the article, and can contribute the predominant amount of either or both.

Layered Compartment Containers

This disclosure relates to a container for sequestering contents, the container having a compartment formed from a pliable material that is separably adhered to a more rigid substrate material. The pliable material is preferably in the form of a sheet that coats a face of the substrate, and is preferably peelably adhered thereto. When a lidding material is maintained in contact with the pliable material such that the pliable and lidding materials fully enclose a compartment, the contents of the compartment can be separated from the substrate without contact occurring between the contents and the substrate. The pliable material can also be used in the absence of a lidding material as a peelable coating for a tray or other container.

More specifically, the disclosure relates to a container for liquid in which the liquid is retained in a compartment or pocket that can be separated from another portion of the container while maintaining segregation of the liquid and that other portion. The compartment or pocket can also be opened or breached to release the liquid.

In an important embodiment, the disclosure relates to a liquid container that includes a relatively rigid substrate (e.g., a tray, or bowl) and a pair of flexible sheets. One of the sheets is a liner sheet that is separably attached to the substrate. The other sheet is a lidding sheet that forms a seal with the liner sheet, the seal, the liner sheet, and the lidding sheet defining a closed compartment from which liquid within the compartment cannot flow without breaching at least one of the seal, the liner sheet, and the lidding sheet. In one form, the seal is substantially more tenacious than the attachment between the liner sheet and the substrate, so that the liquid-containing compartment can be readily detached from the substrate without breaching the compartment. In another form, the seal is substantially less tenacious than the attachment between the liner sheet and the substrate, so that the liquid-containing compartment can be readily breached and substantially drained prior to separating the liner sheet from the substrate. Of course, the compartment can contain dry (e.g., powdery) contents and the structures described herein can be used to inhibit contact between such dry contents and the substrate.

In another important embodiment, the disclosure relates to a container that includes at least three sheets and a lidding sheet. In this embodiment, at least two pliable liner sheets are adhered to a substantially rigid substrate sheet. At least the liner sheet adjacent the substrate sheet is peelable therefrom. At least two of the liner sheets define a space (a "reservoir") between their adjacent faces. The reservoir communicates through a perforation with the space on the opposite face of the liner sheet that bears the perforation, such that liquid present at that face can enter the reservoir and be sequestered there (e.g., by gravity settling, capillary action, absorption by an absorbent material present in the reservoir, or some combination of these). Preferably, the liner sheet adjacent the substrate does not bear a perforation that communicates with the reservoir, so that liquid at the liner-bearing face of the container is capable of migrating or flowing into the reservoir, but is not capable of migrating thence to contact the substrate through the liner sheet adjacent the substrate, and the liner sheets (including any liquid present in the reservoir or on the liner-bearing face of the container) can be peeled from the substrate without transferring any of the liquid to the substrate. The lidding sheet can enrobe the container, be sealed to and around the perimeter of one or more of the liner sheets, or some combination of these, to form a compartment for containing liquid, a food item, an article that can be damaged by liquid, or the like.

Such an embodiment can be particularly useful for recycling of substrate materials (e.g., shaped PET food containers) in applications in which fluid contamination of the substrate renders the substrate unsuitable for recycling. By way of example, many municipal recycling streams exclude food containers contaminated with food waste; significant portions of such containers can be recycled if—as described herein—they have a peelable layer (optionally including a fluid reservoir) by means of which the food waste can be removed from the substrate.

Containers including a fluid reservoir disposed between liner sheets are described in greater detail in U.S. provisional patent application 61/450,565, filed 8 Mar. 2011, which is incorporated herein by reference.

In another important embodiment at least one liner sheet has a quenched face that wets against the polymeric face to which it is applied. In such embodiments, liners having a quenched face can be applied to a substrate sheet and will adhere to the sheet without the need for an interposed adhesive or application of any substantial amount heat. For instance, such liner sheets can be laminated against a substrate sheet by passing the two sheets (stacked such that the quenched face of the liner is opposed against a face of the substrate sheet) through a cold nip roller to form a laminated stack in which the liner is peelably adhered to the substrate. The stack can thereafter be thermoformed (assuming one or both of the liner and substrate is formed from a thermoformable material), trimmed from the larger stack sheet, and used as food container. Following such use, the liner can be peeled from the substrate, and one or both of the liner and the substrate can be recycled.

In another embodiment, the materials described herein are formed into a sealed food container having a tray-shaped substrate to which a liner is peelably adhered at the food-bearing surface. The container is sealed with a lidstock that extends across the food-bearing surface and is relatively securely attached to the liner Definitions An "odor-resistant polymer" is a polymer that substantially inhibits migration of a gas therethrough. The ability of a polymer to inhibit migration of a gas therethrough depends on the properties (e.g., chemical nature, thickness and density) of the polymer. These properties can be empirically determined, as is typically done by ordinarily-skilled artisans in this field (e.g., by measuring passage of the gas across a polymer membrane having controlled characteristics under controlled conditions, such as gas concentration and pressure differential across the membrane). By way of example, polyvinyl acetate (PVA) and polyvinyl alcohol (PVOH) polymers are known to exhibit significant gas-barrier properties under a wide range of conditions, and are known to exhibit significantly lower gas-barrier properties under humid conditions or when saturated with water.

A "laminated" sheet is a sheet having multiple, substantially parallel planar layers, without regard to the means of attachment between the layers and without regard to the method by which the layers are assembled or attached. A laminated sheet having multiple layers can be made by coextrusion of the layers to form a single sheet or by adhesion of multiple, separately formed sheets, for example.

A "tie layer" interposed between two polymers sheets is a material which bonds to each of the two sheets and thereby bonds the two sheets together.

Two sheets of material within a laminated sheet are bound "relatively tenaciously" when the force required to separate the two sheets from one another is greater than the force required to peel the laminated sheet from a surface to which the laminated sheet is adhered.

A polymer sheet is "peelable," as used herein, if the sheet can be peeled from a surface to which it is releasably adhered by a human of ordinary strength without substantially damaging the surface and without substantially delaminating or tearing the sheet. Put another way, the sheet is "peelable" if it is sufficiently flexible and has sufficient tensile strength that it can be peeled away from the surface without tearing.

A sheet is "adhesed" to an underlying surface if an adhesive that binds both the sheet and the surface is interposed between and contacts both the sheet and the surface, such that the adhesive binds the sheet to the surface. In contrast, a sheet is "adhered" to an underlying surface if the sheet binds the surface, regardless of whether an adhesive is interposed between the sheet and the surface. By way of example, a sheet that binds with an underlying surface in the absence of an interposed adhesive, e.g., owing to the static electrical charges of the sheet and surface, is "adhered" to the surface, but is not "adhesed" to the surface.

A polymer sheet is "releasably" adhered to a surface if the sheet can be dislodged from the surface (e.g., by peeling) without tearing, delaminating, or breaking the sheet or the surface.

A polymer sheet is "pliable," as used herein, if the sheet can be substantially deformed (e.g., bent, folded, or crumpled) by application of ordinary human strength without substantially fracturing or tearing the sheet. A pliable polymer sheet preferably is "freely pliable," meaning that it can be relatively easily deformed by application of minimal human strength, analogously to the pliability of normal writing paper, plastic garbage bags, or plastic grocery bags.

A "barefoot" polymer sheet is composed of a single, unitary homopolymeric material, such as a homopolymeric sheet of PE or PET.

A polymer sheet that contacts an oily or aqueous liquid and has an "anti-permeation" polymer layer is a sheet that includes a polymer layer that substantially inhibits flux of the liquid through the layer. For example, an anti-permeation polymer layer should inhibit flux (i.e., rate of transfer per unit area) of the liquid into a substrate capable of absorbing the liquid by at least 50% when the anti-permeation polymer layer is interposed between and contacts both the liquid and the substrate, relative to the flux when the liquid directly contacts the substrate. Preferably, the flux should be inhibited by at least 90% for the first four hours of liquid-layer-substrate contact. The flux inhibition should endure for at least four, and preferably eight, twelve, twenty-four hours, or longer.

As used herein, the "scratch-resistance" of a polymer sheet or layer is a relative term that depends on the anticipated conditions of use to which the polymer sheet will be exposed. A polymer sheet is "scratch resistant" if it substantially retains its barrier properties (i.e., resistance to permeation by a liquid or a gas) under the peak scratching conditions to which it will normally be exposed in use. By way of example, use of laminated polymer sheets is described herein for providing peelable layers for food service containers in which food items and utensils such as spoons and forks will be inserted. Scratch-resistance in this context means that a polymer sheet that contacts the spoons or forks under ordinary use conditions (e.g., scooping or scraping out food items) will substantially retain (i.e., retain 90% or more of) its barrier properties following such contact.

A polymer is "thermoformable," as used herein, if the polymer retains a molded shape after being heated to a temperature at which it is relatively pliable, contacted with a mold, and then cooled to a temperature at which it is relatively rigid.

"Polyolefins," is used herein in its art-accepted sense, meaning polymerized alkenyl compounds, including polyethylene, polypropylene, resinous copolymers of ethylene and propylene, and polymers of ethylene and/or propylene with minor proportions of olefinically unsaturated monomers such as alpha-olefins having from 2 to 8 carbon atoms (e.g., 1-butene, 1-pentene, 1-hexene, 1-heptene, 1-octene and mixed higher alpha-olefins).

"Linear low density polyethylene" ("LLDPE"), is used herein in its art-accepted sense, meaning copolymers of ethylene with one or more comonomers selected from alpha olefins (preferably C-4 to C-10 alpha olefins such as butene-1 or octene) in which the copolymer molecules are in the form of long chains having few side chain branches or cross-links. This structure is in contrast with conventional low density polyethylenes, which are more highly branched than LLDPE. The density of LLDPE is normally in the range of from about 0.916 to about 0.925 grams per cubic centimeter.

"Linear medium density polyethylene" ("LMDPE"), is used herein in its art-accepted sense, meaning copolymers of ethylene with one or more comonomers selected from alpha olefins (preferably C-4 to C-10 alpha olefins such as butene-1 or octene) in which the copolymer molecules are in the form of long chains having few side chain branches or cross-links. This structure is in contrast with conventional medium density polyethylenes, which are more highly branched than LMDPE. The density of LMDPE is normally in the range of from about 0.926 to about 0.941 grams per cubic centimeter.

"Low density polyethylene" ("LDPE"), is used herein in its art-accepted sense, meaning copolymers of ethylene, optionally with one or more comonomers selected from alpha olefins (preferably C-4 to C-10 alpha olefins such as butene-1 or octene) as minor components. This structure is in contrast with conventional medium density polyethylenes, which are more highly branched than LDPE. The density of LDPE is normally in the range of from about 0.910 to about 0.940 grams per cubic centimeter.

"Ultra low density polyethylene" ("ULDPE"), is used herein in its art-accepted sense, meaning copolymers of ethylene, optionally with one or more comonomers selected from alpha olefins (preferably C-4 to C-10 alpha olefins such as butene-1 or octene) as minor components. The density of ULDPE is normally less than about 0.915 grams per cubic centimeter, which is the boundary arbitrarily chosen in this disclosure to differentiate LDPE (density>0.915) from ULDPE (density not greater than 0.915).

"High density polyethylene" ("HDPE"), is used herein in its art-accepted sense, meaning polymers of ethylene, optionally with one or more comonomers selected from alpha olefins (preferably C-4 to C-10 alpha olefins such as butene-1 or octene) as minor components. The density of HDPE is greater than 0.941 grams per cubic centimeter.

"High molecular weight polyethylene" ("HMWPE"), is used herein in its art-accepted sense, meaning polymers of ethylene, optionally with one or more comonomers selected from alpha olefins (preferably C-4 to C-10 alpha olefins such as butene-1 or octene) as minor components. The molecular weight of the polymer chains is typically in the millions, usually between 3 and 6 million.

"Ethylene vinyl acetate" ("EVA"), as used herein, is a known chemical entity and refers to copolymers of ethylene and vinyl acetate monomers. Normally, the ethylene-derived units of the copolymer are present in major amounts, such as between about 60% and 98% by weight and the vinyl acetate derived units in the copolymer are present in minor amounts, such as between about 2% and 40% by weight.

"Ethylene vinyl alcohol" ("EVOH"), as used herein, is a known chemical entity and refers to saponified or hydrolyzed ethylene vinyl acetate polymers, and refers to a vinyl alcohol polymer prepared by, for example, hydrolysis of a vinyl acetate polymer, or by polymerization of polyvinyl alcohol. The degree of hydrolysis should be at least 50% and is more preferably at least 85%. EVOH is normally used in the form of a copolymer of EVOH and a polyolefin comonomer (e.g., polyethylene). The polyolefin component can, for example, be present in the range of about 15 to about 65 mole percent.

"Polyamides," is used herein in its art-accepted sense, meaning polymers having amide linkages among the molecular chains. Polyamides include nylons and aramids, for example. The term "polyamides" also includes polyamide copolymers, such as nylon 6 and nylon 12.

"Aromatic polyesters," is used herein in its art-accepted sense, meaning polymers derived from homopolymers and copolymers of alkyl ester monomers which include an aromatic moiety, such as polyethylene terephthalate ("PET), polybutylene terephthalate, copolymers of isophthalate (e.g., polyethylene terephthalate/isophthalate copolymer), cycloaliphatic esters, and blends of these. Useful PETs include amorphous PET ("APET"), crystalline PET ("CPET"), recycled PET ("RPET"), and glycol-modified PET ("PETG").

"Polyacrylates," is used herein in its art-accepted sense, meaning polymers that include linked alkyl acrylate monomers, including copolymers which include different acrylate monomers (including alkyl acrylate monomers, for example) and/or polyolefin monomers. Examples of suitable polyacrylates include ethylene/alkyl acrylate copolymers, ethylene/methyl acrylate copolymers, ethylene/ethyl acrylate copolymers, ethylene/butyl acrylate copolymers, and ethylene/methyl methacrylate copolymers.

"Polyurethanes," as used herein, refer to polymers having organic monomers with carbamate linkages.

The unit "mil" is used in its art-accepted sense, namely one one-thousandth of an inch in the English measurement system.

Description

Layered Reservoir Articles, Including Layered Reservoir Containers

This disclosure relates to a multiple-layer article that can sequester liquid between its layers. An important aspect of the bi- or multi-layer construction of the article is that a space exists between at least a portion of the overlapping region of the substrate and liner sheets, the space being able to contain liquid. This space is herein designated a "reservoir" and the portion of each overlapping sheet that defines or overlies the reservoir is designated the "reservoir portion" of that sheet. Importantly, the reservoir communicates, through a perforation through at least one of the sheets, with the space on the other face of the sheet bearing the perforation.

By way of example, an article as described herein may consist of a relatively thick, liquid-impermeable substrate layer having a cavity formed therein, the cavity being sealed by a liner layer laminated against (i.e., adhered, adhesed, or fused to) the substrate layer along the perimeter of the cavity, but for one or more perforations that extend through the liner layer. The perforation permits liquid that is on the exterior (i.e., not laminated to the substrate) face of the liner layer to flow (or be drawn by surface tension) into the lumen of the cavity. Thus, the article has the capacity to sequester liquid that contacts the liner face thereof within the cavity. If the cavity contains absorbent material or is dimensioned with relatively narrow dimensions (and, if necessary, surface-treated), liquid present on the exterior surface of the liner layer in the vicinity of the perforation can be drawn into the cavity in the absence of external force (e.g., pressure or gravity) upon the liquid. Furthermore, if more than one perforation extends between the lumen of the cavity and the exterior of the layers forming the cavity (or if the perforation is sufficiently large that it is not plugged with liquid passing therein), then it may not be necessary to displace air or whatever other fluid may be present within the cavity in order to admit the liquid into the cavity.

In one aspect, the disclosure relates to a shaped article that includes a substrate sheet and at least one liner sheet. The substrate sheet has a shape which includes a concave interior portion. Within the interior portion, a reservoir portion of the substrate sheet is recessed away from the substrate sheet and is entirely contained within the interior portion. The reservoir portion can be recessed away from the interior portion in either direction (i.e., either being a more acute concavity within the concave interior portion or a convexity extending into the lumen of the concave interior portion). In an important embodiment, the interior portion includes a flat portion, and the reservoir portion is recessed away from and entirely surrounded by the flat portion. The liner sheet conforms to and is laminated against the substrate sheet across substantially the entire interior portion, other than at the reservoir portion. The liner sheet bears at least one perforation therethrough at the reservoir portion. Liquid present on the face of the liner sheet opposite the laminated face thereof can flow across the liner sheet and into the reservoir through the perforation.

During thermoforming, the substrate sheet, liner sheet, and perforation are positioned with respect to the thermoforming apparatus such that when the substrate sheet is drawn against the (preferably female) mold by suction, the liner sheet is also drawn against the mold across the overlapping portions of the substrate and liner sheets (the substrate sheet being between the mold and the liner sheet), except in the reservoir portion. At the reservoir portion, air (or other working fluid) can pass through the perforation during thermoforming, so that when the substrate sheet is drawn against the mold by suction, the liner sheet can remain non-deflected (or less deflected) from its original position owing to the passage of air through the perforation and retention of that air between the substrate and liner sheets at the reservoir portion. Subsequently, when the sheets are cooled, the substrate sheet will have been displaced against the mold from its original position and the liner sheet will have been displaced less far (or not at all) from its original position, resulting in a space or void (the "reservoir") having been formed between the sheets, the reservoir communicating with the exterior face (i.e., the face most distant from the mold) of the liner sheet by way of the perforation. Thereafter, liquid that is present in the lumen of the interior portion in the vicinity of the perforation is able to traverse the liner sheet at the reservoir portion and enter the reservoir.

In an important embodiment, the article includes multiple liner sheets, each having one or more perforations extending therethrough. Each liner sheet defines a face of a reservoir formed between it and the sheet 'beneath' it (i.e., between it and the sheet nearer the substrate sheet or between it and the substrate sheet itself), the reservoir communicating with a perforation that extends through the sheet. Preferably, many of the reservoirs communicate with one another such that, for example in an article having a substrate sheet and two liners sheets stacked on one face thereof, a first reservoir between the substrate sheet and the first (nearer to the substrate sheet) liner sheet communicates via a perforation extending through the first liner sheet with a second reservoir formed between the first and second liner sheets, the second reservoir communicating with the atmosphere surrounding the article by way of a perforation extending through the second liner sheet. In articles having multiple interconnected reservoirs, fluid may flow (or be drawn by surface tension forces) among the interconnected reservoirs, potentially increasing the fluid-sequestering capacity of the article.

By way of example, FIG. 1 is an image of an article having a perforation extending through a single liner sheet whereby, upon thermoforming, the article includes a reservoir formed along the X-shaped reservoir portion (non-laminated sheets visible in FIG. 1). The article shown in FIG. 1 is capable of sequestering fluid within the gap between the substrate and liner sheets at the X-shaped reservoir portion. If the article in FIG. 1 were made using two liner sheets, each having the perforation therein (at the position shown for the single liner sheet in FIG. 1), then a similar article would be formed, except that both liner sheets would be non-laminated at the X-shaped reservoir portion. Such an article would be capable of sequestering liquid at both the gap between the two liner sheets at the X-shaped reservoir portion and the gap between the substrate and the adjacent liner sheet at the X-shaped reservoir portion. Similarly, similarly-formed articles having three, five, or ten stacked and perforated liner sheets would be capable of sequestering fluid within three, five, or ten gaps at the X-shaped reservoir portion, respectively.

Non-lamination of stacked polymer sheets during the thermoforming process that involves deflecting heated polymer sheets against a mold under suction is believed to be attributable to the ability of air (or other working fluid) to be drawn between the stacked polymer sheets during the process. When a stack of thermoformable polymer sheets is drawn against a mold by suction applied to the sheet nearest the mold, inter-sheet suction will normally draw the sheet adjacent the sheet nearest the mold in the same direction. Similarly, each so-drawn sheet will tend to draw the next adjacent sheet in the direction of the mold, unless the inter-sheet suction is relieved by air passing between the drawn sheet and the next adjacent sheet. When a perforation is present in a region of a liner sheet that is stacked atop a substrate sheet being drawn by suction toward a mold, air passing through the perforation can prevent or decrease deflection of the liner sheet toward the mold, while not retarding deflection of the substrate sheet toward the mold, resulting in formation of a cavity (the reservoir described herein) between the liner and substrate sheets. Upon cooling of the sheets, the liner sheet will remain deflected toward the mold to a lesser degree than the substrate sheet, and the cavity will remain between the sheets, communicating with the non-mold face of the liner sheet through the perforation.

If a stack consisting of a perforated liner sheet and a substrate sheet is drawn by suction applied to the substrate sheet toward a mold, air can pass between the sheets unless the sheets are folded, pressed, clamped, fused or otherwise urged together, in which case air cannot pass between the sheets at the position at which they are urged against each other. It is believed that this is what occurs in thermoforming processes. The extent of non-lamination between adjacent thermoformed polymer sheets can be controlled by manipulating folding or close opposition of the sheets, such as by controlling the contours of the mold with which the sheets are thermoformed. That is, by interposing a fold-inducing surface of a mold between a perforation and another portion of a pair of opposed sheets, inrush of air from the perforation to the other portion can be limited or prevented. Thus, a skilled artisan in this field can design molds that will permit differential deflection of substrate and liner sheets in various portions of the mold by shaping the mold so as permit inter-sheet air flow (in communication with a perforation through one or more sheets) in areas in which reservoir formation is desired.

With reference to FIG. 1, it can be seen that the sheets of the article in that Figure are not laminated in the X-shaped reservoir portion. However, the flat portions immediately adjacent the X-shaped reservoir portion and the roughly O-shaped annular trough surrounding the X-shaped reservoir portion and adjacent flat portions are laminated. This is believed to have occurred because the flat and trough portions were "closed off" from inter-sheet air flow by the sheets deflecting around the mold and making an air-obstructing fold at the boundaries of those regions prior to deflection of the substrate sheet around the portion of the mold corresponding to the X-shaped reservoir portion. As a result, passage of air through the perforation in the liner sheet retarded deflection of the liner sheet toward the mold in the X-shaped reservoir portion during thermoforming, but was unable to retard deflection of the liner sheet in the flat and trough portions because those portions had already been closed off from inter-sheet air flow prior to deflection of the substrate and liner sheets about the features of the mold corresponding to those portions.

Figure 2:
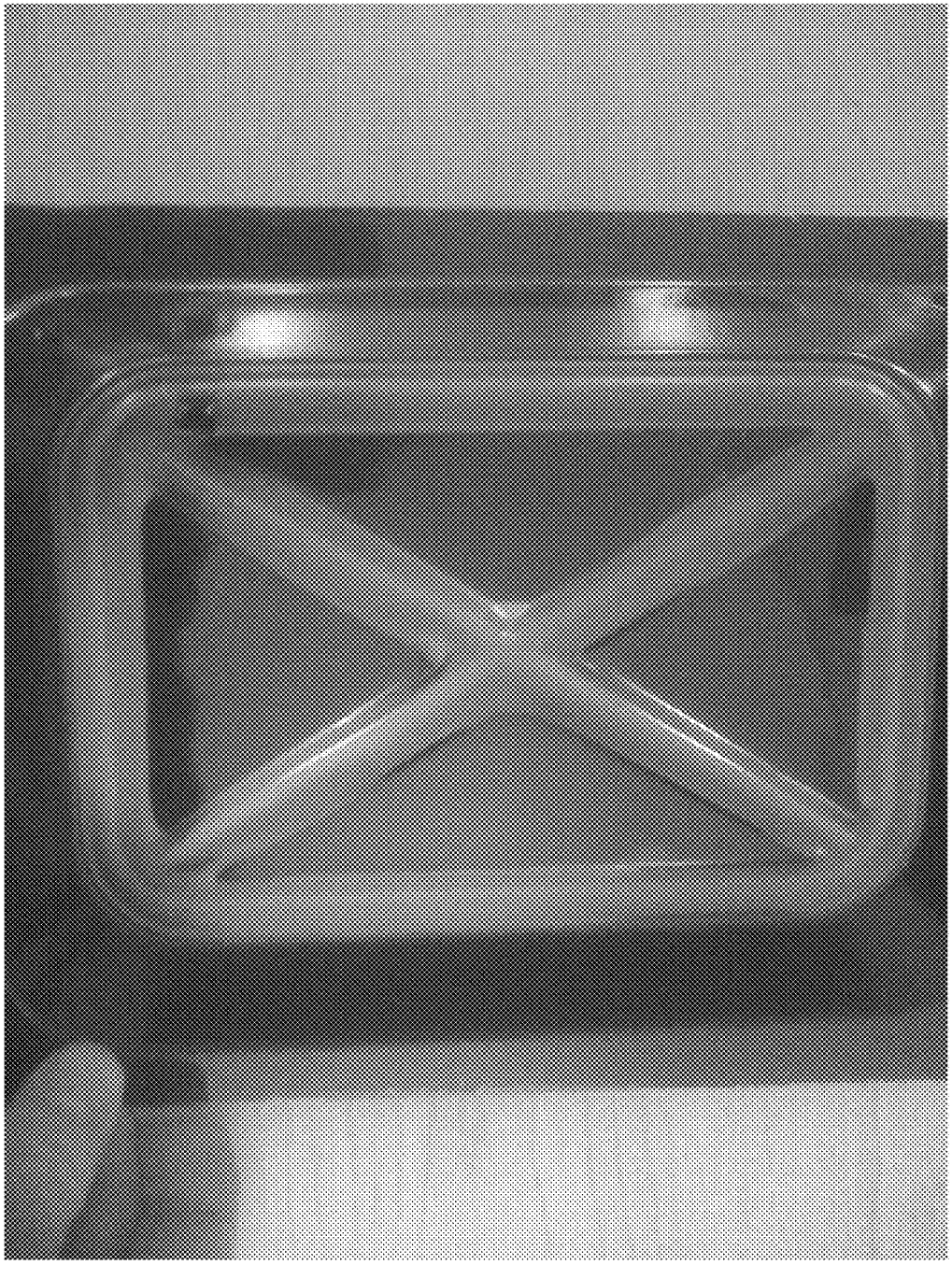
FIG. 2 is an image of a tray described in greater detail herein, the tray having a perforation (generally square shape at the upper left) through the liner sheet thereof, but not through the underlying substrate sheet, in a portion of the tray that communicates with both a lower transition region thereof and a reservoir portion thereof.
Figure 3:
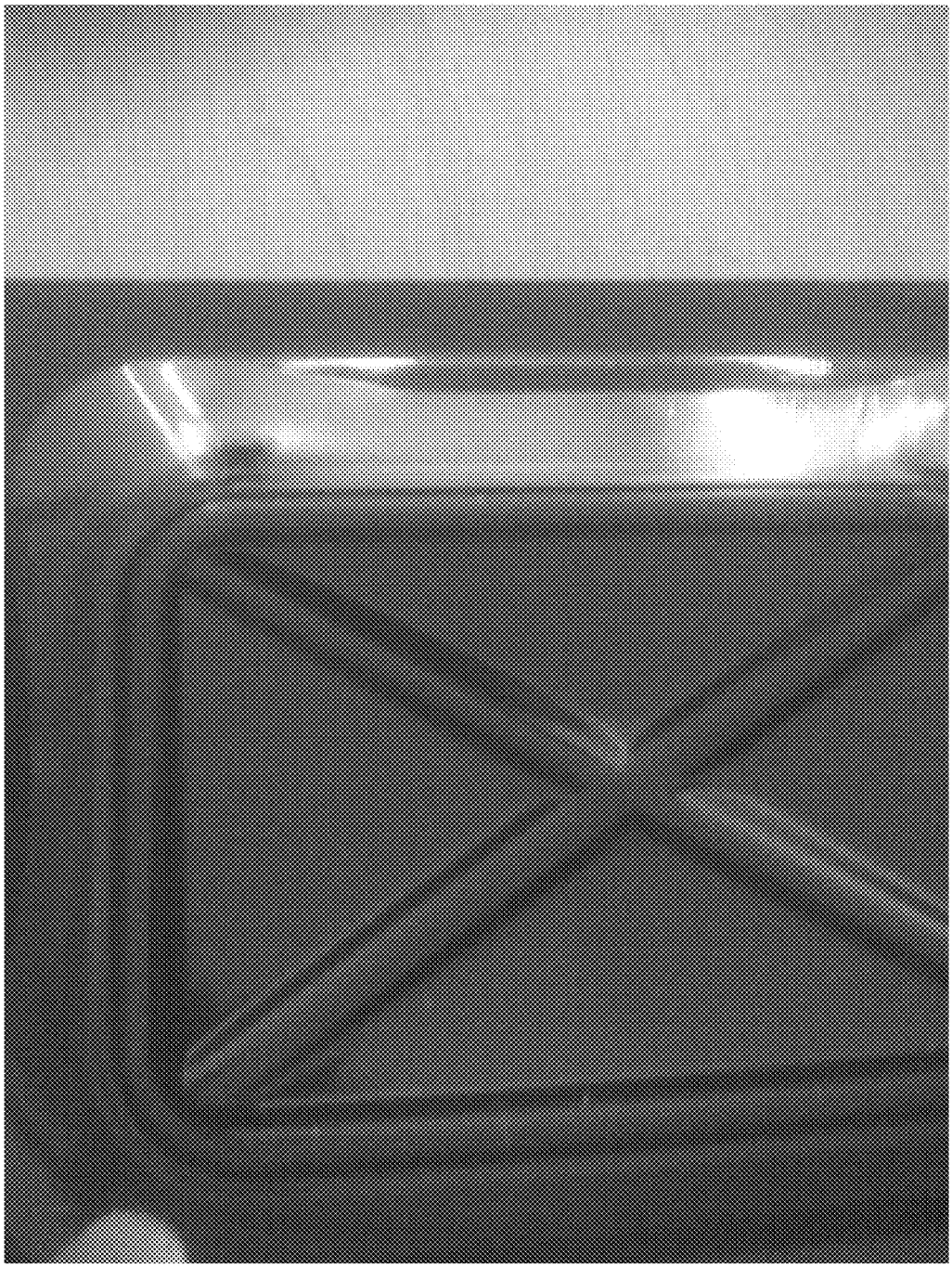
FIG. 3 is an image of a tray described in greater detail herein, the tray having a perforation (generally square shape at the upper left) through the liner sheet thereof, but not through the underlying substrate sheet, in a side wall thereof.
Figure 4:
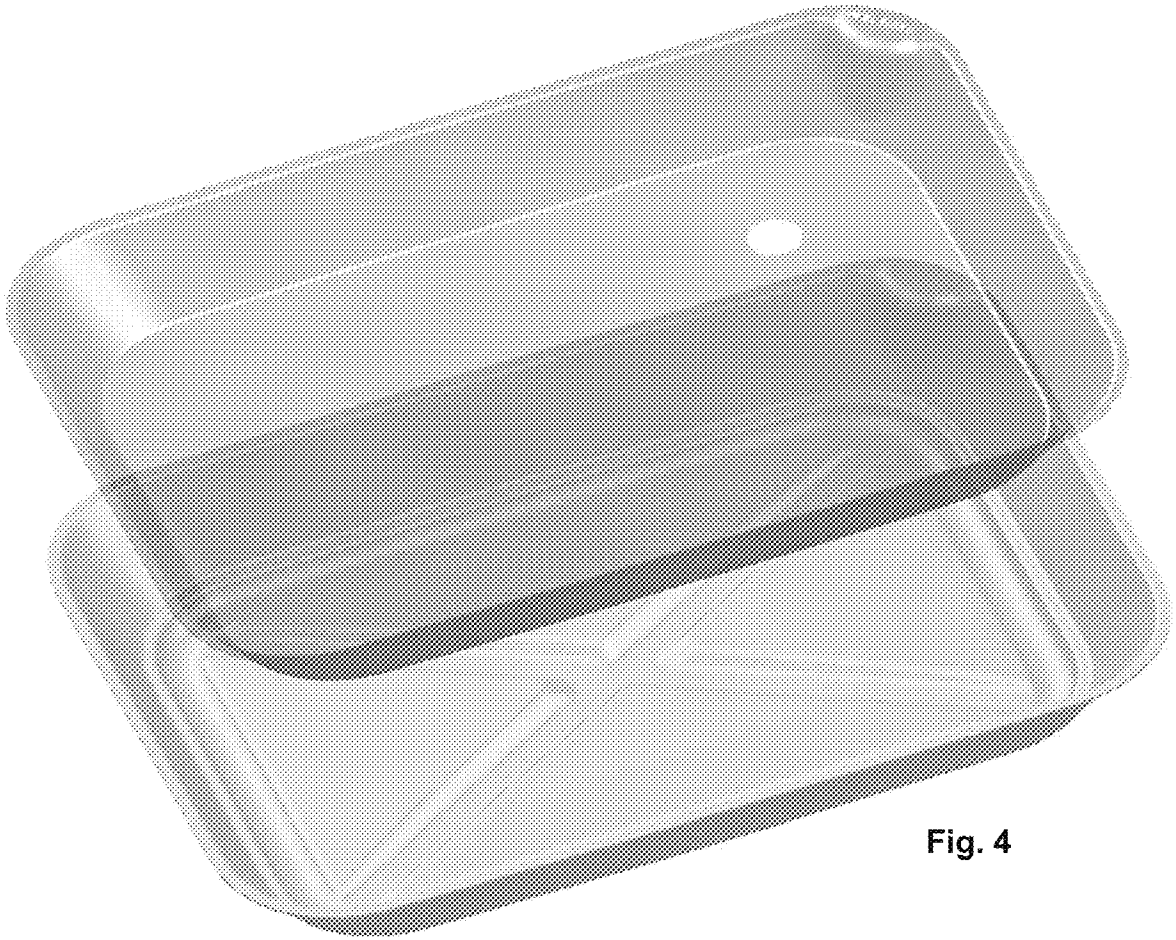
FIG. 4 is an exploded diagram of a tray described herein that illustrates a substrate sheet (yellow) having an X-shaped depression therein and an annular trough surrounding the X-shaped depression and a liner sheet (purple) having a perforation therethrough which, when the two sheets are assembled, communicates with the X-shaped depression of the substrate sheet.
Figure 5:
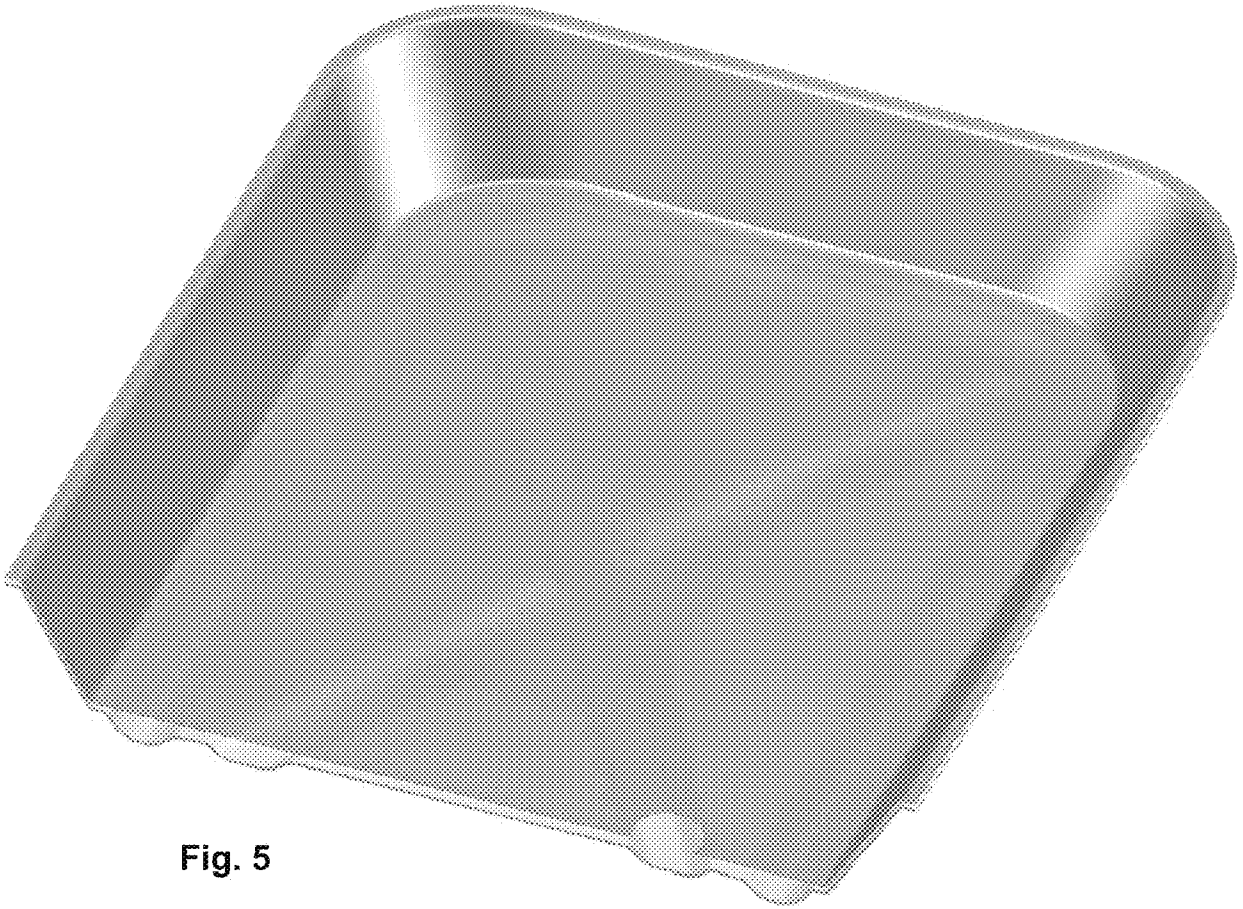
FIG. 5 is a diagram showing a section through a partially-assembled tray described herein, illustrating how the perforation (lower right; section bisects the perforation in the purple liner sheet) communicates with the interior of the reservoir portion of the yellow substrate sheet. In this diagram, the purple liner sheet is displaced away from the yellow substrate sheet both at the X-shaped depression and at the annular trough.
Figure 6:
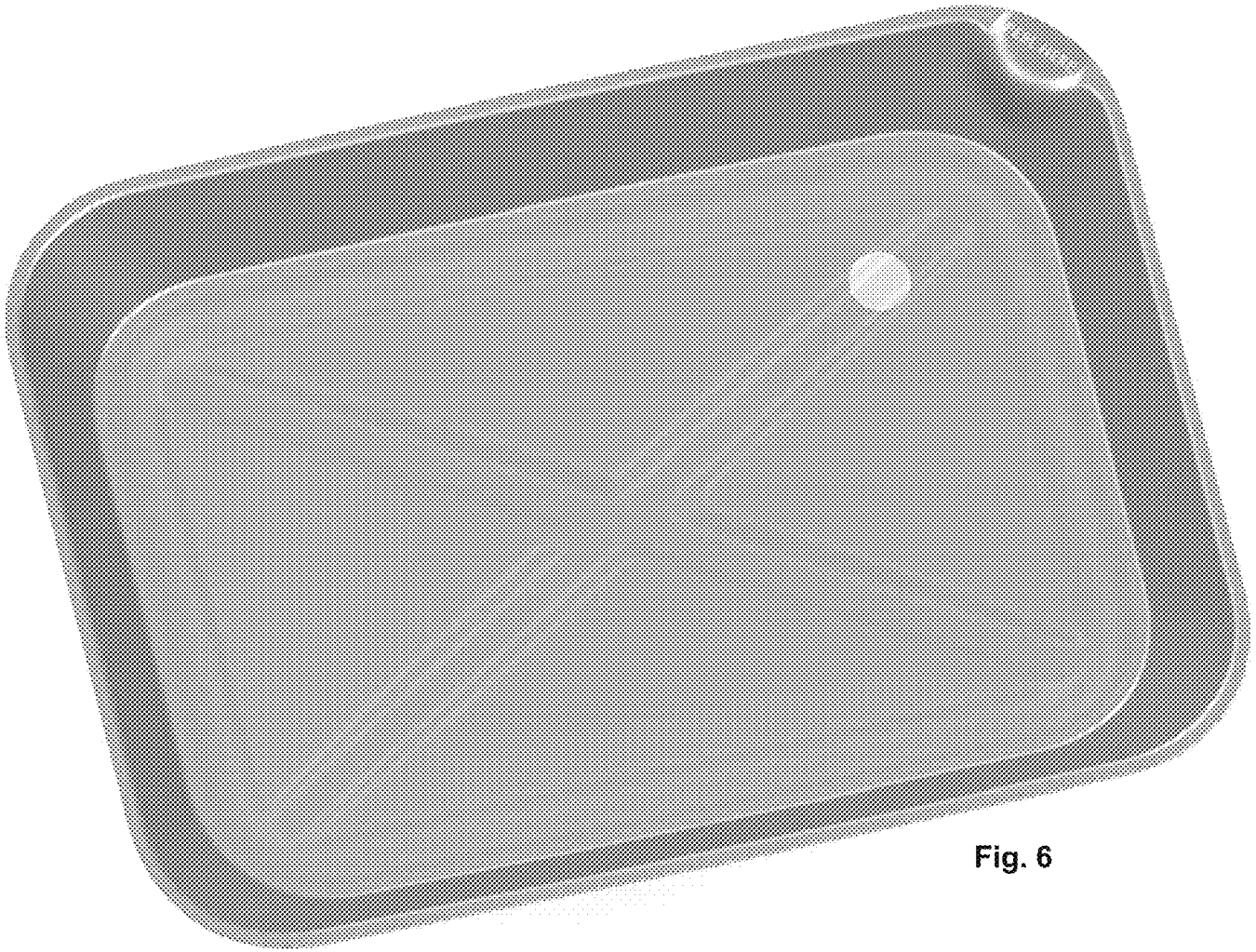
FIG. 6 is a top view of a tray described herein (and shown in various views in FIGS. 4-9), illustrating how the purple liner sheet nests within the yellow tray-shaped substrate sheet, with a circular perforation through the purple liner sheet communicating with the X-shaped depression in the yellow substrate sheet.
Figure 7:
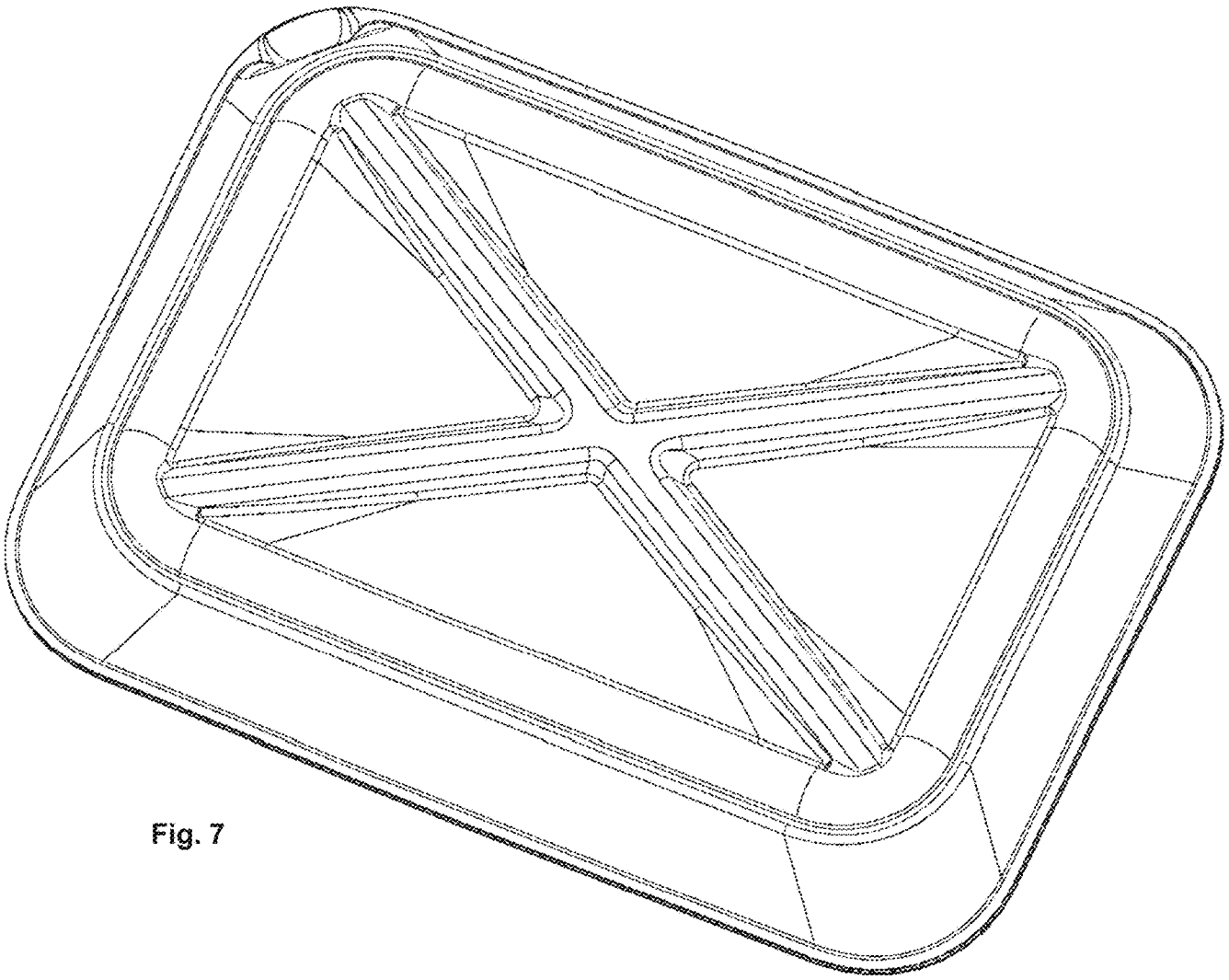
FIG. 7 is a detail of the underside (i.e., the face opposite that shown in FIG. 6) of the tray described herein (and shown in various views in FIGS. 4-9), showing how the X-shaped depression communicates with the annular trough.
Figure 8:
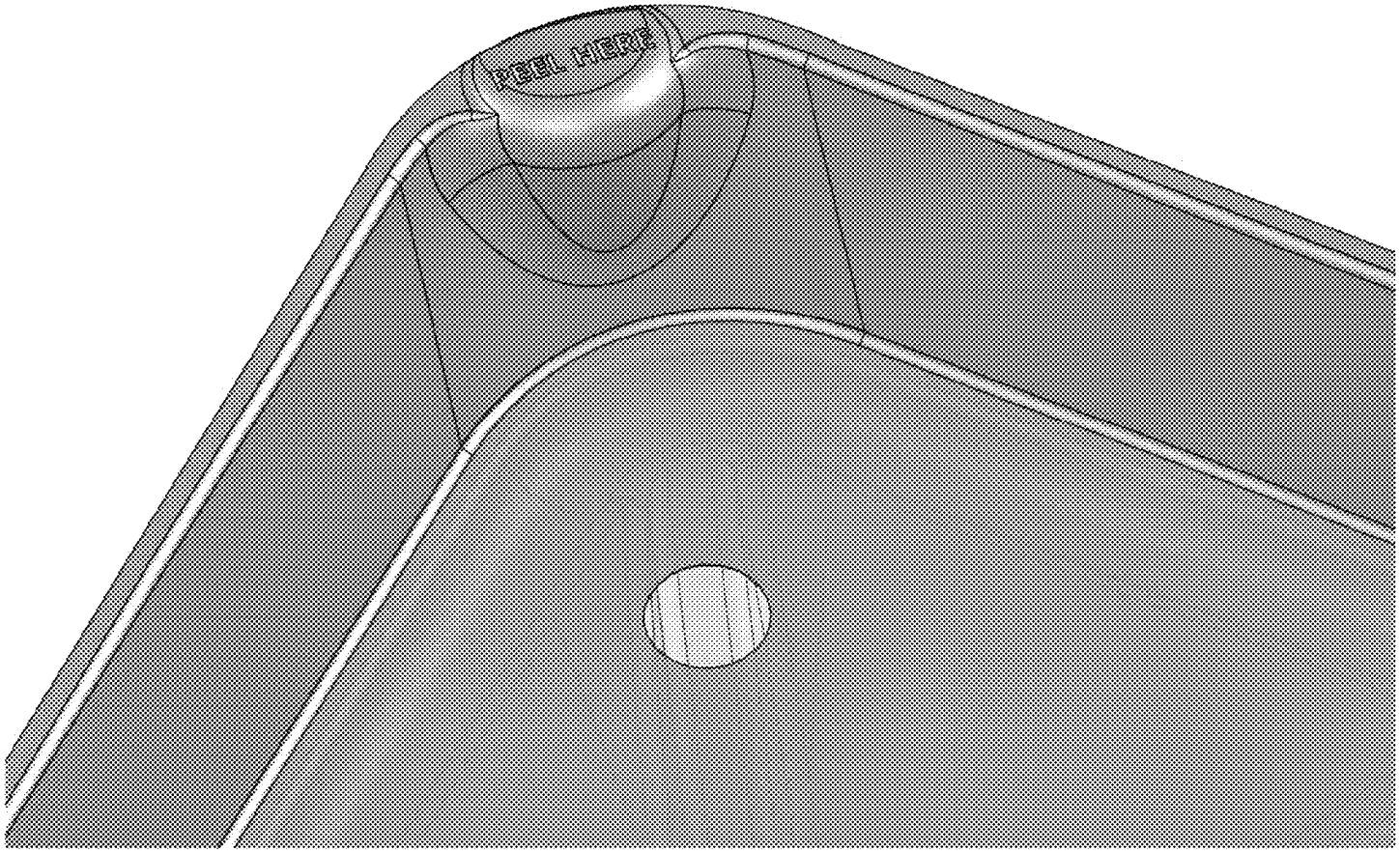
FIG. 8 is a closer view of a portion of the tray shown in FIG. 6.
Figure 9A:
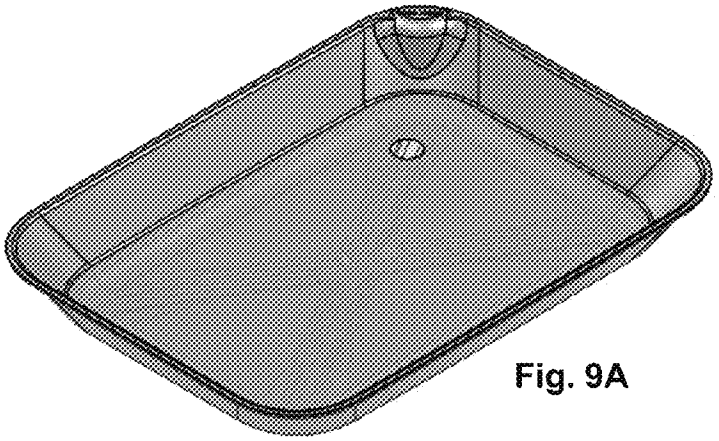
FIG. 9, consisting of FIGS. 9A, 9B, 9C, and 9D, is an isometric view (FIG. 9A) and three orthographic projections (FIGS. 9B, 9C, and 9D) thereof of the tray described herein (and shown in various views in FIGS. 4-9).
Figure 9B:
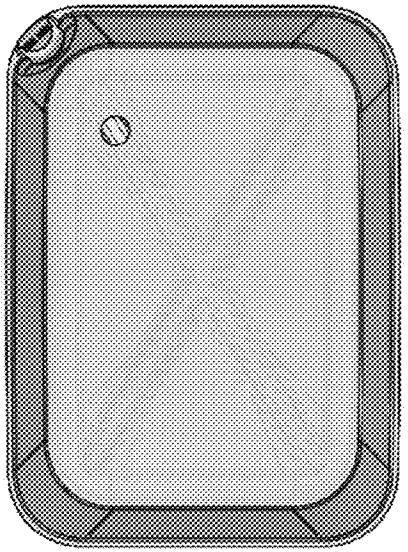
Figure 9D:
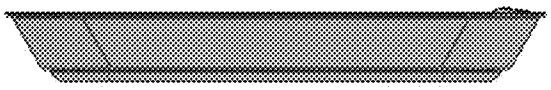
Figure 9C:
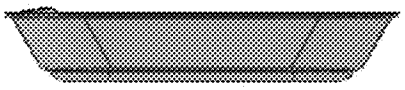

Similarly, in FIG. 2, positioning of the perforation in the annular trough region permits inter-sheet air flow prior to closing off (during thermoforming) of both the annular trough and the X-shaped reservoir portion, and the sheets of the resulting tray remains non-laminated in both the trough portion and the X-shaped reservoir portion. Likewise in FIG. 3, positioning of the perforation in a side wall surrounding the flat, trough, and X-shaped portions of the liner sheet permitted inter-sheet air flow only along the side-wall regions, with inter-sheet air flow being cut off upon sheet bending corresponding to the flat portion of the upper transition region.

In the articles described herein, at least one of the substrate sheet and the liner sheet should be thermoformable. Also, at least one sheet (and preferably each sheet) should maintain its structural integrity (i.e., not break, crumble or tear) under the thermoforming condition used to form the article. If any of the sheets is not thermoformable, it should nonetheless be capable of deflecting under the thermoforming condition used to form the article to such an extent that it does not rupture. Preferably, each substrate sheet and liner sheet is made from a material that can be thermoformed under a single thermoforming condition.

If adjacent sheets are made of the same thermoformable material and exhibit similar surface energy (e.g., not differing by more than about 5 Dynes per centimeter per centimeter), they will often fuse when subjected to a thermoforming condition. Dissimilar sheets will often adhere to one another in a peelable manner. Greatly dissimilar sheets may not adhere well and peel readily from one another. In the articles described herein, it is preferable that adjacent polymer layers remain bound to one another. In some embodiments, peelable layers are preferred. In embodiments in which peelability is not required, fusion of adjacent layers (with reservoirs formed between the layers, the reservoirs communicating with the exterior of the article by way of one or more perforations) is acceptable. When peelability of layers is desired and is not achieved by simple thermoforming of stacked materials, an adhesive composition can be interposed between the layers before or during thermoforming. Peelable adhesives are preferred for such applications, and have been described elsewhere, such as in U.S. patent application publication number 2010/0200596.

When adjacent polymer sheets of a layered reservoir article are adhered to one another using an applied releasable or peelable adhesive, the adhesive is preferably not present within the reservoir region (i.e., so as not to impair separation between the substrate and liner sheets during thermoforming) or, if present, is blocked or otherwise prevented from adhering both sheets (e.g., by saturating the region with an adhesion-blocking compound such as corn starch or tissue paper).

As described herein, the layered reservoir articles described in this disclosure can be thermoformed from stacked polymeric sheets. It can be convenient to manufacture multiple shaped articles in a single thermoforming process by using 'stacks of stacks;' that is multiple stacks of polymeric sheets, each stack corresponding to the layers of a single shaped article and adjacent stacks having a barrier composition interposed therebetween to prevent binding or fusion of the stacks to one another. Such 'stacks of stacks' may lack the barrier composition at, for example, one corner or edge of the stack assemblage, so that the multiple shaped articles formed thereby can be handled, shipped, stored, etc.

as a bundle and separated at a time after the thermoforming process is complete (e.g., by an end user).

By way of example, four stacks of meat trays, as described herein may be formed in a single thermoforming operation, the four stacks containing ten trays each and being linked to one another by a central post which connects all forty trays and from which each individual tray can be removed by cutting or flexing a frangible portion situated at the corner of each tray. Such an assemblage can be formed, for example, by thermoforming ten sets of polymer sheets (each set including a substrate sheet and a perforated liner sheet) having a barrier composition interposed between the sets, except at a central position, thermoforming and trimming the sets to form a ten-layer "clover-leaf" shaped assemblage wherein four ten-layer tray-shaped assemblies are connected by a tray-corner to a unitary central post. A user of the assemblage may peel off the top set of four trays (by grasping a tray on top or bottom of the assemblage, peeling a four-tray sheet off from the stack by peeling the central post between the four trays, and cutting a tray off from the four-tray sheet. Alternatively, the user can cut a stack of ten trays of from one of the four "arms" of the assemblage and thereafter separate the ten trays.

The thickness and composition of each of the polymer layers of the shaped articles is not critical. In one embodiment, one sheet of the article is responsible for most of the strength and shape of the article. By way of example, such an article might include a relatively thick (e.g., 10 mil, 30 mil, 100 mils or more) substrate layer that has one or more relatively thin (e.g., 1-7 mils) liner layers applied to a face thereof, with one or more reservoirs defined between the liner and substrate layers and/or between adjacent liner layers. Shaped articles in which each sheet contributes essentially equally to the strength, rigidity, and shape of the article can also be made. Articles having multiple interconnected reservoirs disposed within multiple liner layers can have a 'sponge-like' texture in which multiple fluid-sequestering spaces are present.

In an important embodiment, the layered reservoir article describe herein is used as, or as part of, a retail display container such as a butcher's meat tray or a wrapped meat-containing package. Such a display container can be used to hold or contain a liquid-exuding food product. Liquid exuded from the food product contacts a perforation in the liner sheet and can be sequestered in a reservoir in the container. By way of example, such a display unit can include cut of beef that is placed atop a meat-tray-shaped layered reservoir article made as described herein and overwrapped with a plastic film having a clear window through which the beef can be viewed by a potential purchaser. Any fluid that is exuded by the beef will be contained within the plastic film. If the fluid contacts a perforation in the tray, it can enter the reservoir that communicates with the perforation and thence can flow to any other reservoir, absorbent material, or space with which the reservoir communicates. In this manner, fluid exuded by the beef is sequestered within the tray, where it will be less observable to the potential purchaser and where it will be less likely to contact the beef. Thus, the appearance of the meat is improved while the likelihood and speed of spoilage of the meat are decreased.

In order to make the layered reservoir articles described herein, a substrate sheet and at least one liner sheet are brought together. The sheets are thermoformed in a mold and under conditions whereby at least one of the sheets takes on the desired shape, that shape including a reservoir portion in which the substrate and liner sheets are not closely opposed (laminated). Generally, the substrate and liner sheets will be laminated, other than within the reservoir portion. At least one of the substrate and liner sheets has a perforation extending through it in the reservoir portion, such that any fluid in the reservoir portion can contact the perforation and, flowing through the perforation, can enter the reservoir between the substrate and liner sheets in the reservoir portion. If multiple liner sheets are used, multiple reservoirs, at least some connected to one another by pores through the interposed sheets, can sequester fluid from the reservoir.

The layered reservoir articles are formed by thermoforming the substrate and liner sheets, preferably using a thermoforming apparatus having a suction-drawn female mold. Such a mold should include a concave interior-forming portion and at least one reservoir-forming portion. Each reservoir-forming portion of the mold should be disposed into the suction-drawing face of the mold within the interior-forming portion thereof. The thermoforming step is performed with the substrate sheet being positioned nearest the suction-drawing face of the mold and with a perforation being disposed within a reservoir-forming portion of the mold. Application of suction in the reservoir-forming portion of the mold displaces the substrate sheet from the liner sheet in the vicinity of the perforation. The shaped article thus formed is cooled to harden it in the reservoir-containing conformation in which it is used.

In one embodiment, the liner sheet is made of a material that is selected such that it is capable of maintaining its structural integrity at a thermoforming condition at which the substrate sheet can be thermoformed. The liner sheet is capable of conforming to the shape of the substrate sheet as the substrate sheet is thermoformed at the thermoforming condition unless, as at the reservoir portion, a perforation extends through the liner sheet in which case air will be drawn through the perforation and the liner sheet will not deform as far as the substrate sheet, leaving a reservoir space between the substrate and liner sheets. If desired, the liner sheet can be a material that is also thermoformable at the thermoforming condition, but this is not a requirement. If a non-thermoformable liner sheet is used, the liner sheet may detach, deform, or pull away from the substrate sheet following thermoforming, forming additional reservoir spaces. Even if the liner sheet is thermoformable, these behaviors can nonetheless manifest themselves if the substrate and liner sheets are made of different materials (owing, for example, to different coefficients of thermal expansion). When the liner sheet is a non-thermoformable material, the characteristics of the liner sheet and any adhesive in the inter-sheet space should be selected to retain the desired configuration of substrate and liner sheets in the finished article (including non-adherence in the reservoir portion).

One or more tabs can be interposed between the sheets of the shaped article. If a tab extends beyond an edge of either sheet, the tab can be used to facilitate separation of the sheets after thermoforming or use. The tab can be adhered to either sheet or to neither. Separation of the sheets of the article can facilitate recovery of sequestered liquid or recycling of the component sheets.

In one embodiment, the tab is relatively fixedly adhered to the lower surface of a liner sheet that overlies another liner sheet or the substrate sheet. The tab is either peelably adhered to or not adhered to the underlying liner sheet (or substrate sheet), such that the overlying liner sheet can be peeled from the underlying liner sheet (or substrate sheet) by grasping the tab and pulling on the edge of the overlying sheet using the tab. In a second embodiment, the tab is relatively fixedly adhered to the underlying sheet and either peelably adhered to or not adhered to the overlying liner sheet, such that the overlying liner sheet can be peeled from the underlying liner sheet by scratching (e.g., with a fingernail or an edged instrument, such as the tine of a fork) the edge of the overlying liner sheet that overlies the tab to begin partial peeling of the overlying liner sheet at the location of the tab, and then grasping the partially peeled portion of the overlying liner sheet and manually peeling the remainder of the overlying liner sheet away from the underlying liner by pulling on the partially peeled portion.

Although a loose stack of polymeric sheets can be thermoformed using the materials and methods described herein, it can be convenient to bind (or fuse) the substrate and liner sheets to one another (other than in the reservoir portions) prior to thermoforming (e.g., to facilitate combination, storage, shipping, handling, manufacture, and alignment of the sheets). The means used to bind the sheets to one another is not critical, but preferably does not affect the properties of the sheets in the region(s) of the sheets that are to be thermoformed. By way of example, the sheets can be bound together using a glue applied to a common edge of the sheets, by fusion of a common edge of the sheets, by stapling the sheets together, by adhering the sheets together using an adhesive applied between the sheets at an inter-sheet area distinct from the reservoir portion(s), or by other means.

In order to prevent detachment or deformation of the liner sheet away from the substrate sheet after thermoforming, an adhesive that peelably adheres the sheets can be interposed between them (other than at the reservoir portion). All, or only a portion, of the overlapping region can be coated with the adhesive. When a tab is interposed between polymer sheets, the tab can be adhered to the adhesive and used to pull the edge of the sheet to which the tab is adhered away from the adjacent sheet to which the tab is not adhered.

If an inter-sheet adhesive, an inter-stack barrier composition, or other optional compound is to be included in manufacturing a layered reservoir article for food-contacting purposes, such compounds should be carefully selected so as not to adversely affect the properties (e.g., wholesomeness and sterility) of food that contacts the article.

Further details of the materials and methods suitable for use in the articles, methods, and compositions described herein are provided in other sections of this disclosure.

Layered Compartment Articles, Including Layered Compartment

Containers The disclosure relates to containers which include at least two layers of polymeric materials. The containers include a substrate layer and a liner layer. The substrate and liner layers are separably attached to one another in such a way that a person of ordinary strength can detach the two layers without substantial difficulty. Typically, the substrate and liner are laminated against one another, such that they appear to the naked eye to form a unitary object (e.g., a tray- or bowl-shaped container) over most of their surface area. Preferably, the substrate and liner are not attached to one another at at least one portion of the container, and a person looking at the container can discern the separate liner and substrate layers at that portion (e.g., a tab is interposed between the two layers at a portion or are de-laminated at the portion.

The container can also include a lidding layer that can be sealed against the liner layer The liner and lidding layers can be sealed against one another (e.g., adhered or urged against one another by an outside object, such as a clip) to define a compartment. Lidding is also referred to herein as "lid-stock." The boundaries of the compartment are one face (i.e., "the compartment face") of the liner, one face (i.e., "the compartment face") of the lidding, and the seal or interface between the liner and lidding. The compartment is preferably closed, such that a liquid within the compartment cannot flow out of the compartment, regardless of how the container is manipulated in space (e.g., turned, flipped, spun, or tilted) without breaching at least one of the liner, the lidding, or the seal between them. Preferably, the seal between the liner and the lidding is formed either by an adhesive interposed between the liner and the lidding or by fusion between the liner and the lidding. However, the lidding and liner can also be adhered (rather than adhesed) to one another as described herein in the section regarding adherable polymer sheets.

At least one of the liner and the substrate is preferably thermoformable. If at least one is, then the container can be made by thermoforming stacked planar sheets of the substrate and the liner. The lidding can be thermoformed together with the substrate and liner, so long as either the contents of the compartment are interposed between the liner and the lidding at the time of thermoforming or a gap is left in the seal between the liner and the lidding that defines the compartment, such that contents can be added to the compartment after thermoforming.

A substantial advantage of containers described herein, relative to previously-known containers is that the contents of the compartment can remain associated with the substrate until one desires to dissociate the two, at which time the contents can be dissociated from the substrate without necessarily removing the contents from the compartment. This can be achieved because the substrate and the liner can be detached without necessarily detaching the liner and the lidding.

Thus, for example, if the liner and the lidding define a closed compartment containing a cut of poultry, free liquid, and a liquid-engorged absorbent material that is not attached to either of the liner and the lidding, the entire contents of the compartment can be detached from the substrate (by separating the liner from the substrate) while leaving the compartment intact. Thereafter, if desired, the compartment can be breached (i.e., by puncturing one or both of the liner and the lidding, by separating the liner and the lidding at the seal therebetween or by some combination of these) to remove one or more of the contents. As an alternative example, the contents of the container can be discharged from the compartment while the liner remains attached to the substrate (with or without the lidding remaining attached to the liner), and the liner can be separated from the substrate after the contents have been discharged.

Containers described herein can include sheets that define both the compartment described above and the fluid reservoir described above and in U.S. provisional application 61/450,565. That is, the containers can include at least two liner sheets which define a fluid reservoir interposed between them and a lidding that can be sealed against one or more of the liner sheets to form a closed compartment. The compartment and the reservoir communicate with one another through a perforation in at least one of the liner sheets. As a result, liquid generated in the compartment (e.g., liquid exuded by a cut of meat or poultry) remains within the closed compartment and can be sequestered within the reservoir. When the compartment is opened (e.g., by breaching or removing the lidding), most or all of the liquid preferably remains within the reservoir. The liners defining the reservoir can be peeled from the substrate either before or after opening the compartment.

Thus, for example, a cut of poultry can be interposed between a lidding sheet and a pair of liner sheets that are bound (adhered or fused) to one another, other than at a reservoir portion that communicates with the space between the lidding and the liners via multiple small holes in one of the liner sheets. The pair of liners can be peelably adhered to a shaped substrate tray, such that they conform to the shape of the tray. The lidding can be wrapped around the lined tray (e.g., as is commonly done in supermarkets and groceries using conventional meat films, such as PVC and vinyl films) to define a closed compartment bounded by the liner sheet pair and the lidding. Alternatively, the lidding can be adhered, peelably adhered, fused, or peelably fused to at least one of the liner sheets, such as around a rim or edge of the substrate tray or around the cut of poultry (e.g., by packaging the cut under a vacuum, such that lidding is opposed against at least one liner sheet in an area that surrounds the cut). If desired, the composition of gas(es) within the compartment can be controlled by performing the packaging operation in a selected gaseous environment (such methods are well known in the art). The liner and lidding sheets that define the compartment can be peeled away from the substrate tray prior to opening the compartment to extract the cut. Alternatively, the liner sheets (including the reservoir and any liquid therein) can be peeled away from the substrate after opening the compartment and extracting the cut.

Although not necessarily a preferred embodiment, the containers described herein need not have the lidding sealed against one or more liner sheets in a fluid-tight manner. The lidding can, instead, simply enclose the liner-clad substrate in the compartment, such that the liners will prevent contact between liquid within the compartment and at least the portion of the substrate to which they are peelably attached. Liquid within the container can be sequestered in the reservoir, and the liner sheets (including the reservoir) can be peeled from the substrate once the compartment is opened. As another alternative, the lidding can enclose the liner-clad substrate and be resiliently urged against one or more of the liners along the entire perimeter of a shaped portion of the substrate, such as along the rim of a tray or bowl. In this alternative embodiment, resilient urging of the lidding against the liners can prevent migration of most, if not all, liquid from within the compartment to without the compartment, and liquid within the compartment can be sequestered within the reservoir. The lidding can also define more than one closed compartment for a single substrate, such as a generally tray-shaped article having multiple concave compartments for containing separate articles, two or more of the compartments can have liners associated therewith.

Food Containers

A significant use for the containers described herein is for containing food products. During storage, shipping, and retail display, many foods must be both contained (to prevent loss or contamination of nearby equipment and products) and protected from environmental conditions (e.g., oxygen-induced degradation, chemical and microbiological contamination, and absorption of non-desired odors). Use of polymeric materials for packaging of foods is widespread, as the physical and chemical properties of polymeric materials can be selected or engineered to provide favorable food storage properties.

Although the relative inertness and substantial physical and chemical stability of polymeric food packaging materials are beneficial for packaging purposes, those same properties render many polymers resistant to degradation. Food packaging materials are rarely re-used, both for aesthetic and sanitary reasons, and are usually discarded after a single use. Even though some polymeric materials can be recycled, relatively few polymer-based food containers are recycled, for at least two reasons.

First, government regulations frequently limit or prohibit contact between human foodstuffs and post-consumer-use recycled materials, predominantly for sanitation and health reasons. Among other concerns, food-borne pathogens or products of decomposition could be transmitted to a foodstuff from an insufficiently-sanitized recycled product, or the product could contain chemicals which, although not injurious, could support microbial growth in otherwise safe products when contacted with the recycled product.

Second, relatively few polymeric materials exhibit all of the properties required of a food packaging. As a result, food packages often contain a variety of polymeric materials, often in the form of laminated materials having multiple layers composed of different polymers. By way of example, EVOH polymer sheets strongly inhibit trans-sheet penetration by odors, moisture and gases, but do not exhibit particularly useful flexibility or rigidity; polyolefins exhibit good flexibility, but may exhibit low tensile strength and low resistance to gas and odor transmission; nylons exhibit good tensile strength, but often exhibit low moisture and gas resistance. Many polymers can be recycled only when the recycled materials are relatively pure. Mixtures of different polymers often exhibit extremely poor or inconsistent properties when recycled, and such recycled products are often useless for any substantial purpose.

Recyclability

A substantial benefit of the containers described herein is that they facilitate recycling of substantial amounts of polymer-based packaging. In one embodiment of the containers described herein, the substrate exhibits most or all of one or more desired properties of the container and can be separated from the liner and the lidding once those desired properties are no longer desired or needed.

For example, in the case of a meat tray, a substrate tray that exhibits significant rigidity (i.e., it is rigid enough that it retains a desired shape, facilitates practical handling of meat contained in the package, and prevents significant deformation of the meat during such handling) can have a liner peelably attached thereto. A cut of meat can be placed atop the liner (i.e., on the face of the liner opposite the liner face that is peelably attached to a surface of the meat tray), and a lidding can be fused to the liner along the edges of the meat tray to enclose the meat within a fluid-retaining compartment. If the liner is detachably attached to the meat tray (e.g., if the liner is peelably adhered to a concave face of the meat tray), then the entire package can be shipped, displayed, and handled as a unit and the liner can be detached from the substrate when desired (e.g., prior to or after opening the compartment) Because the substrate can be made of a substantially uniform (and recyclable) polymeric material such as PET, can be separated from the liner and lidding (regardless of their composition), and can make up a significant fraction of the material used to make the container, a significant fraction of the container can be recycled. That is, even if the liner and lidding are discarded, the amount of non-recyclable waste generated by use of the packaging can be greatly decreased, relative to a comparable non-recyclable package.

Containers as described herein can therefore divert to recycling significant portions of food packaging waste streams that have heretofore been sent to landfills and other non-reusable sinks.

In addition to diverting material that would otherwise be landfilled to recycling, the containers described herein also increase the uses for which recycled materials can be used. Recycled polymer products can be significantly less expensive than comparable virgin materials. However, for food packaging purposes, many government regulatory schemes discourage or prohibit contact between foodstuffs and recycled polymers, out of concern for sanitation and contamination by chemicals or other agents that can be present in recycled products. Because products in the compartment of the containers described herein do not contact the substrate, substantially any material can be used to make the substrate, at least so long as the liner exhibits sufficient barrier properties to prevent leaching of undesirable chemicals from the substrate, through the liner, into the compartment.

The compartment of the containers described herein is formed between the liner and lidding. In some embodiments, the liner directly contacts the substrate, and in others an adhesive, one or more additional polymer sheets, or other materials are interposed between the liner and the substrate. If the liner itself does not exhibit sufficient barrier properties to prevent migration of any non-desired substance from the substrate into a foodstuff in the compartment, one or more barrier layers can be interposed between the substrate and the liner, between the liner and the compartment, or both. Such a barrier layer can be a discrete layer (e.g., a polymer sheet or a layer of a solid, liquid, or gelatinous material) or it can be included (e.g., as a laminar layer) within the liner sheet itself. By way of example, a liner sheet consisting of two layers of ULDPE tied to opposite faces of a nylon sheet may exhibit good adhesion and peelability properties when used in conjunction with a RPET substrate, but could permit migration of certain chemical species through the liner sheet. To prevent this, a layer of EVOH (assuming EVOH is relatively impermeable to the chemical species) can be incorporated into the liner, such as between the nylon sheet and one of the two ULDPE layers, the various layers of the laminate liner sheet being attached using appropriate adhesives or tie layers, such as are readily selectable by skilled artisans in this field.

Because the liner and lidding materials can be made from very thin (e.g., 8 mil or thinner) polymer sheets, the bulk of the container (and it's gross physical properties) can be attributable to its substrate. Because recycled materials can be used to form the substrate of the containers described herein, their cost can be significantly reduced, relative to the same container made from all-virgin materials.

Thermoformable Polymer Sheets

Each of the substrate and liner sheets described herein can be a thermoformable polymer sheet. The identity and composition of thermoformable polymer sheets used in the articles and methods described herein are not critical. A skilled artisan will recognize that substantially any thermoformable polymeric material can be used. Examples of suitable thermoformable polymeric materials include polyethylene terephthalates, polyesters, polyethylenes (e.g., high density polyethylenes and high molecular weight polyethylenes), polypropylenes, polyvinylchlorides, polystyrenes, nylons, copolymers of these, and combinations of these. Plant-based polymers, such as polylactates (also known as "lactic acid polymers" and PLAs) can also be used. Polymers used for contacting foods should, of course, be selected for compatibility.

Examples of suitable thermoformable polymeric materials for use as substrates include polyethylene terephthalates (e.g., RPET, amorphous PET, and PETG), polyesters, polyethylenes (e.g., high density polyethylenes and high molecular weight polyethylenes), polypropylenes, polyvinylchlorides, polystyrenes, nylons, copolymers of these, and combinations of these. Plant-based polymers, such as polylactates (also known as "lactic acid polymers" and PLAs) can also be used.

A skilled artisan can select a thermoformable polymeric material, or combinations of such materials, suitable for use in substantially any application by considering such properties as the shrink rate, crystallinity, heat deflection temperature, tear strength, draw ratio, thickness, rigidity, melt temperature, thermal conductivity, and polymer backbone orientation of the materials. Selection of materials can also be guided by properties that do not necessarily directly impact the thermoformability of the materials, such as cost, color, opacity, recycled material content, environmental impact, surface energy, chemical resistance, and surface sheen of the materials.

In selecting appropriate materials, an artisan should consider at least two sets of conditions: the environmental conditions to which the finished, shaped article will be subjected and the conditions that the materials will experience during the thermoforming process. Materials should be selected so as to exhibit the desired color, shape, strength, rigidity, and peelability, for example, once the materials have been shaped in the thermoforming process into their final, desired form. The materials should also be selected, together with the thermoforming conditions, so as to allow assembly and shaping of the materials into their final, desired form using thermoforming conditions available to the artisan.

For deep-walled containers (i.e., containers for which substantial stretching of the planar substrate or liner stock materials would be required upon forming of the container shape), a substrate blank molded, folded, or otherwise formed to have the approximately the final conformation of the container can be used to reduce the risk of rupturing the substrate on account of over-stretching. For example, if a metal foil substrate is used, it can be folded and compressed from a flat sheet of foil to form a blank having the approximate shape of the final container prior to applying a polymeric liner sheet thereto. Under conditions at which the liner sheet can be thermoformed, the final shape of the container can be achieved by thermoforming the liner sheet against and re-shaping the blank in the thermoforming press.

For containers intended to contain foodstuffs (especially for human consumption), special consideration should be given to the choice of substrate materials. If the substrate material contains, or potentially contains (e.g., for recycled substrate materials), any substance injurious to health, the substrate should be used only in conjunction with a liner sheet (and/or barrier sheets or compositions interposed between the substrate sheet and the liner sheet) sufficient to reduce foreseeable migration of the substance from the substrate to the compartment under the conditions of anticipated use. Selection of appropriate materials is within the ken of the skilled artisan in this field.

The Substrate

The identity and composition of the substrate is not critical. A skilled artisan will recognize that substantially any formable material can be used, such as metals and thermoformable polymers (which are preferred substrates). The substrate sheet described herein need not be thicker, more rigid, or more opaque than any other sheet used to make the articles described herein. However, in many embodiments, it is desirable that the substrate contribute the majority of the rigidity, strength, and shape of the article, with other components contributing relatively less of these characteristics.

For example, in a bin or tray for containing meat or vegetable pieces, the substrate can be substantially the only component that retains the bin/tray shape when separated from the other components. Liner sheets that may serve to prevent direct contact between meat or vegetable pieces and the substrate and lidding that may serve to hold such pieces within the void of the bin/tray may be unable to retain their shape once cut or peeled from the substrate, and may contribute to the overall shape and rigidity of the filled bin/tray only to the extent that they seal the pieces therewithin or overwrap the bin/tray.

In embodiments in which recyclability of the substrate is an important attribute, the substrate should be a recyclable material and should constitute the majority (on a volumetric or weight basis) of the material used to form the article. The quantities of any non-recyclable or difficult-to-recycle liner or lidding material portions of such an article are preferably reduced or minimized (relative the quantities used in previously-known similar articles), so as to maximize the proportion of materials of the article that can be recycled and to reduce the proportion which must be landfilled, incinerated, or disposed of in another environmentally disfavored manner.

The Liner

The liner sheet must be susceptible of reversible attachment to the substrate and attachment (whether or not reversibly) to the lidding. The liner material should also be selected for physical and chemical compatibility of materials that are anticipated to be contained within the compartment. The liner can be made from the same material as the substrate (e.g., a thinner sheet of the substrate material), but preferably is not. If the substrate and liner are of the same material, a barrier composition must normally be interposed between them to prevent fusion of the two sheets during thermoforming operations. If they are not of the same material, then the materials, surface treatments, and thermoforming conditions should be selected such that the materials bind peelably under the thermoforming condition or—if they do not—a suitable peelable adhesive should be interposed between the sheets.

In an important embodiment of the containers described herein, the liner can be detached from the substrate, preferably without substantial tearing or stretching. The liner should be peelably attached to the substrate. Peelable adhesion can be achieved by any of variety of methods known in the art. By way of example, a peelable adhesive can be interposed between the liner and the substrate, or a liner faced with a polymer that peelably adheres to a face of the substrate (e.g., when the two faces are pressed together) can be used.

The identity and composition of liner polymer sheets used in the articles and methods described herein are not critical. A skilled artisan will recognize that substantially any peelable polymeric material can be used. Examples of suitable materials include polyethylenes, polypropylenes, polyethylene terephthalates, nylons, polyvinyl chlorides, copolymers of these, and combinations of these. Plant-based polymers, such as polylactates (also known as "lactic acid polymers" and PLAs) can also be used.

Because food containers must exhibit numerous properties, use of laminated polymeric materials is common in food containers, and such laminates may be used as the liner sheet in the containers described herein. Such laminates should include polymer layers that exhibit desired properties (e.g., tensile strength, vapor/odor resistance, moisture resistance, flexibility, lack of ingredients incompatible with food, at least in the absence of a barrier layer interposed between such ingredients and the compartment) and sufficient adhesives or tie layers to bind the layers together into a peelable sheet. The outermost polymer layers have added significance, in that the substrate-side face of the liner sheet must be compatible with reversible attachment of that face to the substrate (taking into account any materials interposed between the liner and the substrate) and in that the lidding-side face of the liner sheet must be compatible with attachment to the lidding (taking into account any adhesive or other materials interposed between the liner and the lidding).

Peelable liner sheets preferably have sufficient structural integrity that they do not tear or significantly stretch when subjected to forces necessary to peel them from surfaces to which they are adhered. For example, when a tray having a peelable liner layer is made as described herein, the peelable sheet can preferably be peeled from the substrate as a single, integral sheet (i.e., no holes or tears) while not rupturing the compartment defined by the liner and lidding. Peelable sheets that tear, stretch, or puncture are acceptable in embodiments in which containment of liquid within the peelable sheet is not required.

The liner sheets are preferably thin and highly flexible. Sheets having a thickness in excess of 8 mils can be difficult to peel, and so sheets thicker than that are not preferred. The liner sheets can be made from substantially any polymeric material(s) and by substantially any sheet-forming process. By way of example, suitable polymer sheets can be made by blowing, molding, casting, or extruding suitable polymer materials, or by some combination of these processes. When made of thermoformable materials, the liner sheets are preferably thermoformed simultaneously with the substrate to which they are adhered. When made of non-thermoformable materials, the peelable sheets should be capable of maintaining their structural integrity at a thermoforming conditions at which the substrate sheet to which they are adhered is thermoformable.

Liner sheets can be selected to be rigid (i.e., retain their shape after peeling) or substantially non-rigid (e.g., blown polymeric sheets such as the material used in trash can liners and trash bags).

The peelable nature of an individual liner sheet can derive from surface attraction between the liner sheet and the surface underlying it. Alternatively, an adhesive is interposed between the sheet and the surface and the peelable nature of the sheet derives primarily from the adhesive forces exerted by the adhesive upon the sheet and the surface. An adhesive can be selected (e.g., based on the chemical identity or the surface treatment of the liner sheet or the surface to which it is adhered) so that, upon peeling of the liner sheet, the adhesive preferentially remains adhered to the liner sheet, or to the surface (which is less preferable if the surface is the surface of a polymer body that is to be recycled). For instance, when the function of the liner sheet is to expose the substrate surface free of adhesive and other contaminants, the adhesive can be selected so that it both adheres the liner sheet and the surface and adheres more strongly (i.e., more tenaciously) to the liner sheet so that, upon peeling, the adhesive is removed from the substrate along with the liner sheet.

Differences in the tenacity with which an adhesive binds the opposed surfaces of two polymer sheets can be controlled in a number of ways, including by coating one or more portions of one surface with a composition that inhibits binding of the adhesive to the surface. Preferably, however, differences in the tenacity of adhesive-binding are controlled by selecting or treating the polymer sheets such that their opposed surfaces exhibit a difference in surface energies. If the difference between the surface energies of the two surfaces is relatively large—at least 5 Dynes per centimeter—then the adhesive will bind significantly more tenaciously to one surface than the other. As the difference in surface energies of the two surfaces increases beyond 5 Dynes per centimeter, the likelihood that all of the adhesive will remain with one sheet when the two sheets are separated increases. A difference of 5 to 14 Dynes per centimeter between the adhered surfaces of the two sheets is considered appropriate.

It may be possible to separate two surfaces having an adhesive interposed between them, even if the surface energies of the surfaces differ by less than 5 Dynes per centimeter. In this situation, the adhesive may adhere to each of the two surfaces with roughly equal tenacity, meaning that the adhesive may adhere to both surfaces (at various portions) after the two surfaces are separated from one another. In many applications, it is desirable to have most or all of the adhesive to adhere to the surface of only a single one of the polymer sheets (usually the one being peeled away from the remaining sheets or substrate). For such applications, the two surfaces contacted by the adhesive should preferably have surface energies that differ by at least 5 Dynes per centimeter.

The amount of force needed to separate liner sheets from their underlying surface is not critical, but is preferably sufficiently small to prevent tearing and substantial stretching of the peelable sheet upon manual peeling of the sheet from the surface. The amount of separation force needed is a function of the materials selected for the liner sheets, the underlying substrate surface, and any barrier composition or adhesive interposed between them. Practically speaking, the tenacity of adhesion between a liner sheet and the underlying surface should be selected so that the sheet can be peeled away from the surface using normal human strength, but not so tenacious that the sheet must be torn or punctured by a person peeling the sheet from the surface. A skilled artisan recognizes that the numerous variables (e.g., the angle at which the sheet is pulled from the surface, whether fingernails are applied to the sheet surface, the speed with which the sheet is peeled, the temperature of the shaped article at the time of peeling) can affect the peeling characteristics of the sheet, and the materials described herein include all materials that are operable under the ambient conditions corresponding to anticipated uses of the materials and shaped articles.

To the extent that an objective measure of the force needed to peel a sheet from an underlying substrate surface is desired, a standardized test of peel strength can be used. An example of a suitable test is ASTM D3330/D3330M, which is a standardized test for peel adhesion of pressure-sensitive tape. A modification of this procedure (e.g., substituting a sheet of the substrate material in place of the standard steel sheet in ASTM D3330/D3330M and selecting a peel angle appropriate for the intended use of the shaped article being tested) can also be used. In each case, the characteristics of the shaped article or stack should be selected such that the peel strength of the liner sheet from the substrate surface is within the limits of ordinary human strength.

Various surface treatments and polymer sheet ingredients can be used to affect the surface energy. In one embodiment, the substrate and liner sheets are made of the same material. Unless treated non-identically, the two faces of a polymer sheet will normally have the same surface energy. Therefore, in containers which include substrate and liner sheets of the same material, it is important that the two faces of the identical polymer sheets be treated differently, so as to yield a polymer sheet having different surface energy values for each of its two faces. Such sheets are preferably treated such that the surface energies of their faces differ by 5 Dynes per centimeter or more. Many compositions and methods for affecting the surface energy of polymer sheets are known to skilled artisans in this field, and substantially any of those methods may be employed. Such methods include conventional surface finishing techniques such as grinding and polishing, quenching and annealing processes, Corona treatment, and plasma contact techniques such as atmospheric, chemical, and flame plasma techniques. Compositions for affecting the surface energy of a surface of a polymer sheet are also well known, and include compounds that can be contacted or reacted with the surface to modify its chemical or physical properties (affecting its surface energy).

An example of a suitable surface treatment is the process known as Corona treatment or Corona discharge treatment, which involves application to a surface of a high-frequency, high voltage electrical discharge. Corona treatment raises the surface energy of a polymeric surface. Applied to one face of a polymer sheet having two otherwise identical faces. Corona treatment will raise the surface energy of the face, relative to the opposite face of the sheet. The power applied in a Corona treatment can be controlled to limit the treatment substantially to one side of a sheet. At very high power, the treatment can raise the surface energy of both faces of the same sheet which, in the absence of other surface treatments, will not yield a polymer sheet having different surface energies on its two faces. If a polymer sheet is Corona treated at or near the time it is formed, the surface energy-raising effects of the treatment can endure for weeks, months, or years. If the sheet is Corona treated days, weeks, or later after the sheet is made, the surface energy-raising effects of the treatment can be more transitory (e.g., enduring only for days or weeks). Polymer sheets that are Corona treated at or very near the time they are formed can be used in the containers described herein. Polymer sheets can also be "bump-treated" (i.e., be Corona treated regardless of how long it has been since the sheet was formed) shortly before making the stacks and articles described herein.

The liner sheet can also be attachable to the lidding, preferably without the aid of a mechanical device that continuously urges the liner and lidding against one another (i.e., the liner and lidding "stick" without continuously-applied external pressure). Preferably, the liner and lidding adhere to one another or fuse under conditions used to contact the lidding and the liner. By way of example, if the opposed liner and lidding faces are made from the same polymer, the two sheets can be caused to fuse if the faces are urged against one another at a temperature sufficient to permit fusion (e.g., the melting temperature of the common polymer). Alternatively, an adhesive can be interposed between the liner and the lidding to form the seal, so long as the adhesive binds both opposed faces.

The seal between the liner and the lidding can be peelable (i.e., the tensile strength of the seal can be less than the tensile strength of the weaker of the two polymer sheets), but need not be. When liquid containment within (or exclusion from) the compartment is desired, the seal should have sufficient strength (i.e., rigidity and/or resiliency) that the seal will not be breached during anticipated ordinary handling of the container. The seal between the liner and the lidding can be essentially irreversible, too (i.e., the tensile strength of the seal can be greater than the tensile strength of the weaker of the two polymer sheets), in which case opening of the compartment will ordinarily be achieved by breaching one or both of the liner and lidding, rather than by separating them along the seal.

The material used as the liner should be selected to exhibit sufficient barrier properties to exclude from the interior of the compartment any material(s) that are anticipated to be present at the substrate face of the liner under conditions of ordinary use of the container, taking into account both materials present in the substrate and materials present in any adhesive, barrier compositions, additional polymer sheets, or other components interposed between the liner and the substrate. Selection of materials based on their barrier properties is routine in the art, given knowledge of the material(s) for which migration is to be avoided.

In a preferred embodiment, the liner material is peelably adhered to the substrate and is closely opposed against a surface of the substrate, such that it can be difficult for an ordinary observer to tell that the liner is present, except perhaps at a selected area where a tab or folded portion of the liner is present to facilitate peeling thereof. In another embodiment, the materials or characteristics (e.g., color) of the substrate and the liner are selected to clearly differentiate whether or not the liner and the substrate are adhered. By way of example, a white liner can be applied against the face of a black substrate, such that the presence of the liner is obvious. The liner, the substrate, or both can also carry an indicia (e.g., a stripe, an arrow, or the text "PEEL HERE") that highlight a portion of the container at which peeling of the liner from the substrate can be initiated.

The liner should also be selected to have sufficient barrier properties to maintain desired conditions within the compartment, taking into account barrier properties of the substrate at positions at which the liner and substrate are laminated. Food containers are commonly intended to maintain a desired atmosphere (i.e., gas content and/or humidity), presence or absence of compounds within the compartment, or other physical or chemical characteristics in the compartment in which a foodstuff is contained. By way of example, foodstuffs that are relatively susceptible to discoloration or degradation in the presence of atmospheric levels of oxygen are sometimes packaged in an atmosphere from which oxygen is substantially depleted, such as a nitrogen, argon, carbon dioxide, or carbon monoxide atmosphere. Such packaging techniques are commonly referred to as modified atmosphere packaging or MAP techniques.

For containers intended for use in combination with desired compartment conditions, a liner material capable of maintaining those conditions under the conditions of anticipated use of the container should be selected. Such selection is within the ken of a skilled artisan in this field.

By way of example, meat and poultry products can be packaged in a container in which the substrate is made from a PET material (e.g., amorphous PET or PETG) and each of the liner and the lidding are a laminate polymer material. In this example, the liner can have a substrate-side face composed of ULDPE or LLDPE, a nylon lamina to confer tensile strength to the liner, an EVOH or PVOH lamina to inhibit moisture and vapor passage through the liner, and a lidding-side face composed of a material identical to the liner-side face of the lidding (i.e., to facilitate heat fusion of the liner and lidding upon application of heat to the opposed faces). The lidding in this example, can have the same layers as the liner. In one embodiment, the liner and the lidding are identical (e.g., viewed in cross section, the two sheets have the identical composition, only in an inverted configuration, such that 'top' of one sheet contacts the 'top' of the other), such as an embodiment in which a portion of the liner is laminated against a convex surface of the substrate and a second portion of the liner forms a flap that can be folded across the opening of the convex surface and sealed against itself (i.e., the liner and the lidding are part of the same sheet of polymer or laminate).

In embodiments in which a rapidly-quenched polymer sheet is used to promote adhesion, it can be preferable that a face of the sheet that was directly quenched (e.g., the face against which water was applied in a water-quenched blow extrusion process, the face opposed against a chilled metal surface in a casting process, or a face contacted against a chilled extrusion die) be applied against the sheet to which it is to be adhered. Thus, for example, in articles in which a rapidly-quenched, relatively thin liner sheet having an EVOH layer sandwiched between two LLDPE layers is adhered against an ordinary (i.e., not rapidly-quenched), relatively thick PET substrate sheet, a LLDPE face of the liner sheet against which a quenching agent was applied in order to effect rapid quenching is the face that is preferably applied against the PET substrate. In this example, the liner sheet can be laminated against the PET substrate sheet using a cold-nip roller, and the resulting laminate can be thermoformed and cut to yield the shaped article, such as a tray from which the liner can be peeled. If, in this example, the PET sheet was also rapidly quenched, the directly quenched face of the PET could be applied against either face of the liner sheet, just as the directly quenched face of the liner sheet could be applied against either face of the substrate sheet. Enhanced adhesion can be exhibited by laminates in which both opposed faces of adjacent sheets are the directly quenched face of a rapidly-quenched polymer sheet. By selection and arrangement of the directly quenched face(s) of laminated sheets, a skilled artisan in this field is able to obtain and select among a variety of useful configurations.

Because containers can be subjected to a wide variety of ambient conditions, containers that will be so subjected should be constructed using a liner material that has about the same coefficient of thermal expansion ("shrink rate") as the substrate.

The Lidding

The identity of the materials used as the lidding is not critical, other that that the lidding should be attachable to the liner and should exhibit any properties (e.g., tensile strength, barrier properties, ability to carry printing or adhesive labels, and surface appearance) required for the desired application. The lidding material can be the same material as the liner, or it can be different.

In one embodiment, the container is supplied in the form of a kit that includes a shaped substrate (e.g., a tray or bowl) that has a liner peelably laminated against a face thereof and a separate lidding material, supplied either as a roll or as a piece of lidding having a size and shape corresponding to the portion of the shaped substrate to which the lidding will be applied and attached to the liner.

In another embodiment, the container is supplied in the form of a shaped substrate (e.g., a bowl or tray) having a liner peelably laminated against a face thereof, with the lidding present as an extension of the liner and shaped and positioned such that the extension can be folded across the portion of the substrate bearing the liner and attached to the liner (e.g., "a bowl with a flap," the flap having a size and shape sufficient to cover the shape of the bowl with sufficient overlap along the periphery thereof to permit sealing between the flap and the portion of the liner borne by the periphery of the bowl, and the flap being positioned and dimensioned such that it can be folded across the orifice of the bowl and contact the liner about its periphery to facilitate such sealing about the entire periphery).

In yet another embodiment, the container is supplied in the form of a non-shaped (i.e., substantially flat or planar) piece of substrate material having a piece of liner material opposed against it (with or without additional polymer layers, adhesives, barrier compositions, or other materials interposed between the pieces). The substrate and liner can be simultaneously thermoformed and the lidding thereafter attached to the liner. In still another embodiment, the liner and the lidding are attached to one another (forming the compartment and optionally enclosing an article) prior to reversibly attaching the liner and the substrate.

Adhering Polymer Sheets

As disclosed herein, various layers (sheets) of polymeric materials are intended to be combined to form laminated containers and other articles, but the layers/sheets are intended to remain separable from one another (e.g., peelable using ordinary human strength) in many embodiments. The adhesives described herein can be used to assemble such laminated structures. However, in some applications (e.g., food containers), it is preferable that the laminated structures be made in a manner that does not involve interposing an adhesive between laminae, but nonetheless yields laminated articles in which the laminae remain relatively fixedly associated with one another until a lamina is peeled from the article by a user. Disclosed herein are polymer sheets which peelably adhere to the surface of other polymers without the use of an interposed adhesive, as well as methods of making and using such sheets.

It is well known that dissimilar polymer sheets (e.g., barefoot PE and PET sheets) will generally not adhere to one another absent static charge differences, the presence of an interposed wetting agent, sealant, or adhesive, co-extrusion of the polymer layers, inclusion of adherence-promoting additives in one or both sheets, or heating one or both polymer sheets above its melting point while urging it against the other. Although these methods can be used to adhere polymer sheets, their utility is limited for making some of the laminated articles described herein.

By way of example, owing to government regulations, good manufacturing practices, and the added cost of interposing an agent (e.g., an adhesive) between adjacent polymer sheets, many chemicals are not used in food packaging materials, and food containers preferably do not include unnecessary components. For that reason, it is preferable to make containers that lack adhesives, wetting agents, or other chemical agents interposed between polymer layers. Some of the articles described herein can be used for containing food, and contact between the food and interlaminar adhesives or other agents (whether direct contact or indirect contact, such as by migration of such agents across or around polymer layers) can raise contamination and regulatory concerns. At least in some embodiments, the food containers (and other containers) described herein preferably do not include adhesives or other materials interposed between peelable polymer layers, and instead incorporate adherable polymer sheets as described in this section.

Methods of rendering polymer sheets peelably adhered to one another can also impose manufacturing limitations that render such methods impractical for use on a large scale. By way of example, some PE films can be peelably adhered to PET substrates if the PE is heated above its melting point and compressed against the PET. Thus, for example, a 2 mil PE sheet can be peelably adhered to a 20 mil PET substrate by stacking the two sheets and passing them through a hot nip roller that induces melting of the PE. However, such processes can be limited by the rate at which the hot nip can transfer heat to the PE film, which leads to relatively slow processing speeds and impracticality in commercial-scale manufacturing. Similarly, it can be difficult to adequately and reliably deliver adhesives and wetting agents between two polymer sheets at high processing speeds. Articles made using adherable polymer sheets can generally be manufactured at greater line speeds because these process limitations are not present.

Interposition of adhesives, wetting agents, or other materials between polymer sheets can also reduce the recyclability of the "webbing" (i.e., laminated polymer material trimmed or excluded from manufactured articles during the manufacturing process) that is produced as a by-product of the thermoforming manufacturing process. Because the laminated polymer sheets of the webbing can be separated from one another without having an adhesive or other agent adhered to either sheet, the resulting separated sheets can be more easily recycled or re-used than sheets from similar processes that employ such agents.

It has been discovered that laminated articles described herein can be made using polymer sheets that can be peelably adhered to one another without the use of interposed adhesives or wetting agents and without application of heat prior to thermoforming. Polymer sheets that peelably adhere to other polymers include especially those in which the face of the sheet to be adhered to the other polymer has been rapidly quenched, such as by liquid quenching in a blow-molding process or by liquid (or liquid-cooled metal surface) quenching in a sheet-casting process. Such sheets can be peelably adhered by opposing the rapidly-quenched face against the other polymer and urging the sheet toward the other polymer, such as by using a cold nip roller process. The rapidly-quenched face can be a face of a thin liner sheet urged against a face of a relatively thick substrate sheet. Alternatively, a face of a relatively thick substrate sheet can be rapidly-quenched and urged against a face of a relatively thin liner sheet. In either configuration, urging the rapidly-quenched face against the other will cause the two faces to adhere, especially if the two faces are urged together coherently over a large area, such as by compressing the two sheets against one another between a roller and another surface such as a second roller. In fact, both of the opposed faces can be rapidly-quenched.

The properties of rapidly-quenched polymer sheet faces that result in peelable adhesion are believed to include its tackiness, deformability, and cohesiveness. In this context, "tackiness" relates to exhibition of the tactile sensation of stickiness, at least to a small degree, such as a feeling of releasable adhesion to a human finger pad when the finger is pressed lightly against the surface in a direction perpendicular thereto and withdrawn in the same direction. "Tackiness" also relates to exhibition of friction, as measurable by the coefficient of static friction measurable when the rapidly-quenched polymer face is applied against a substrate face. A relatively tackier material will exhibit a greater coefficient of static friction when at rest against a substrate surface than a less tacky material at rest against the same surface. "Deformability" relates to the ability of the rapidly-quenched polymer face to be displaced from its original conformation and more nearly mirror the conformation of a polymer surface against which it is urged. "Cohesiveness" relates to the ability of the rapidly-quenched polymer face to remain a substantially unitary polymeric mass (i.e., without splitting or fracturing) when urged against a polymer surface.

Although the materials described in this section are referred to as "rapidly-quenched" polymer sheets, the utility of these materials does not necessarily depend on the duration of the quenching period. Instead, it is the combination of properties (i.e., tackiness, deformability, and cohesiveness) that are exhibited by rapidly-quenched polymer sheet faces that lend utility to the materials. It is recognized that skilled artisans in this field are able to mimic the surface and bulk properties of polymer sheets that are attainable by rapid quenching through use of methods and reaction conditions that do not depend solely on the temporal duration of polymer annealing. By way of example, annealing of polymer strands and their distribution among amorphous and crystalline regions can be affected by humidity, temperature, the presence of solvents, the presence of nucleating agents (or anti-nucleating agents), and other factors known in the art. Without being bound by any particular theory of operation, it is believed that reducing the degree and extent of crystallinity at the surface of a polymer sheet is an important factor for enhancing the tackiness of a polymer surface, and methods and reaction conditions that will tend to reduce the degree and/or extent of crystallization are preferred. Still without being bound by any particular theory of operation, it is believed that relatively low density is another favorable characteristic induced by rapid quenching at polymer surfaces, although it is unclear whether the relatively low density is causative of tackiness, coincidental with tackiness, or both. Relatively low density is, for most polymers, coincidental with a less-ordered (e.g., less crystalline) polymer structure. Furthermore, phase conversions among polymer phases having different densities can contribute to adhesion in polymers capable of undergoing such conversions (e.g., upon compression between rollers during lamination).

Whether adhesed with or without an interposed adhesive, the degree of adhesion that is usefully attained between a liner sheet and an opposed substrate sheet is preferably a sufficient degree of adhesion that the liner and substrate can be laminated and thermoformed into a shaped article without substantial delamination of the liner from the substrate. More preferably, the degree of adhesion is sufficient that the article can be not only formed without substantial delamination, but also employed for its intended end use without substantial unintended delamination. Depending on the application and use of the article, a greater or lesser degree of adhesion can be desirable between adjacent liner sheets, particularly for applications and articles intended to have separately-peelable liner layers.

By way of example, for the food container described herein having a thick, rigid substrate with a liner peelably adhered thereto, the liner having a lidstock material bound about its periphery to form a peelable leak-proof 'pocket.' the liner preferably adheres to the substrate to a sufficient degree that the liner and substrate can be laminated and thermoformed into the shape of a tray without the liner delaminating to a substantial degree from the substrate (other than at an intentionally-formed tab, for example, the tab included to facilitate peeling of the liner from the substrate). More preferably, a foodstuff can be placed upon the tray and a lidstock heat-sealed to the liner about the foodstuff (e.g., under vacuum to remove gases from between the liner and the lidstock) to form a leak-proof, foodstuff-containing pocket adhered to the tray, and the degree of adherence between the liner and the substrate is sufficient that these operations can be performed without the liner substantially delaminating from the substrate. Still more preferably, the degree of adherence is such that, even when the packaged foodstuff is subjected to the handling and storage conditions normally incident to wholesale and retail sale of the foodstuff, substantially no delamination of the liner from the substrate occurs until such delamination is intentionally initiated by an individual desiring to consume the foodstuff.

A skilled artisan in this field understands that the coefficient of friction and other characteristics of two adhered polymer sheets are typically assessed empirically, and that the magnitude and combination of characteristics that are desirable for a selected article or application tend to be functionally, rather than numerically, defined. Thus, a skilled artisan attempting to make and use the articles described herein will often select materials that are empirically determined, through reasonable trial-and-error, to exhibit characteristics sufficient to achieve the desired end, taking into account what is taught in this disclosure.

While not being bound by any particular theory of operation, it is believed that relatively rapid quenching of a polymer tends to preserve the amorphous configuration of polymer strands relative to one another and reduce crystallization of polymer strands, while slower quenching facilitates formation of crystalline and other ordered polymer configurations. It is believed that a relatively disordered polymer strand conformation promotes (more so than do ordered conformations) the ability of polymer strands to bind with surfaces they contact, because chemical moieties on the strands that exhibit binding capacity are not bound to other strands of the same polymer and therefore remain available to bind with moieties at the surface. It is also believed that a relatively disordered polymer strand conformation promotes (more so than do ordered conformations) the ability of polymer strands to be displaced upon being urged against such a surface. Thus, it is believed that rapidly quenched polymer materials can conform more closely against an opposed surface and present a greater number/concentration of surface-binding moieties than can more slowly quenched materials, even those composed of the same polymer. By contrast, strands in slowly-quenched polymers can rearrange themselves to assume more stable conformational and energetic inter-strand configurations, thereby reducing their 'adhesive reactability' with a surface against which such slowly-quenched polymers are urged.

The degree of crystallinity is known to affect the barrier properties of polymer sheets in relatively predictable ways. By way of example, the oxygen permeability of nylon and EVOH films tends to decrease as the degree of crystallinity increases. Thus, selection of polymers for liner and substrate sheets (and layers within sheets) should take those characteristics into account. By way of example, the EVOH layer of a liner sheet formed by sandwiching an EVOH layer between two LLDPE layers can have higher oxygen permeability if the sheet is formed by liquid-quenched blow extrusion than if a sheet having layers with identical dimensions and compositions is formed by ordinary (air) blow extrusion processes. In such an instance, the thickness of the EVOH layer of the liquid-quenched blow extruded liner sheet may need to be increased if the sheet is to exhibit the same oxygen barrier properties as the (air) blown sheet. Such modifications of known polymer sheet designs are within the ken of the skilled artisan in this field, even if empirical trials may be necessary.

Tackiness and deformability of the rapidly-quenched polymer are believed to be related, in that as deformability of the polymer increases, less tackiness is required in order to peelably adhere it to a polymer surface. Similarly, it is believed that as tackiness of the polymer increases, less deformability is required in order to peelably adhere it to a polymer surface. A skilled artisan in this field understands that a polymer compositions, properties, and production methods are often adjusted through reasonable empirical trials, and such trials are well within the ken of such an artisan.

The adhesive force between the quenched polymer face and the polymer surface to which it is adhered should be sufficient to maintain the adherence during manufacture of the articles described herein and their ordinary (pre-peeling) use. The tenacity with which the quenched polymer face and the polymer surface are adhered should not be so great that the two polymers cannot be separated by a user of ordinary human strength, and should also not be so great that either polymer will tear prior to peeling from the other. By way of example, in a retail food container in which a rapidly-quenched polymer sheet is used as a liner for a substrate, the liner should adhere to the substrate sufficiently tenaciously that it remains adhered thereto as the container is made, shipped to a food processor for filling, and used to contain a food through processing, shipment, and wholesale and retail sale.

A drawback of insufficient adherence between a liner sheet and a substrate sheet is that air pockets can be included between the sheets during lamination if the sheets are not uniformly pressed against one another. Formation of such air pockets can also be induced if the laminated sheets are too sharply 'pinched'—i.e., if the laminated sheets are caused to deflect from a planar conformation and the radius of curvature of the deflection is too small. When a laminated sheet having an air pocket between its lamina is thermoformed, the heat of the thermoforming can cause the air in the pocket to expand and prevent adhesion between portions of the sheet that were intended to be adhered. The materials and processes used to make the shaped laminated articles described herein should therefore be selected to reduce occurrence of air pockets. Two significant ways in which air pocket occurrence can be reduced are by laminating sheets flush against one another (i.e., with flat faces opposed against one another, substantially without wrinkles, such as by passing through hot or cold rollers) and by reducing the curvature angle of any deflections to which the laminated sheets are subjected. By way of guidance, many thermoforming and plastic-sheet-laminating processes can be performed without causing the sheets to bed around any corner having a radius of curvature less than two inches; selection of materials which, when adhered flush against one another and bent about a corner having a radius of curvature of two inches or more, remain laminated and do not admit air pockets between the sheets should be suitable for making the articles described herein.

Such containers can be sold in the form of a kit, the kit including a substrate having a polymeric liner sheet adhered thereto by way of a rapidly-quenched face and a lidding material adapted for binding (by adhesion, adherence, or fusion) with the liner sheet. Using such a kit, food processors, retailers, or others can place an article (e.g., a foodstuff) on or in the container at a surface at which the article contacts the liner and seal the article within a compartment by binding the lidstock to the liner about the article.

The material(s) from which the adherable polymer sheets described herein are made is not critical, other than that it should be capable of exhibiting the properties described herein. By way of example, PEs and other polyolefins are believed to be suitable materials which can be rapidly quenched and, when so quenched during their manufacture, will exhibit the properties described herein. Suitable adherable polymer sheets have been made by rapid quenching of PE and ULDPE polymers, for example, and those rapidly-quenched polymer faces exhibited peelable adherence to smooth PET substrates when compressibly urged together using a cold nip roller followed by thermoforming.

Multilayer films having a rapidly-quenched surface can be used as the adherable polymer sheets, so long as the rapidly-quenched polymer is present on at least one surface of the sheets. Sheets having rapidly-quenched polymer on both faces are suitable, and can be manufactured, for example by adhering, back-to-back, two sheets having a rapidly-quenched polymer face on their front faces. Such dual-faced sheets can be used to peelably adhere two polymer substrates to one another by compressing a stack having the two substrates with the dual-faced sheet interposed therebetween.

The properties of the surface to which adherable polymer sheets are adhered are not critical. Such surfaces should, however, be relatively smooth so as to facilitate close opposition of the sheets thereto and binding between the rapidly-quenched polymer layer and the substrate. Polymeric substrates (e.g., PETs, PETGs, polystyrenes, and the like) are considered suitable and other polymers undoubtedly are as well.

The method of manufacturing the adherable polymer sheets described herein is not critical, and indeed appears to be far less important than that the face of the polymer sheet that is adherable be rapidly quenched from a melted state during its manufacture. A preferred method of manufacture is by liquid-quenched blow extrusion processes. Equipment for performing liquid-quenched blown film extrusion is available from at least two manufacturers, Windmoeller & Hoelscher Corporation (Lincoln, R.I.; especially their AQUAREX brand water-cooled blown film extrusion apparatus) and Brampton Engineering (Brampton, Ontario, Canada; especially their AQUAFROST brand water-cooled blown film extrusion apparatus). Various film casting systems can also be used, so long as at least one face of the film is made of a polymer capable of exhibiting the properties described herein upon rapid quenching and that face is rapidly quenched.

Rather than rapidly quenching an entire polymer sheet, only one or more portions of such a sheet can be rapidly quenched. By way of example, a molten polymer extrudate can be layered onto an existing film and then rapidly quenched (e.g., by flooding the molten face with liquid, by immersing in liquid the film carrying the molten face, or by compressing the molten face against a liquid-cooled metal surface, such as a metal roller having chilled water circulating therein or a liquid-cooled die connected with an extruder). Further by way of example, a polymer sheet can be formed in a conventional way, with no face thereof being rapidly quenched. A face of the sheet can thereafter be melted (whether or not other portions of the sheet are melted) and the molten face rapidly quenched.

In one embodiment, stacks of polymer sheets suitable for thermoforming into shaped articles having a peelable surface (e.g., food containers) are made by laminating at least two polymer sheets, with at least one of the opposed faces of two adjacent sheets having the rapidly-quenched surface with the properties described herein. Upon lamination (e.g., by passage of the stacked sheets between a cold nip roller or other compressing apparatus), the sheets become peelably adhered to one another. More than two sheets can be peelably laminated in this manner, provided that at least one surface between each pair of adjacent sheets has the rapidly-quenched surface with the properties described herein. Of course, multi-sheet laminates can also be made in which some adjacent sheets are peelable on account of the presence of the rapidly-quenched surface with the properties described herein and other adjacent sheets are peelable on account of the presence of a peelable adhesive interposed between them.

In another embodiment multiple identical sheets are layered atop a substrate and are individually peelable from the construct, on account of there being a rapidly-quenched surface with the properties described herein at at least one face of each pair of adjacent sheets. Thus, for existence, a recycled PET substrate can be coated with multiple stacked sheets of a bi-layer film, each sheet of the bi-layer film having a rapidly-quenched ULDPE layer tied to a virgin PET layer. The rapidly-quenched ULDPE layer of the sheet adjacent the substrate peelably adheres to the substrate and displays the virgin PET layer on its opposite face. Stacked thereon is a second sheet, such that its ULDPE layer peelably adheres to the virgin PET layer of the first sheet, the second sheet having its virgin PET layer situated distally from the substrate. Additional layers can be stacked thereon, and the stack can be thermoformed, the thickness of the stack being limited substantially only by the operating characteristics of the thermoformer and the thermformability of the polymers in the stack. Similarly, the first polymer sheet (adjacent the substrate) can have rapidly-quenched ULDPE tied to both faces of a PET sheet, such that it peelably adheres to the substrate at one face and presents at its other face a rapidly-quenched ULDPE layer that can be peelably adhered to the virgin PET layer of the PET-ULDPE bilayer sheet. Additional bilayer sheets can be layered thereon, each with its PET face proximally facing toward the substrate.

Making the Container

The articles described herein can be made using known thermoforming apparatus and conditions. Of course, the apparatus and conditions should be selected based on the identity and the characteristics of the materials to be processed. Selection of appropriate thermoforming conditions, based on the identity(ies) of the materials to be processed is within the ken of a skilled artisan in this field.

The container is formed by reversibly attaching the liner to the substrate and by attaching the lidding to the liner to form the compartment for containing material.

The substrate can be formed into a desired shape before or after detachably attaching the liner thereto. However, at least for thermoformed containers, it can be convenient to simultaneously (or nearly simultaneously) attaching the liner to the substrate and forming one or both of the liner and substrate. Preferably, the substrate has a thickness substantially greater than the liner (e.g., a 10, 20, or 50 mil substrate can be bound with a 1, 2, or 5 mil liner). Preferably, both the liner and the substrate are thermoformable, and preferably at a common thermoforming condition.

In one embodiment, the substrate, the liner, and the lidding are simultaneously subjected to the thermoforming condition, and reversible attachment of the liner and substrate and attachment of the liner and lidding occur substantially simultaneously in the thermoforming operation. Containing an article within the compartment of a container made in this way requires either that the compartment remain open after thermoforming operation or that the article be interposed between the liner and lidding sheets during thermoforming, so that the article is contained within the compartment following thermoforming.

One or more tabs can be interposed between the substrate and the liner, between the liner and the lidding, or both. If a tab extends beyond an edge of two sheets, the tab can be used to facilitate separation of the first sheets after thermoforming or sealing. The tab can be adhered to either sheet or to neither.

In one embodiment, the tab is relatively fixedly adhered to the lower surface of a liner sheet that overlies the substrate. The tab is either peelably adhered to or not adhered to the underlying substrate, such that the overlying liner sheet can be peeled from the underlying substrate by grasping the tab and pulling the overlying sheet by way of the tab. The tab can, for example, be formed by folding a piece (e.g., a corner) of the liner over itself.

In a second embodiment, the tab is relatively fixedly adhered to the shaped surface of the substrate and either peelably adhered to or not adhered to the overlying liner sheet, such that the overlying liner sheet can be peeled from the surface by scratching (e.g., with a fingernail or an edged instrument, such as the tine of a fork) the edge of the overlying liner sheet that overlies the tab to begin partial peeling of the overlying liner sheet at the location of the tab, and then grasping the partially peeled portion of the overlying liner sheet and manually peeling the remainder of the overlying liner sheet away from the surface by pulling on the partially peeled portion.

Although a loose stack of polymeric sheets can be thermoformed using the materials and methods described herein, it can be convenient to bind the substrate and liner sheets to one another prior to thermoforming (e.g., to facilitate combination, storage, shipping, handling, manufacture, and alignment of the sheets). The means used to bind the sheets to one another is not critical, but preferably does not affect the properties of the sheets in the region(s) of the sheets that are to be thermoformed. By way of example, the sheets can be bound together using a glue applied to a common edge of the first and second sheets, by fusion of a common edge of the sheets, by stapling the sheets together, by adhering the sheets together using an adhesive applied between the sheets at an inter-sheet area distinct from the shaped section of the sheets, or by other means, such as providing a continuous (i.e., much longer than it is wide) roll of substrate sheet having the liner sheet adhered thereto or opposed against it.

Improved Methods of Making Multi-Layer Plastic Articles

A significant aspect of this disclosure relates to methods by which shaped articles having multiple layers of different plastics can be made. It is known to thermoform laminated plastic materials into shaped articles by providing to a thermoforming apparatus a multi-layer thermoplastic-containing sheet. The thermoplastic layer(s) of such sheets impart thermoformability to the sheets, while other layers can impart other desirable properties, such as gas and odor resistance, color, suitability for receiving ink and other printing materials, light impermeability, and solvent (e.g., water) resistance.

Typically, thermoplastic-containing sheets include two or more different materials (e.g., two or more different polymers or a thermopolymer and another material, such as paper or metal foil) are formed by coextrusion, either of multiple polymers simultaneously or by extrusion of a polymer onto a base material, such as a pre-formed polymer sheet or a sheet of paper or metal foil or by coextrusion of multiple polymer layers. The sheets can be shaped or formed during the extrusion/coextrusion process in various known ways (e.g., by expansion in an blown film extruder) and the resulting thermoplastic-containing sheets can be cut or rolled into leaves or rolls of a selected size or shape for storage, shipment, or subsequent use. The thermoplastic-containing sheet is fed into a thermoformer, shaped, and trimmed if necessary to yield the shaped article.

In order to form a shaped article having a defined combination of material layers by such processes, the thermoplastic-containing sheet fed to the thermoformer typically has the defined layers already formed and bound together. Although the multi-layer sheets facilitate the forming process, it is impractical to alter or rearrange the order of the layers in the sheets, meaning that substantially the only use for the pre-formed multi-layer sheet is to make shaped articles having those layers in the existing order. Furthermore, manufacture of the multi-layer sheet can be expensive and require substantial effort.

At least some of the expense and effort needed to produce specialized multi-layer sheets for thermoforming into shaped articles having corresponding specialized layers can be avoided by feeding homogenous layer materials, readily-available multi-layered materials, or some combination of these into the thermoforming process. These methods avoid the need for the pre-formed multi-layer thermopolymer-containing sheets and render the thermoforming process more readily changeable, since the materials fed to the process can be altered substantially at will. These methods also have the advantage that the web that remains after thermoforming articles and cutting those articles from the sheets of component polymers can be disassembled into its component sheets and those sheets can be recycled or re-used. Webs from pre-formed multi-polymer sheets can be difficult to recycle, especially when they are adhered or fused beyond the thermoformed areas. In the methods and articles described herein, web portions of homopolymer sheets assembled at or near the time of thermoforming can be relatively easily separated after thermoforming.

In the thermoforming processes described herein, a stack consisting of the desired layers of the shaped articles is assembled during, or immediately prior to, thermoforming, and the desired layers are subjected to thermoforming together under conditions sufficient to bind the layers together in the desired order and with the desired degree of tenacity and peelability. By way of example, shaped trays having a thick recycled PET substrate layer, a thin virgin PE layer for contacting a foodstuff, and a very thin EVOH layer for inhibiting permeation of oxygen and flavor/odor compounds through the tray can be formed by feeding separate films of the PET substrate, the virgin PE, and a commercial EVOH film having ULDPE coextruded on both faces thereof into a thermoformer, the films interleaved in the desired order, and thermoforming the resulting stack. If the materials and thermoforming conditions are selected such that the film layers bind (peelably, releasably, or substantially irreversibly) to one another, no other materials need be used. For materials that do not bind with one another (assuming such binding is required in the finished shaped article), interposition of an adhesive or a material that does bind with both materials between the otherwise-non-binding materials can link the materials together, yielding a integral shaped article after thermoforming.

In these methods, it is not necessary that each of the sheets and materials is thermoformable. However, at least one of the materials must be a thermoformable polymer sheet. Each non-thermoformable material used in the thermoformed stack should be applied, attached, or linked to a thermoformable material of the stack sufficiently that the material retains the conformation of the shaped article following thermoforming. As described herein, it can be desirable to prevent attachment of the various materials of the stack to one another at selected regions of the shaped article, such as at a reservoir portion of a shaped article intended to sequester liquid. In such articles, a barrier composition can be used (or an adhesive omitted) at the region at which non-attachment of materials is desired, so that the materials do not remain attached to one another at the region during thermoforming.

The materials used can be selected to yield a shaped article having desired properties, such selection being within the ken of a skilled artisan in this field. By way of example, many combinations of materials are known to be suitable for making food containers having desirable physical and chemical properties. An example of such a food container is a tray-shaped container for accepting a lidstock and containing therein a foodstuff (e.g., a cut of meat or ground meat) and an atmosphere consisting of a selected combination of gases, the container being composed of a relatively thick, substantially rigid substrate layer made from a material such as recycled PET, a relatively thin food-contacting surface layer made from a material such as virgin PET (optionally having a layer of PE laid thereon or tied thereto to facilitate fusion of lidstock with the tray), and a thin barrier layer of an EVOH polymer interposed between the substrate and surface layers, for preventing exchange of oxygen between the contained atmosphere and the environment surrounding the container.

In one embodiment of these methods, individual sheets corresponding to each of the desired layers of the shaped article are assembled into a stack by interleaving the sheets and urging them together between unheated nip rollers immediately before feeding the stacked sheets into a thermoforming press having a vacuum-assisted female mold. In another embodiment, multiple sheets corresponding to adjacent layers of the shaped article are urged against one another between heated nip rollers in the presence of an adhesive that covalently binds the sheets to one another. The resulting sheet is fed (alone, or together with other sheets, as in the preceding embodiment) into a thermoformer and shaped. In yet another embodiment, an upper sheet, and intermediate sheet, and a lower sheet are fed into a thermoformer, and operation of the thermoformer is relied upon to urge the three sheets against one another, fuse them, and shape them. The upper sheet is a homopolymer sheet, and the lower sheet is a sheet of the same or another homopolymer. The intermediate sheet is a sheet formed by coextrusion onto a central base sheet of a polymer of a first binder that is identical to the homopolymer of the upper sheet (or a tie layer that binds both the base sheet and the upper sheet) and a second binder that is identical to the homopolymer of the lower sheet (or a tie layer that binds both the base sheet and the lower sheet). Upon operation of the thermoformer, the upper sheet is urged against and fuses with the first binder of the intermediary sheet and the lower sheet is urged against and fuses with the second binder of the intermediary sheet, yielding an integral shaped article.

As described herein, the various sheets and materials interposed between them and the stacking and thermoforming conditions can be selected by a skilled artisan to yield a shaped article in which the various adjacent polymer layers are fused, substantially irreversibly adhered, releasably adhered, peelably adhered, substantially not adhered, or prevented from adhering (e.g., by a barrier composition).

Immediately-Post-Fabrication Peelable Coating of a Substrate

Polymer sheets suitable for use as the substrate layer in the containers described herein can be fabricated by many well-known methods, including sheet casting and extrusion operations. In many of those methods, a hot liquid (or semi-solid) polymer resin is spread against a base (in casting methods, the base commonly being a solid surface, a liquid surface, or a column of pressurized gas, such as in blow molding), extruded through a die, or both. The hot resin is cooled as a desired shape and thickness are achieved, yielding the finished film. The cooling process is typically aided by processing machinery or fluids, such as metal calendaring rolls (which can have a chilled liquid flowing through them), a chilled metal casting surface, a chilled fluid casting medium, or a chilled liquid in direct contact with a blown film (such as in liquid-cooled blow extrusion process). Heat removed from the hot resin by process equipment or fluids is typically either absorbed (e.g., in batch processes) or transmitted to a heat sink in continuous processes, and such heat is often not used for other purposes.

The energy that must be removed from a hot polymer resin during forming of a solidified plastic film or article can, instead of being discarded, be used to peelably adhere a polymer layer to the solidified film or article as a part of the cooling process. This can be performed as follows.

During formation of a plastic film or article from a molten resin, the resin material will attain a conformation that is the same as, or similar to, the final desired conformation of the film or article and at which the resin is sufficiently cooled that it is no longer molten, but retains a significantly greater amount of heat energy than the finished film or article. Rather than removing and/or dissipating that heat with process machinery or fluids, a second polymer that has a conformation that is the same as, or similar to, the final desired conformation of the film or article can be contacted with the cooling resin, the second polymer being non-molten and (at the instant immediately before it contacts the resin) at a temperature less than the temperature of the resin. Owing to the temperature difference between the resin and the second polymer, energy will be transferred from the resin to the second polymer, cooling the resin and heating the second polymer. If the amount of heat transferred to the second polymer is sufficient to melt at least a portion of the second polymer at the surface thereof that contacts the resin (and the temperature of the resin at least at the contact point exceeds the melting point of the second polymer), then the second polymer and the resin can be peelably adhered to one another without the need to apply additional heat energy (i.e., beyond the heat transferred from the resin to the second polymer). The degree of adherence can furthermore be enhanced if the second polymer sheet and the resin body are compressively urged against one another (e.g., such that molten second polymer flows into any high or low spots on the resin body as the film and the body are urged together).

As heat is removed (e.g., by conduction into the second polymer or by transfer to process machinery or fluids) from the resin—second polymer laminate, the temperature of molten portions of the second polymer will fall below the melting point of the second polymer, the second polymer will solidify, and the resulting film or article (having its final desired conformation) will be formed with a laminated structure, the second polymer lamina being peelably adhered to the now-solidified resin.

A similar process can be used to coat a second polymer film layer onto a pre-formed (e.g., multi-laminate) film or article.

Readily Peelable Lidstock-Liner-Substrate Configurations

Benefits (e.g., recyclability) of food trays and other containers having peelable liners are described elsewhere herein, as are those of trays and other containers which further include lidstock material attached to the uppermost liner to form a sealed compartment. It can be beneficial to make containers from which the liner and the lidstock can be removed without necessarily breaching the compartment. The ease from which the compartment can be removed intact from the container substrate can affect the desirability of the container to the user who will perform such removal. Such containers can be displayed at the point of sale of articles contained therein, in which instance the appearance of the container is also important. Described in this section is a configuration of the substrate, line(s), and lidstock that can exhibit these properties.

In this configuration, the lidstock and the liner are adhered to one another more tenaciously than the liner is adhered to the surface underlying the liner at at least one portion of the container, preferably along the perimeter of the container. Moreover, that zone of relatively tenacious binding should preferably occur along one edge of at least the liner sheet, so that the compartment formed between the liner and the lidstock can be readily peeled intact from the surface underlining the liner by grasping and peeling the lidstock. Because the lidstock is relatively tenaciously adhered to the liner at the edge of the liner, lifting the lidstock towards the liner will commence peeling of the liner from the substrate as the lidstock is lifted away from the substrate at the edge of the liner. This configuration facilitates manufacture of a container from the thermoformable stack described herein by applying lidstock thereto, such as in conventional ways.

In one configuration, a relatively thick substrate (e.g., 20-40 mil thick PET) has a single relatively thin liner (e.g., 1-6 mil thick) adhered thereto. In this embodiment, the thin liner is a homopolymer sheet, such as a polyethylene sheet, that is peelably adhered to the substrate across substantially an entire face of the substrate. The substrate and adhered liner have a shape (e.g., formed by thermoforming the stacked sheets) that includes a concave portion having a rim surrounding it, the rim preferably being substantially planar such that a flat sheet that contacts the rim about the perimeter of the concavity seals the concavity. A lidstock material (e.g., a 1-10 mil thick homopolymer or laminated polymer sheet) contacts the liner about the rim of the concavity, and is preferably taut, such that the lidstock material has a substantially planar shape within the perimeter of the concavity. The lidstock is adhered or fused to the liner at at least one portion of the rim, and is preferably adhered or fused to it around the entire perimeter of the concavity. If the liner and the face of the lidstock that contacts it are made of substantially the same material (the necessary degree of identity being understood by those skilled in the art), then the liner and lidstock can be fused by heating each above the melting temperature of the material, contacting the liner and lidstock (preferably urging them against one another, such as by forming a high-impact seal or a low-impact seal, as these terms are used in the plastic packaging arts), and then cooling the materials below the melting temperature. The liner is adhered or fused to the lidstock at at least one edge of the liner/substrate stack. The adherence or fusion is sufficiently resilient that the liner peels from the substrate when the lidstock is pulled in a direction away from the substrate. The resulting package is useful for enclosing articles (e.g., food articles or liquid-sensitive components) within the compartment formed between the lidstock and the liner while the liner is engaged with the substrate, and for peeling the compartment from the substrate (e.g., by peeling the lidstock therefrom at a position at which it is adhered or fused to the edge of the liner/substrate stack) without necessarily breaching the compartment. Optionally, the container can include a zipper-type reclosable opening disposed either in the lidstock or between the lidstock and the liner, for facilitating access to and reclosing of the compartment between the lidstock and liner.

In alternative embodiments, the container includes more than one liner, such as an embodiment in which a compartment that includes a fluid reservoir formed between a perforated and a non-perforated liner, with at least one of the liners adhered to or fused with the lidstock. By way of example, the container can have a substrate formed to include a concavity and having a non-perforated liner peelably adhered to the substrate at least at the portion thereof that defines the concavity, a perforated liner fused with (optionally adhered to) the non-perforated liner about the rim of the concavity, and a lidstock adhered to or fused with the perforated liner about the rim of the concavity, including up to an edge of the perforated liner. When the lidstock is peeled away from the substrate, at least the perforated liner (and optionally the non-perforated liner, such as if it is fused with the perforated liner) is pulled away from the concavity, taking with it any objects within the compartment between the lidstock and the perforated liner that cannot fit through the perforations. If the non-perforated liner is not simultaneously peeled from the substrate, then materials (e.g., liquid) capable of passing through the perforations can be separated from other materials in the compartment and can remain associated with the substrate (and can be subsequently dissociated from the subject by dumping or pouring, or by peeling the non-perforated liner from the substrate). If the non-perforated liner is fused with the perforated liner about the rim, for example, then peeling the lidstock away from the container without separating the lidstock and liners from one another will peel away a compartment that can contain both materials larger than the perforations and materials smaller than the perforation. Thus, for example, such a container can be used to contain a cut of meat within a concavity of the container, liquid exuded by the meat can pass into the fluid reservoir between the perforated and non-perforated liners, the meat can be removed in a sealed compartment from the substrate, and any exuded liquid can be either removed at the same time (by peeling the non-perforated liner from the substrate simultaneously with peeling the lidstock) or after the compartment has been removed (by peeling the lidstock and associated compartment first, and thereafter peeling the non-perforated liner from the substrate).

In various embodiments, one or more of the liners and the lidstock can be multi-laminate polymer sheets, such as sheets having various polymer laminae that confer barrier properties, tensile strength, adherability, ability to fuse with opposed polymer faces, ability to link adjacent laminae, or other properties. The liners and lidstock can also be homopolymer sheets.

The substrate can have multiple concavities, and each concavity therein can be covered with the same liner sheet(s) or different liners. Some or all of the concavities can have a single piece of lidstock applied thereto. Similarly, multiple pieces of lidstock (composed of the same material or different materials) can be fixed around or across a single concavity (e.g., two pieces of closely-spaced lidstock having parallel edges can be fixed across a concavity to yield a compartment that is closed other than at a slit defined by the edges of the lidstock pieces. For ease of manufacture, filling, and assembly, it is preferred to manufacture containers in two pieces: a first piece including the substrate and all liners peelably bound thereto (with the shape, including any concavities, preferably formed by thermoforming a substrate-liner(s) stack) and a second piece including the lidstock; thereafter to fill the containers with desired items (e.g., electronic component parts or poultry parts within concavities); and thereafter to seal the lidstock to the shaped and filled liner-substrate piece. The first piece can include multiple separable containers, each having a concavity and being separable by cutting or tearing the first piece after the lidstock has been sealed thereto.

Containers of the type described in this section can be particularly beneficial if they are formed and shaped in a manner that facilitates peeling of at least one liner from the substrate upon peeling of the lidstock from the substrate. This can be achieved by adhesing or fusing the liner and the lidstock at an edge of the liner, so that peeling the lidstock past the adhesed/fused edge initiates peeling of the liner from the surface underlying it (i.e., from the substrate or from another liner interposed between the substrate and the liner adhesed/fused to the lidstock). Such adhesion/fusion can be accomplished by adhesing or fusing the liner and lidstock prior to adhering the liner. However, such manufacturing methods can be difficult to perform and can interfere with packaging of items between the liner and the lidstock. More typically, the substrate-adhered liner will be manufactured separately from the lidstock and the lidstock and liner are adhesed or fused after packaging an item within the compartment formed between the liner and the lidstock. Such assembly can make it difficult to adhese or fuse the edge of the liner to the lidstock without special care, such as that which is described as follows and illustrated in FIGS. 10-12.

The edge of a liner can be adhesed or fused with lidstock by bringing the edge of the liner in contact with the lidstock during the adhesion/fusion process. For ease of manufacture, for the purpose of strengthening edges, and for aesthetic reasons, thermoformed containers often have curved or bent edges. Binding lidstock to the edge of the container is typically not of particular concern in prior art containers. Instead, lidstock is usually trimmed near the edge of the container after being applied thereto, and the edge of the lidstock is sometimes heated so that it either curls around the edge of container or shrinks to more closely fit against that edge. In the configuration described in this section, it is important that the edge of a liner adhered to the substrate bind relatively tenaciously to the lidstock (relative to the tenacity with which the liner binds to the substrate), so that the liner can be peeled from the substrate upon peeling of the lidstock therefrom. In order to facilitate binding of the liner edge to the lidstock, the liner edge should be brought into close opposition to the lidstock upon binding (by adhesion, adherence, fusion, or otherwise) of the lidstock and the liner. Such close opposition can be achieved in substantially any manner known in the art.

One way in which the edge of a liner and lidstock material can be brought into close opposition during binding therebetween is by urging the lidstock and liner together in a conformation in which the edge of the liner is held against the lidstock during application of ambient conditions (e.g., temperature, irradiation, pressure, or provision of an adhesive) that cause binding of the lidstock and portions of the liner which contact it. By way of example, a liner having a lidstock-binding face composed of the same material as the liner-binding face of a lidstock material can be caused to bind with the lidstock material by contacting the two faces at a temperature at or greater than the melting temperature of the common material.

When the location is known at which peeling force applied to a lidstock material will be transmitted to a liner bound to the lidstock, close opposition of the lidstock and liner can be preferentially maintained at that location during liner-lidstock binding. Similarly, the location at which such close opposition is maintained during liner-lidstock binding can be indicated on the finished container, so that the location can be selected by a user of the container as an appropriate location for peeling.

Figure 10B:
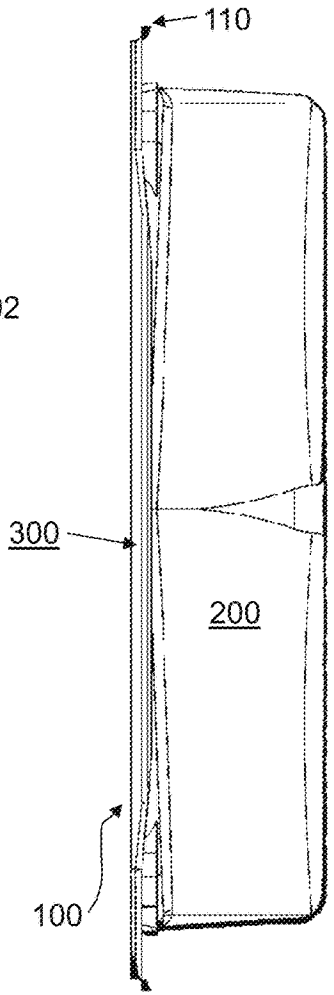
FIG. 10B is a side view of the same tray.
Figure 10A:
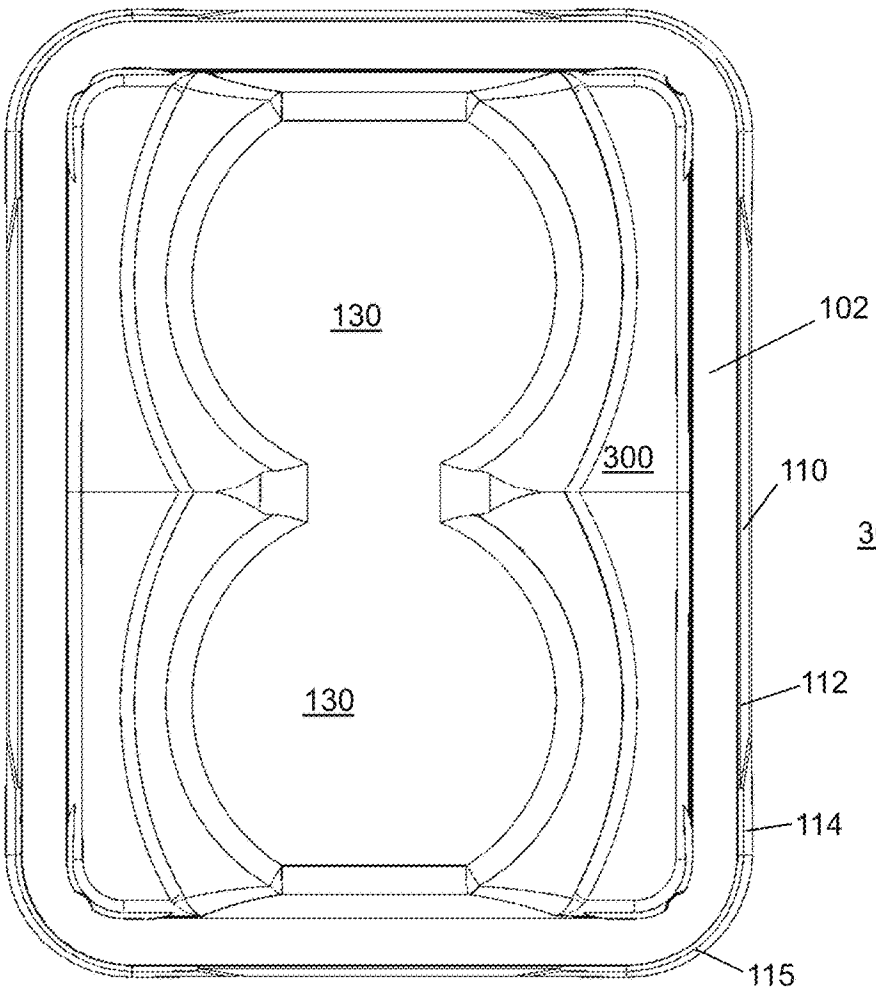
FIG. 10A is a top view of a four-patty tray described herein.
Figure 11A:
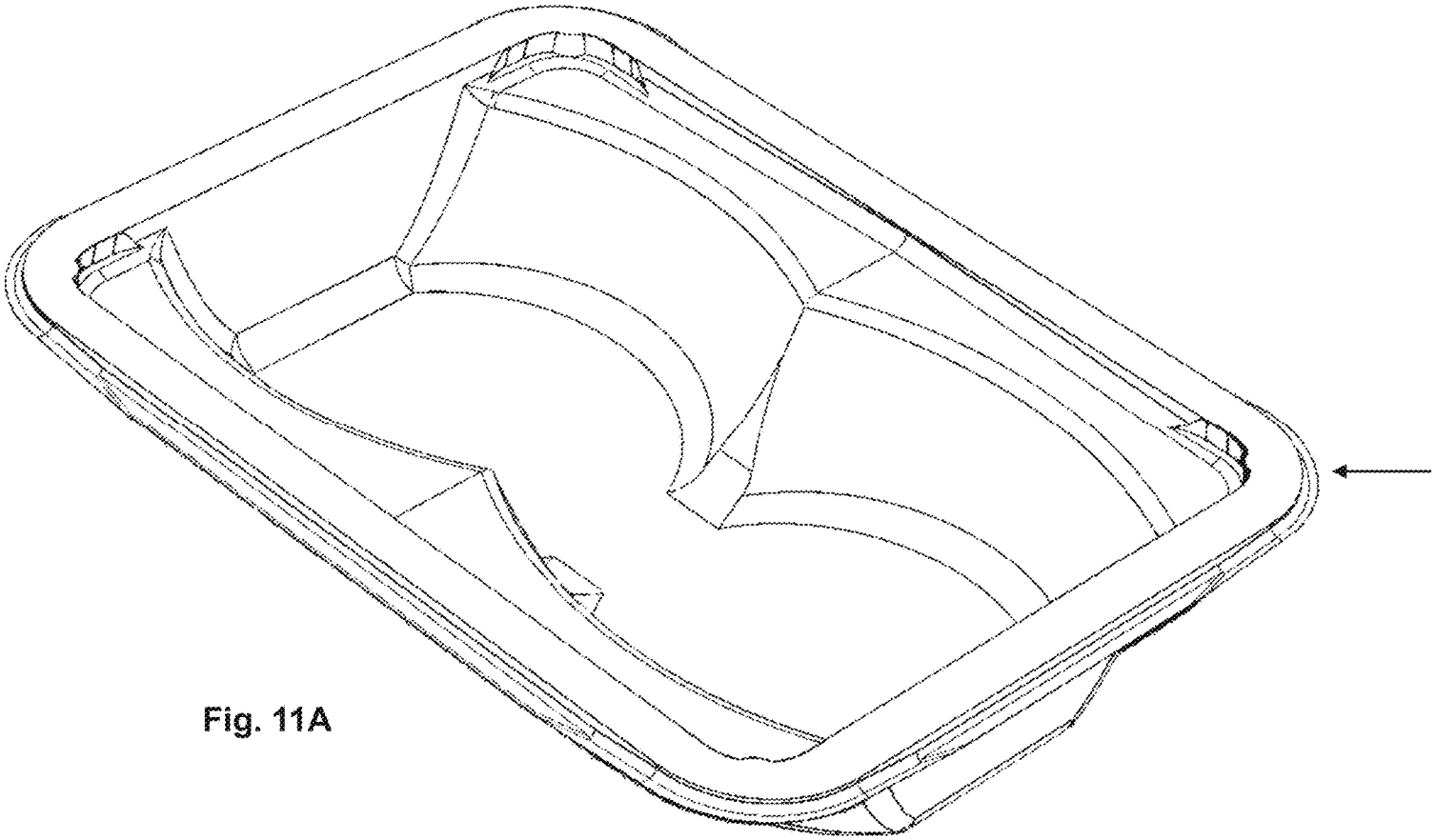
FIG. 11A is an isometric view of the four-patty tray shown in FIG. 10 and described herein.
Figure 11B:
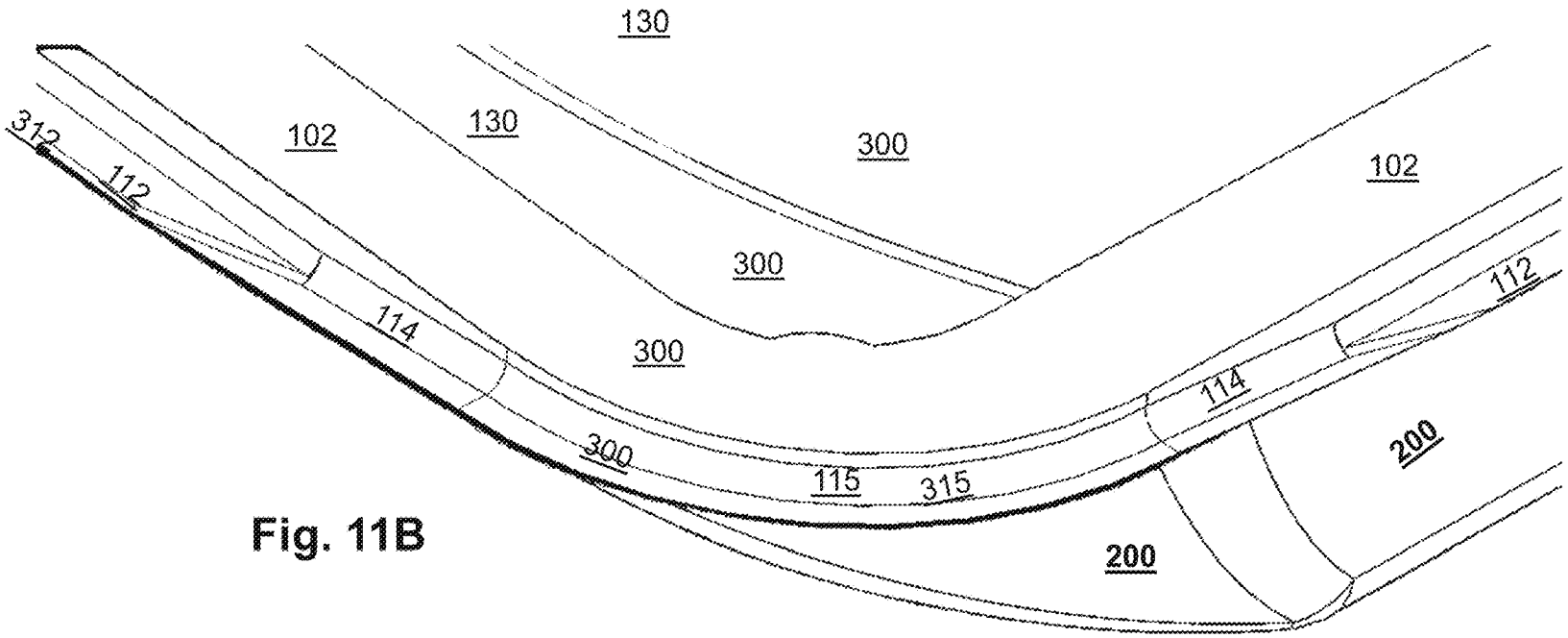
FIG. 11B is a detailed view of the corner of the tray nearest the point of view in FIG. 11A.
Figure 12:
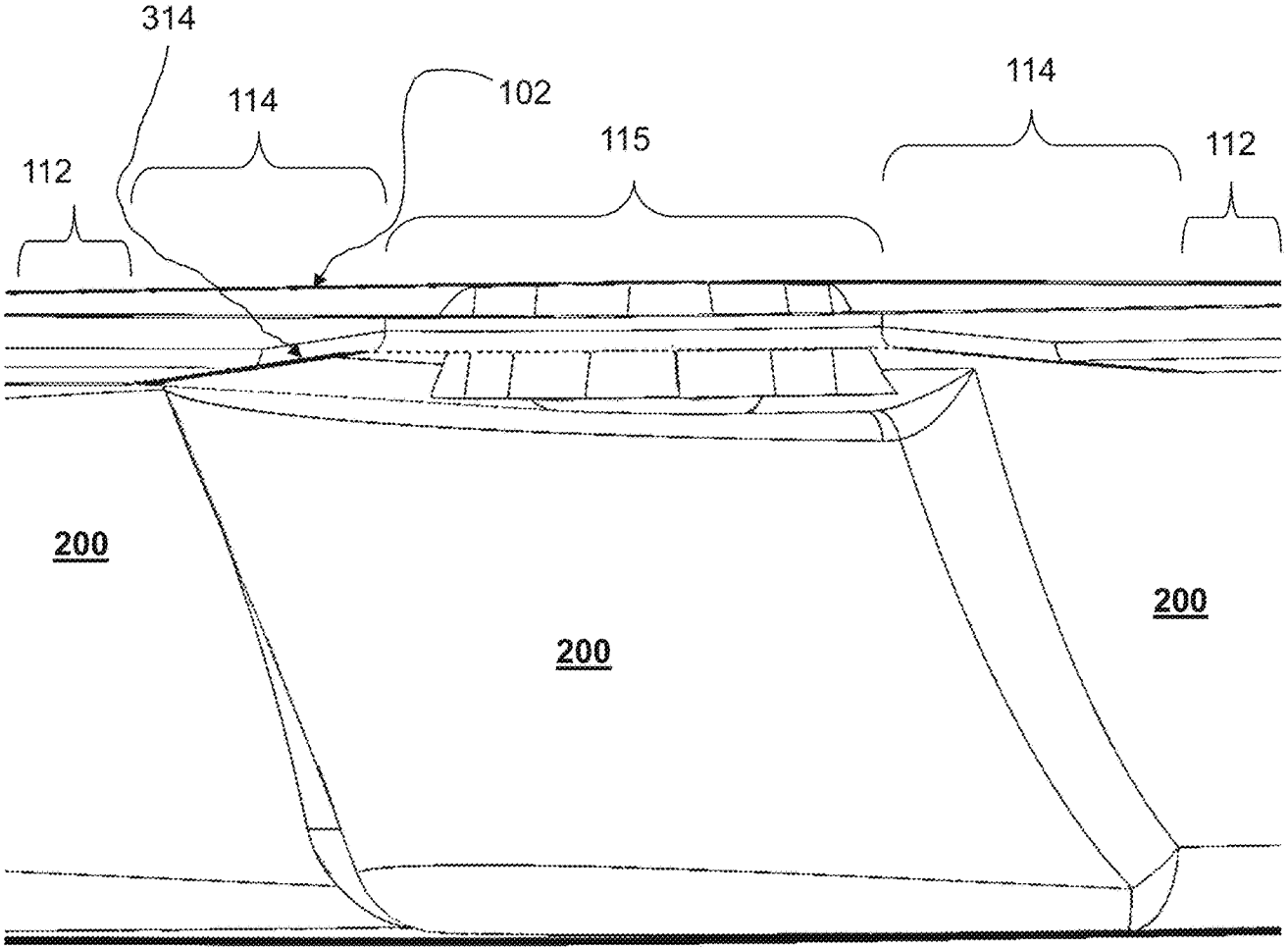
FIG. 12 is a detail view of a corner of the four-patty tray shown in FIG. 10, as viewed from perspective indicated by the arrow in FIG. 11A. A dotted line indicates the position of the peripheral edge of the corner of the tray. Displaced regions along the tray periphery are indicated by 112; the corner region of the tray periphery is indicated by 115; intermediate regions of the tray periphery are indicated by 114.

The configuration described in this section can be better understood by reference to FIGS. 10-12, which illustrate a specific embodiment of the container having that configuration. Of course, this embodiment is but one example of a wide variety of containers for containing foodstuffs, prepared foods, moisture-sensitive components, and other articles, and the disclosure is not limited to any particular shape or conformation of such containers.

In the embodiment shown in FIGS. 10-12, the container has the general shape of a food container commonly referred to as a "four-patty tray" on account of its common use to contain four ground meat patties. In use, the container often bears two pairs of patties, one pair within each of the two generally round portions of the main central concavity of the substrate tray. The patty-bearing container can be wrapped in a material, such as a clear plastic film in order to retain the patties within the concavity, exclude materials from the interior of the concavity, retain fluids (e.g., gases or liquid exuded from the patties) within the container, or some combination of these. The wrap can be sealed, to itself, to the tray, or to both in order to render the container substantially impervious to flow of one or more fluids, such as liquids, certain gases, or substantially all atmospheric gases. Rather than being wrapped, the container can be closed, sealed, or both by securing a material, such as a clear plastic film, across the opening of some or (preferably) all of the concavity. By way of example, a film can be fused with the surface layer of the tray along the entire perimeter of the concavity. Such uses of four-patty trays and similar containers were known prior to this disclosure.

As disclosed herein, a tray such as that shown in FIGS. 10-12 can be thermoformed from a stack consisting of a relatively thick polymeric substrate sheet having stacked thereon a relatively thin liner sheet. The liner is preferably adhered or adhesed onto the substrate sheet, such that the liner is peelably disengagable from the substrate. In the context of the four-patty tray shown in FIGS. 10-12, the liner inhibits or (preferably) prevents transfer of liquids, particles of ground meat, microbiological contamination, and other items between the substrate and one or more articles within the concavity by acting as a barrier to such transfer. When used for containing raw meat patties, for example, the liner can prevent transfer from the meat to the substrate of compounds which can decompose and cause odors. Thus, after removing the meat from the concavity, the liner can be peeled from the substrate, yielding a clean, potentially recyclable or reusable tray-shaped substrate and a soiled liner that can be discarded (or recycled, such as after washing).

Not shown in FIGS. 10-12 is a clear plastic lidstock film material which is commonly applied across, for example, food-containing concavities in food storage containers. However, it can be seen in FIGS. 10-12 that the tray illustrated therein is adapted to receive such film. For example, the container 100 shown in the figures has a generally rectangular overall shape, with rounded corners. The container is formed from a substrate 200 having a liner 300 adhered or adhesed to the entirety of a face thereof. The container is shaped such that the substrate 200, and preferably the liner 300, bears a concavity 130, with the interior portion of the concavity 130 being lined with the liner 300. As can be seen in FIG. 10A, the container 100 has a package seal seat 102 that completely surrounds the concavity 130. In the tray shown in FIGS. 10-12, the package seal seat 102 is in the form of a rectangular band having rounded corners and extends about the container 100 near the periphery thereof. In this embodiment, the package seal seat 102 is completely covered by the liner 300 on the side of the container 100 to which a lidstock material will be bound. The width of the package seal seat 102 is, in this embodiment, sufficient to accommodate a "low impact seal" of the type known generally in the art as such (i.e., a relatively broad seal formed by compression of the liner 300 and a lidstock material face made of the same material as the liner 300 against one another at a temperature at or above the melting point of the common material). The width of the package seal seat 102 is, in this embodiment, also sufficient to accommodate a "high impact seal" of the type known generally in the art as such (i.e., a relatively narrow seal generally made by rapid compression, such as with a hammer-and-anvil-type arrangement, of lidstock and liner materials).

Surrounding the package seal seat 102 in this embodiment is a tack seal seat 110 that extends around the periphery of the package (although it need not do so in all embodiments). Tack seals are commonly used in packaging involving lidstock seals to cause the edges of the lidstock material to more closely conform to the edges and shape of the container at the sealed face. In prior art containers, continuity of the tack seal about the concavity is generally not considered critical, because tack seals tend to serve more cosmetic purposes (e.g., improving the appearance of the sealed face of the package) than functional purposes (e.g., sealing the package). In the embodiment of the container described in this section of the disclosure, however, the tack seal seat 110 and its conformation have greater significance.

The degree to which a lidstock material binds with an underlying material to which it is adhered, adhesed, or fused can be significantly impacted by the extent, continuity, and magnitude of compressive forces brought to bear upon the lidstock and the underlying material. In the embodiment of the container described in this section of the disclosure, relatively tenacious binding between the lidstock and the edge of the liner 300 that is peelably engaged with the substrate 200 is needed. Such relatively tenacious binding is particularly important at portions 315 of the container 100 at which peeling of the lidstock therefrom is expected to occur, such as at and near the corners of the container 100 illustrated in FIGS. 10-12. At portions 312 of the container (e.g., portion 112 of the container 100 illustrated in FIGS. 10-12) at which peeling of the lidstock is unlikely to be initiated, it is less critical that the edge of the liner 300 be tenaciously bound with the lidstock. Thus, there are effectively two seals of importance in the container 100 illustrated in FIGS. 10-12: a first seal between the liner 300 and the lidstock that forms a (preferably completely sealed) compartment with a portion of the liner 300 that covers all or a portion of the concavity 130 and a second seal between the edge of the liner 300 and the lidstock at at least one position. The function of the second seal is to facilitate peeling of the liner 300 and the lidstock (together) from the substrate 200 when the lidstock is peeled from the substrate 200 at the position at which the edge of the liner 300 and the lidstock are relatively tenaciously bound. So long as the relative tenacity of that bond exceeds the tenacity of the bond between the liner 300 and the substrate 200 at that same position, peeling of the lidstock can be expected to induce peeling of the liner 300 away from the substrate 200.

In order to facilitate relatively tenacious binding between the edge of the liner 300 and the lidstock, the liner 300 and lidstock should be subjected to compression at that edge at the time they are bonded to one another. The container shown in FIGS. 10-12 facilitates such compression at positions at which lidstock peeling by a user can be anticipated. As illustrated in FIG. 10A, the container 100 has a tack seal seat 110 that extends around the perimeter of the container at the outer periphery thereof. At raised portions 115 of the tack seal, which are positioned at each of the four corners of the container 100, the tack seal seat 110 is relatively close to the level of the package seal seat 102. The lidstock can be simultaneously sealed to the liner 300 at the package seal seat 102 and at the raised portion 115 of the tack seal. Alternatively, the lidstock can be sealed to the liner 300 of the container only at the package seal seat 102 and later, portions 315 of the liner 300 can be tenaciously bound at the raised portion 115 of the tack seal set, such as by a die or press that urges together the liner 300 and the lidstock at at least one (and preferably all) of the raised portions 115.

It is relatively immaterial whether the edge of the liner 300 is bound in a relatively difficult-to-separate manner to the lidstock at positions at which it is unlikely that peeling of the lidstock from the container 100 will be initiated, such as at portions 312 of the liner 300 that are positioned within a depressed portion 112 of the tack seal seat (i.e., a portion of the tack seal seat 110 situated at a greater distance from the package seal seat 102 than the raised portions 115) and portions 314 of the liner 300 that are positioned within an intermediate portion 114 of the tack seal seat (i.e., a portion situated intermediately between a depressed portion 112 and a raised portion 115). The lidstock can, for example, be not attached to the liner 300 at a portion 312 at or near its edge (although it should be attached to the liner at some point, such as at the package seal seat 102 in order to form a closed and/or sealed compartment) throughout the depressed portion 112 of the container 100 shown in FIG. 10A and can be weakly or intermittently attached to the liner 300 at a portion 314 thereof, such as the part of the liner 300 situated in the intermediate portion 114 of the tack seal seat. So long as the lidstock is peeled from the container 100 within the raised portion 115, the liner 300 will be bound to the lidstock and should be peelable from the substrate 200.

If the container 100 having the lidstock bound thereto includes a portion (e.g., at depressed portion 112) at which the liner 300 and lidstock are not tenaciously bound and the liner 300 and lidstock are peelably bound to one another, then the container may be disassembled and opened in at least two ways:

i) the lidstock can be peeled from the substrate 200 at a position at which the liner 300 is relatively tenaciously bound to the lidstock to displace the liner 300 and lidstock from the substrate 200 without opening the compartment defined by the liner 300 and the lidstock; and the compartment can thereafter be opened by peeling the liner 300 from the lidstock beginning at a position at which the edge of the liner 300 is not tenaciously bound to the lidstock.

ii) the lidstock can be peeled away from the liner 300 beginning at a position at which the edge of the liner 300 is not tenaciously bound to the lidstock (and preferably holding the liner 300 against the substrate 200, for example using a fingernail) to open the compartment and optionally remove contents; and the liner 300 can thereafter be peeled away from the substrate 200, such as by grasping a portion of the lidstock at a position near or at which it is tenaciously bound to the liner 300 and peeling the lidstock (with liner 300 attached) away from the substrate 200.

The precise shape and size of the lidstock bound to the liner 300 of the container 100 shown in FIGS. 10-12 is not critical. It can, for example, be a rectangular piece of substantially transparent (with or without opaque printing or labeling thereon) plastic that has substantially the same dimensions as the longer and shorter axes of the tray. Attachment of such a piece of lidstock to the container 100 will result in an overhanging piece of lidstock at each of the corners (i.e., because the corners of the substrate 200 are rounded). Such an overhanging piece of lidstock can be grasped by a user and pulled upon in order to peel the lidstock from the container 100. For such containers, at least one, and preferably all, of the overhanging pieces of lidstock is relatively tenaciously (relative to the amount of force needed to peel the liner 300 and the substrate 200 from one another at the same position) bound to the liner 300, so that a user can use the overhanging lidstock as a tab for removing the liner 300 from the substrate 200.

The lidstock should have dimensions sufficient to provide a seal for the concavity 130, such as at the package seal seat 102, at least to the desired extent of sealing (e.g., it may be desirable to leave a small gap to permit liquid egress from the package in its sealed condition. It is immaterial whether the lidstock overhangs the edge of the container 100 (and the edge of the liner 300) at more than one position. In fact, the lidstock can be bonded flush against the edge of the liner at all positions, but that can complicate peeling of the lidstock from the container 100, since a user would have to peel the liner 300 from the substrate 200 without the aid of an overhanging piece of lidstock. Nonetheless, peeling of the liner-lidstock compartment from such containers can be initiated by, for example, rubbing a finger along the edge of the container or by using a knife or fork to initiate the peeling by scraping the edge.

Lidstock that extends beyond the package seal or beyond the periphery of the tray can be unsightly. Such unsightliness can be reduced by trimming the overhanging lidstock, by tack-sealing the lidstock to the tack seal seat, or by some combination of these.

A skilled artisan appreciates that the configurations, materials, and methods described in this section are not limited to four-patty trays, but are broadly applicable to a wide variety of sealed containers that include a shaped substrate having a lidstock that forms a compartment therewith.

Barrier Compositions

The identity and composition of barrier compositions that can be interposed between polymer sheets used in the articles and methods as described herein are not critical. A skilled artisan will recognize that substantially any material can be used as a barrier composition between two polymers, so long as it substantially prevents fusion of two polymers under conditions at which at least one of the polymers can be thermoformed. A wide variety of such compositions are known for this purpose. Barrier compositions used to make shaped articles for food uses should, of course, be selected for compatibility with foodstuffs.

Examples of suitable barrier compositions include adhesives (e.g., peelable adhesives such as pressure-sensitive adhesives), known polymer release agents, a polymeric or paper film interposed between polymer layers, and various liquids, including low-viscosity silicone oils.

A composition interposed between two surfaces (e.g., between the first and second polymer sheets, or between two second polymer sheets, as described herein) can act as a barrier composition between the two surfaces if the composition coats at least one of the two surfaces at a thermoforming condition, thereby preventing surface-to-surface contact and fusion of the two surfaces at the thermoforming condition.

A barrier composition prevents fusion of opposed polymeric surfaces only when it is interposed between the surfaces at the thermoforming condition. For that reason, the barrier composition must be interposed between the surfaces over the entire area for which fusion between the surfaces is not desired. This can be achieved in various ways, including use of liquid and solid barrier compositions. When a stack is to be thermoformed to make a plurality of shaped objects that are not fused over some portions, but fused at at least one portion (e.g., a stack of meat trays fused only at a single, frangible extension of the trays at one corner), the barrier composition is interposed among the polymer sheets in the non-fused areas, but is not interposed between the polymer sheets in the area in which fusion is desired.

Liquid barrier compositions should be selected such that they completely coat (i.e., wet) at least one of the surfaces over the entire area for which fusion is not desired. This can be achieved by selecting a liquid barrier composition (i.e., a composition that is a liquid at at least the thermoforming condition, regardless of whether it is a liquid at which it is contacted with the surface) that has a surface tension significantly greater (i.e., at least 2 Dynes per centimeter, and preferably at least 10 Dynes per centimeter greater) than the surface energy of the surface with which it is contacted. This surface energy difference should ensure that the liquid barrier composition completely wets (i.e., coats) the area of the surface for which fusion is not desired. Preferably, the liquid barrier composition has a surface tension significantly greater than the surface energy of both surfaces, so that the liquid is not displaced from between the surfaces at points at which the two surfaces are urged tightly against one another.

Solid barrier compositions (e.g., polymer sheets) should be selected so that the solid covers the entire area for which fusion is not desired. The identity of the solid is not critical, so long as it does not prevent the portions of a polymer sheet that are to be thermoformed from reaching the thermoforming condition. Solid barrier compositions can prevent fusion of the surfaces (and/or) fail to fuse to one or both surfaces for a variety of reasons, any of which are sufficient to render a material suitable as a solid barrier composition. Some solids can be predicted to act as suitable barrier compositions, while other may require empirical testing (e.g., thermoforming two sheets of the polymer with the solid interposed between them) in order to determine their suitability. Either way, selection of an appropriate solid barrier composition is within the ken of a skilled artisan in this field.

Another type of barrier composition that can be used is a composition incorporated as an additive into one or both of the polymer sheets. These compositions melt and "bloom" to the surface of a polymer when heated, pressed, stretched, or otherwise manipulated. If such a composition is included in one or both of the polymer sheets such that the composition blooms at the surface of at least one sheet at the thermoforming condition and prevents contact between the polymer sheets themselves, then the composition can be used as a barrier composition in the articles and methods described herein. A wide variety of compositions that exhibit such blooming behavior are known in the art.

Adhesives

The identity and composition of adhesive that can be interposed between polymer sheets used in the articles and methods as described herein are not critical. A skilled artisan will recognize that substantially any material can be used as an adhesive between two polymers, so long as it reversibly binds the two polymer layers and requires no more force to separate the polymer layers than can be practically applied to the polymer layers by a person of ordinary strength. A wide variety of such compositions are known for this purpose. For food-contacting articles described herein, any adhesive employed should be selected for compatibility with foodstuffs.

When an adhesive is used between two polymer sheets, it can be used to coat substantially the entire interfacial region between the two sheets (to "flood coat" them). Adhesive can be excluded from a portion of the interfacial region, to permit fusion (if no other barrier composition is present) or to leave a non-adhered portion to facilitate peeling.

The adhesives used between a peelable polymer sheet and an underlying surface are preferably peelable, meaning that the polymer sheet can be peeled from the surface by a person of ordinary strength, preferably without tearing or substantially stretching the sheet. Preferably, an adhesive having a coat weight of roughly 0.6 to 15 ounces per inch is used to adhere a peelable sheet to an underlying surface.

A wide variety of suitable adhesives are known in the art and can be used as described herein. Pressure-sensitive adhesives are among the suitable adhesives that can be used. Likewise, adhesives that adhere preferentially to one of two adhered surfaces, upon peeling of one of the surfaces away from the other) are suitable and are preferred in certain embodiments. By way of example, if an adhesive adheres more strongly to a peelable polymer sheet than to a surface to which the sheet is adhered by the adhesive, the adhesive will tend to remain with the sheet when it is peeled from the surface.

Various compounds and surface treatments can be used to reduce the force needed to pull an adhesive from a surface, and such compounds and treatments can be used to modulate adhesion of an adhesive to a surface described herein.

Specific examples of adhesives that can be used in the articles described herein include polysiloxane-based adhesives, rubber cement, and acrylic adhesives (e.g., waterborne pressure-sensitive, acrylic adhesives of the MULTI-LOK brand family of acrylic adhesives manufactured by National Adhesives of Bridgewater, N.J.).

Thermoforming Apparatus and Conditions

The articles described herein can be made using known thermoforming apparatus and conditions. Of course, the apparatus and conditions should be selected based on the identity and the characteristics of the materials to be processed. Selection of appropriate thermoforming conditions, based on the identity(ies) of the materials to be processed is within the ken of a skilled artisan in this field.

Printing

Text, images, or other graphical material can be printed onto one or more faces of one or more of the polymer sheets described herein. A wide variety of materials and methods can be used to print such material onto the surface of a polymer sheet. A difficulty inherent in printing on polymer materials is that the printed matter can often easily be displaced from the polymer surface by heat, light, or mechanical abrasion, leading to reduced print quality. Furthermore, it can be undesirable for the materials used for printing to contact materials within the compartment.

The tenacity of binding of printed matter to a polymer sheet can, as described herein for adhesives, be affected by surface treatment of the polymer sheet prior to printing upon it. Corona treatment and plasma discharge techniques, for example, can raise the surface energy of a polymer surface, rendering it susceptible to more tenacious binding by the printed matter. Likewise, surface treatment (e.g., Corona treatment) of a polymer surface having printed matter thereon can raise the surface energy of the surface (including the portion on which the printed matter appears). It can be preferably to enhance or reduce the surface energy of the surface of one of two polymer sheets that are adhered or adhesed in an article described herein, so that when the two sheets are separated from one another, most or all of the printed matter at the interface of the two sheets will remain attached to one of the two sheets.

Inks, binders, materials used to prepare a surface to receive printing, and products formed by surface preparation can include products which are undesirable in food products. Thus, when articles described herein are to be used both to carry printing and to contain or contact food products, care should be taken either to select printing and surface preparation materials appropriate for use for food containers (i.e., safe for consumption or insoluble in food) or to create a barrier between food and any such materials (i.e., to prevent their migration into food).

By way of example, in a food container consisting of a thick thermoformable substrate having a thin, pliable liner sheet peelably adhered thereto, substantially any material that does not migrate under ordinary food packing and storage conditions through the liner sheet can be used for printing upon the substrate or for preparing the surface of the substrate for printing. At least in portions of the container in which the liner is interposed between the substrate and food stored in the container, the presence of the liner will inhibit or prevent substantial migration of such components from the surface of the substrate into the food. Thus, even an ink which is inappropriate for inclusion in a food and which would normally dissolve in the food can be used to print upon the substrate of the food container, so long as a liner sheet through which the ink cannot migrate under ordinary conditions is interposed between the food in the container and the surface to which the ink is applied (regardless of whether other materials are interposed between the ink and the food). If the characters or images printed on the substrate are to be viewed through the liner, then the liner should be sufficiently transparent or translucent that such viewing is possible.

One embodiment (referred to as "two-side printed containers") of a food container described herein is a generally planar tray or dish that bears printing that is visible from both faces of the container and is suitable for containing a food even if a material used in the printing process is unsuitable for contacting with the food. This embodiment includes both a substrate sheet (e.g., a relatively thick thermoformable material such as virgin PET or RPET) and a relatively thin liner sheet (e.g., a clear monolithic PE sheet or a clear or translucent multi-layer sheet in which a layer of EVOH is sandwiched between PE layers). Interposed between the substrate sheet and the liner sheet is a generally opaque printed sheet that bears characters, diagrams, images, or other visual indicia on one or both faces thereof.

In two-side printed containers, the identity of the printed sheet is not critical, other than that it should be fixably emplaceable between the liner and substrate sheets (i.e., fusible with, adherable to, or adhesible to both the substrate sheet and the liner sheet or sufficiently perforated that binding between the substrate and liner sheets is sufficient to hold the printed sheet in place without compromising the structural integrity of the finished container). In its assembled state, a two-side printed container has the liner sheet on its food-bearing face(s), the liner sheet overlying the printed sheet (such that indicia on the printed sheet are preferably visible through the liner sheet), and the printed sheet overlying the substrate sheet (such that indicia on the printed sheet are preferably visible through the substrate). In this assembled state, the substrate can provide bulk physical properties (e.g., rigidity and shape), the printed sheet can provide a desired visual appearance, and the liner sheet can prevent transfer of any undesirable materials present on or in the printed sheet or substrate sheet into the food that contacts the liner on the face of the liner opposite the face opposed against the printed sheet and substrate sheet.

As with other lined containers described herein, two-side printed containers can be combined with a lidstock material that closes one or more orifices of or spaces in the container. The lidstock can be peelably adhered or adhesed to one or more portions of the container, fused with one or more portions of the container, or a combination of these. For food storage applications, a food-compatible lidstock is preferably sealed about the perimeter of an area or cavity defined by a food-compatible liner material, which can be peelably or tenaciously attached to a substrate material. By way of example, a lidstock material having a face made from the same material (e.g., ULDPE) as the face of a liner sheet can be fused with the liner sheet when the two faces are opposed against one another at a temperature sufficient to melt the material. The lidstock can have printed matter thereon, the printing occurring before application of the lidstock to the container (e.g., application of a pre-printed package design), after such application and sealing of the container (e.g., application of a "packed on" or "use by" date), or a combination of these. Decals, stickers, price tags, paper sleeves, and other known product package components can also be added during or after packaging.

In a specialized embodiment of two-side printed containers, each of the liner sheet and the substrate sheet is substantially clear and the printed sheet is both substantially opaque and printed on both faces thereof. In addition, one face of the printed sheet has a material on its surface that bonds to the liner sheet more tenaciously than the printed sheet binds to the substrate in the finished container (i.e., so that the liner and printed sheets can be peeled together from the substrate sheet). By way of example, the face of the printed sheet opposed against a liner sheet can be made of the same material as the opposed face of the liner sheet (e.g., each face can be the same PE), such that the two sheets fuse upon thermoforming or upon passage through a hot-nip roller that transmits sufficient heat to melt the opposed faces. Alternatively, a unitary container can be made by thermoforming a liner sheet, a printed sheet, and a substrate sheet wherein the opposed faces of the liner and printed sheets are made from the same material and the opposed faces of the printed and substrate sheets are also made from the same material (not necessarily the same as the opposed faces of the liner and printed sheet faces), such that when the three sheets are thermoformed, the liner sheet fuses with the printed sheet, the printed sheet fuses with the substrate sheet, and a unitary container results.

In two-side printed containers, printing on the face of the printed sheet facing the liner sheet can include, for example, recycling instructions, instructions for removing the printed and liner sheets from the substrate sheet, instructions or a diagram for positioning food to be contained on the container prior to sealing, recipes or cooking instructions for the food to be contained, and the like. Printing of the face of the printed sheet facing the substrate sheet can include, for example, nutritional information, contact information for the food manufacturer or packager, recipes or cooking instructions for the food to be contained, instructions for disassembling the container and recycling one or more parts thereof, trade marks or trade dress material, and design or graphical materials.

Meat Trays and Other Shaped Articles

In one embodiment, the subject matter disclosed herein includes a meat tray including at least a substrate sheet and a liner sheet that are simultaneously thermoformed to form the tray. As used herein, the term "thermoformed" is intended to encompass various methods of shaping a thermoplastic sheet or stacked sheets by heating the sheet and applying a pressure differential to the opposed side of the sheet to conform the sheet to the shape of a mold surface.

While the subject matter of this disclosure is occasionally described in terms of the preferred embodiment of simultaneously thermoforming substrate and liner sheets, it will be understood after reading the disclosure that the subject matter also includes simultaneously forming a substrate and a single liner sheet, and shaping the liner sheets and substrate by other means, e.g., by stamping, injection molding or blow molding. The substrate sheet, while preferably a thermoformable plastic, may also be of other materials, e.g., metals.

In one example of thermoforming known as vacuum molding, a sheet is positioned adjacent a female (or, less commonly, male) mold section and a vacuum is applied to draw the sheet against the mold surface. A male mold section may be pressed against the sheet on the opposite side of the sheet from the female mold section to assist in conforming the sheet to the shape of the female mold section. However, when a male mold is used to assist in forming shaped articles described herein, care must be taken that the male mold does not prevent separation between the substrate and liner sheets and consequent reservoir formation.

In a preferred embodiment of the subject matter disclosed herein, a stack comprising a planar sheet of thin (e.g., 1-7 mil) plastic ("liner sheet") is positioned on a surface of a planar substrate sheet of a greater thickness (e.g., 10-40 mils) to be formed into a meat tray. An additional liner/substrate sheet stack may be layered atop the first stack if a barrier composition is interposed between the stack to prevent their fusion.

The sheets can be provided in either sheet form or roll form. For convenience in shipping, storage, and thermoforming, the stacked sheets may be provided to the thermoformer in a continuous roll form, with a barrier composition interposed between the layers of the roll. The roll can be continuously fed through the thermoformer, with each length of tray sheet being indexed, then thermoformed into a shape, i.e., a meat tray. The roll length and width can be as desired. For example, the master pad roll can be 5" to 60" in width.

The stack of sheets is thermoformed as a unit into the shape of the desired article, e.g., a meat tray having the liner sheet on the concave interior of the meat tray. Upon cooling, the tray maintains its thermoformed configuration due to the thickness and rigidity of the substrate sheet; the configuration of the liner sheets can be set by thermoforming or assisted by the presence of an inter-sheet adhesive.

The meat tray is used like a traditional one would use an ordinary meat tray that does not have a liner. However, unlike prior art meat trays described above, there is no need to place a 'diaper' or other absorbent liner into the tray or attempt. After use, the upper liner sheet can be simply peeled away to release exudate sequestered within the reservoir(s) between the substrate and liner sheets or between adhered multiple liner sheets.

The mold, and thereby the thermoformed tray system, can be of various shapes. Generally, the resultant tray will have an open-top interior cavity with a floor and continuous side walls. The shaped article may include ridged, flat, or other shaped portions, as with traditional meat trays and other food containers. The shaped article may also have separate sections for containing discrete food portions section, and each compartment may have one or more reservoirs that communicate with the interior of the compartment or with reservoirs of other compartments, as desired.

Use of the Container

The container described herein can be used to isolate articles contained within the compartment. An important intended use of containers described herein (especially layered reservoir containers) is to contain food products, such as cuts of meat, poultry, or seafood, that have a tendency to release liquid (to "weep," the liquid sometimes being referred to as "purge") or otherwise soil their containers, such that the soiled container is ordinarily rendered unsuitable for recycling.

Containers for weeping food products frequently contain an absorbent material for absorbing the purge. Even when an absorbent material is present, the container can become soiled and contaminated to a degree that consumers do not wish to recycle it, and many municipalities prohibit inclusion of such items in recycling streams. Even if the absorbent material is not attached to the container, the foulness of the absorbent material can lead consumers to discard the entire container, rather than attempting to sort and clean its various parts, particularly in view of the messiness that such cleaning entails. Food packaging wastes constitute a substantial portion of current solid waste streams sent to landfills.

Weeping food products contained within the containers described herein weep just as in previously known containers. However, once the food product is removed from them, the lidding and liner can be peeled from the substrate and discarded, yielding a substantially clean substrate that is suitable for inclusion in recycling streams. By recycling the substrate and discarding only the relatively thin liner and lidding layers, the volume and weight of materials sent to landfills can be substantially reduced. Furthermore, consumers increasingly seek products having a minimum of non-recyclable packaging.

The food container described herein is typically used by pre-forming substrates having the liner sheet peelably adhered to a face thereof. Preferably the substrate has a conformation that includes a concave portion (e.g., a bowl, or a high-walled tray) for containing a food item. The liner covers the concave portion. After the food item is placed onto or within the substrate, a lidding material is attached to the liner material to form a closed compartment (e.g., by bonding or fusing the lidding and liner around the edges of the bowl or walls of the substrate) that encloses the food item.

A variety of liner and lidding items have been used in prototype containers having a substrate formed from amorphous PET or PETG. Suitable materials that have been identified include at least the following laminated polymer sheets:

a multi-layer sheet consisting of LLDPE—tie layer—EVOH—tie layer—LLDPE;

a multi-layer sheet consisting of (a mixture of ULDPE and LLDPE)—tie layer—EVOH—tie layer—LLDPE;

a multi-layer sheet consisting of LLDPE—tie layer—EVOH—tie layer—PETG;

a multi-layer sheet consisting of (a mixture of ULDPE and LLDPE)—tie layer—EVOH—tie layer—PETG; and ICE (TM; Bemis Europe, Soignies Belgium) brand high performance barrier film.

Descriptions of Embodiments Illustrated in the Drawings

In this disclosure, terms such as horizontal, upright, vertical, above, below, beneath, and the like, are used solely for the purpose of clarity in illustrating the subject matter disclosed herein, and should not be taken as words of limitation. The drawings are for the purpose of illustrating the subject matter disclosed herein and are not intended to be to scale.

FIG. 1 is an image of a tray-shaped article having an X-shaped reservoir portion disposed on a flat bottom portion. The bottom portion is surrounded by four substantially flat side walls arranged in a rectangular configuration having rounded corners, forming an interior portion. A flat flange portion surrounds the side walls. The distal (i.e., farthest from the flat bottom portion) portion of the interior portion is slightly larger than the proximal portion because the side walls are slanted, forming an obtuse angle with the bottom portion when viewed in cross section. Two transition regions border the bottom portion at the intersection of the bottom portion and the side walls. The lower (closer to the bottom portion) transition region includes a substantially planar 'shelf' region that is substantially parallel to the plane of the bottom portion.

The lower transition region includes a rounded bottom edge (when viewed in cross-section) where it meets the bottom portion and a substantially squared edge (when viewed in cross-section) where the shelf region intersects the portion that meets the bottom portion. The upper transition region includes a rounded bottom edge (when viewed in cross-section) where it meets the shelf region of the lower transition region, a substantially planar 'shelf' region that is substantially parallel to the plane of the bottom portion, and an angled edge (when viewed in cross-section) where the shelf region of the upper transition region intersects the side walls. The X-shaped reservoir portion is raised above (i.e., away from the face of the bottom portion in the direction of the side walls) the bottom portion. A roughly square perforation is visible in the lower right (on the same side as, and opposite the hand) and extends through the liner sheet, which is nearer the viewer. A portion of the substrate sheet (behind the liner sheet, relative to the viewer) can be viewed through the perforation. The lighter coloration along the X-shaped reservoir portion, relative to the adjacent flat parts of the bottom portion, indicates that the liner sheet is delaminated from the substrate sheet at the reservoir portion. A space exists between the liner and substrate sheets in the X-shaped reservoir portion, into which liquid within the tray can enter by way of the perforation. The tray shown in FIG. 1 was formed by drawing a substrate sheet (behind the visible liner sheet and visible primarily through the perforation in FIG. 1) against a female mold by application of suction between the mold and the substrate sheet in a thermoforming apparatus. The liner sheet remained laminated against the substrate sheet during this operation, except in the vicinity of the perforation and the reservoir portion that communicates with the perforation, resulting in delamination of the sheets in those portions, owing to the suction drawing the substrate sheet against the mold, but air passing through the perforation and into the X-shaped reservoir portion allowing the substrate sheet to remain separate from the substrate sheet. The relatively sharp boundaries between the X-shaped reservoir portion, the flat regions of the bottom portion, and between the ends of the X-shaped reservoir portion and the adjacent regions of the lower transition region were pinched off during thermoforming by drawing of the substrate sheet and laminated liner sheet against the mold in these portions, preventing air from passing into the perforation, through the reservoir portion and into these adjacent areas. The liner sheet remains tightly laminated against the substrate sheet at portions adjacent the reservoir portion.

FIG. 2 is an image of a tray formed in the same manner as that shown in FIG. 1, except that the perforation is situated in the lower transition region, rather than on the X-shaped reservoir portion. Because the relatively sharp mold forms between the flat regions of the bottom portion and the first transition region, the flat regions are pinched off from the perforation during thermoforming, and the substrate and liner sheets remain laminated against one another in those regions. Because the perforation permits air flow among the perforation, the lower transition region, and the X-shaped reservoir portion proximal to the boundary between the lower transition region, and because the X-shaped reservoir portion is pinched off by the shape of the mold during the thermoforming operation, the substrate and liner sheets remain become un-laminated in both the lower transition region and the X-shaped reservoir portion, as the mold suction draws the substrate sheet away from the liner sheet while the perforation permits air flow into the space between the two sheets.

The information in this disclosure refers to subject matter previously disclosed in other patent documents, including U.S. Pat. No. 7,721,910, U.S. patent application Ser. No. 12/620,460, U.S. patent application publication number 2010/0200596, and international patent application publication number WO 2011/130268, each of which is incorporated herein by reference.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A container for sequestering contents, the container comprising a substrate having a shaped portion, a liner sheet that conforms to and is reversibly attached to the shaped portion, and a lidding attached to the liner sheet, the lidding, the liner sheet, and their attachment defining a closed compartment for sequestering the contents, whereby the liner sheet and attached lidding can be detached from the substrate without rupturing the compartment.

2. The container of claim 1, wherein the liner sheet is peelably adhered to the shaped portion.

3. The container of claim 2, wherein the liner sheet is peelably adhered to substantially the entire shaped portion.

4. The container of claim 1, wherein the liner sheet is attached to the lidding by way of an adhesive interposed between the liner sheet and the lidding.

5. The container of claim 1, wherein the liner sheet is fused with the lidding.

6. The container of claim 1, wherein the liner sheet is peelably adhered to the lidding.

7. The container of claim 1, wherein lidding is attached to the liner sheet more tenaciously than the liner sheet is attached to the substrate.

8. The container of claim 1, having a liquid-exuding food product contained within the compartment.

9. The container of claim 1, wherein each of the liner and the lidding has a thickness of from about 1 mil to about 7 mils and the substrate sheet has a thickness of from about 10 mils to about 100 mils.

10. The container of claim 1, further comprising a perforated liner sheet interposed between the lidding and the liner sheet to segregate a reservoir from the remainder of the compartment.

11. The container of claim 10, further comprising an absorbent material contained within the reservoir.

12. The container of claim 1, wherein the substrate is thermoformable.

13. The container of claim 1, further comprising a tab interposed between the liner sheet and the substrate, whereby peeling of the liner sheet from the substrate is facilitated.

14. The container of claim 1, further comprising a tab interposed between the liner sheet and the lidding, whereby separation of the liner sheet and the lidding is facilitated.

15. The container of claim 1, further comprising an absorbent material contained within the compartment.

16. The container of claim 1, including a barrier layer between the substrate and the compartment, for preventing migration of non-desired substances from the substrate to the compartment.

17. The container of claim 16, wherein the liner sheet comprises the barrier layer.

18. The container of claim 1, wherein the substrate comprises a recycled material.

19. The container of claim 1, wherein the lidding has a reclosable opening disposed therein for facilitating access to and reclosing of the compartment.

20. The container of claim 1, having disposed between the lidding and the liner sheet a reclosable opening for facilitating access to and reclosing of the compartment.

* * * * *